US012270147B2

(12) United States Patent
Jang et al.

(10) Patent No.: US 12,270,147 B2
(45) Date of Patent: Apr. 8, 2025

(54) LAUNDRY TREATMENT APPARATUS

(71) Applicant: LG Electronics Inc., Seoul (KR)

(72) Inventors: Semin Jang, Seoul (KR); Jaehyung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/257,702

(22) PCT Filed: Dec. 30, 2021

(86) PCT No.: PCT/KR2021/020272

§ 371 (c)(1),
(2) Date: Jun. 15, 2023

(87) PCT Pub. No.: WO2022/146073

PCT Pub. Date: Jul. 7, 2022

(65) Prior Publication Data

US 2024/0052553 A1 Feb. 15, 2024

(30) Foreign Application Priority Data

Dec. 31, 2020 (KR) ..... 10-2020-0189127

(51) Int. Cl.
*D06F 87/00* (2006.01)
*D06F 63/00* (2006.01)
(Continued)

(52) U.S. Cl.
CPC ..... *D06F 87/00* (2013.01); *D06F 63/00* (2013.01); *D06F 67/005* (2013.01); *D06F 67/02* (2013.01); *D06F 67/10* (2013.01)

(58) Field of Classification Search
CPC ..... D06F 87/00; D06F 63/00; D06F 63/02; D06F 67/005; D06F 67/02; D06F 67/10; D06F 65/00; D06F 65/02; D06F 65/08
See application file for complete search history.

(56) References Cited

U.S. PATENT DOCUMENTS 3,765,580 A * 10/1973 Wilsker ..... D06F 73/02 68/5 D
4,980,981 A * 1/1991 Naidoo ..... D06F 69/00 38/144
(Continued)

FOREIGN PATENT DOCUMENTS

KR 20110048343 A * 5/2011
KR 10-1220579 B1 1/2013
(Continued)

OTHER PUBLICATIONS

International Search Report and Written Opinion in International Appln. No. PCT/KR2021/020272, mailed on Apr. 26, 2022, 13 pages.
(Continued)

*Primary Examiner* — Ismael Izaguirre
(74) *Attorney, Agent, or Firm* — Fish & Richardson P.C.

(57) ABSTRACT

The present disclosure relates to a laundry treatment apparatus including a cabinet having an inlet, a door rotatably coupled to the cabinet so as to open and close the inlet, a door inner plate positioned at the door, a laundry hanger support provided on the door inner plate, abase plate coupled to the door inner plate, a rotating shaft provided in a width direction of the door, a roller rotating about the rotating shaft, a moving unit supporting the rotating shaft and moving the rotating shaft and the roller in a vertical direction of the door due to rotation of the roller, and a drive unit provided at the roller or the moving unit so as to rotate the roller.

27 Claims, 19 Drawing Sheets

(51) Int. Cl.

| | |
|---|---|
| ***D06F 67/00*** | (2006.01) |
| ***D06F 67/02*** | (2006.01) |
| ***D06F 67/10*** | (2006.01) |

(56) References Cited

U.S. PATENT DOCUMENTS

| | | | | |
|---|---|---|---|---|
| 9,469,934 | B2 * | 10/2016 | Alrefaei | A47G 25/14 |
| 2012/0222337 | A1 * | 9/2012 | Grange | D06F 61/02 38/101 |
| 2015/0020419 | A1 | 1/2015 | Park et al. | |
| 2019/0249356 | A1 | 8/2019 | Lim et al. | |
| 2019/0376226 | A1 | 12/2019 | Yoon et al. | |

FOREIGN PATENT DOCUMENTS

| | | | | |
|---|---|---|---|---|
| KR | 20180083740 | A | * | 7/2018 |
| KR | 10-2019-0116095 | | | 10/2019 |
| KR | 10-2020-0081084 | | | 7/2020 |

OTHER PUBLICATIONS

Extended European Search Report in European Appln. No. 21915870.6, mailed on Oct. 11, 2024, 6 pages.

* cited by examiner

[Fig. 1]
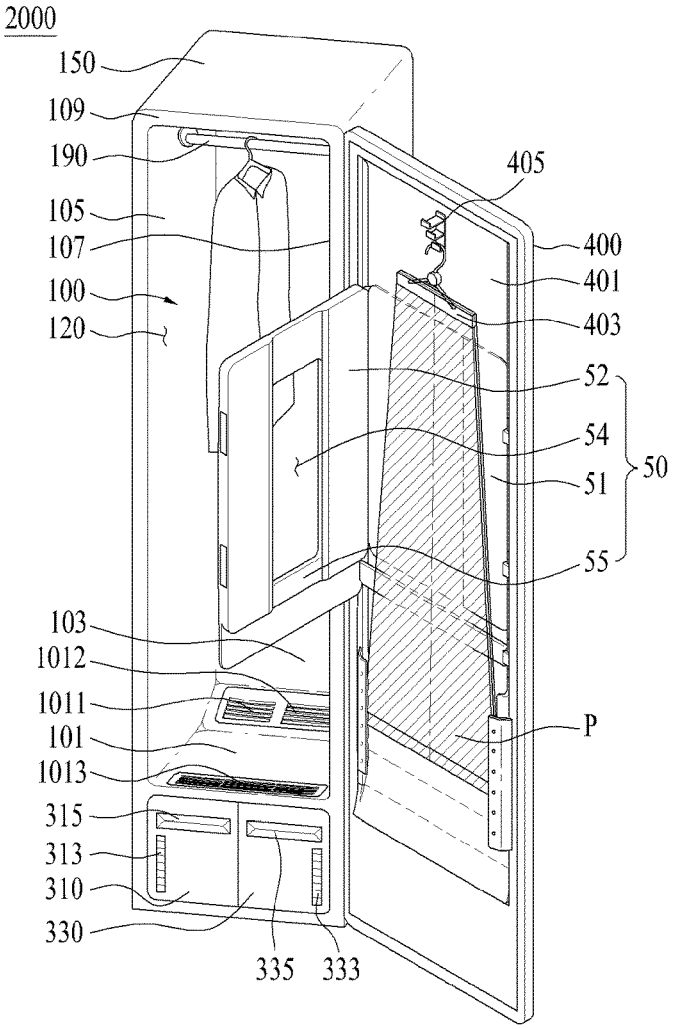
[Fig. 2]
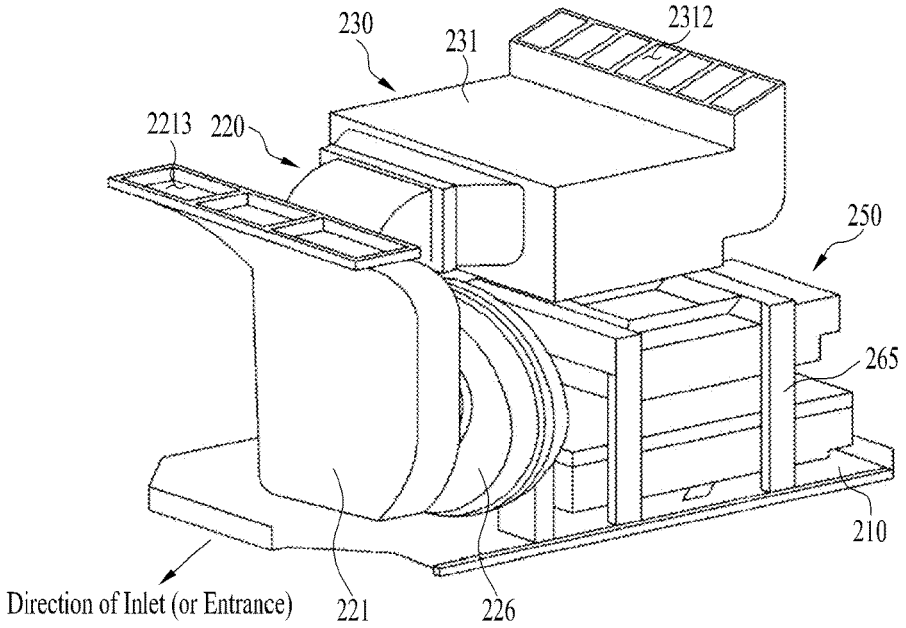

[Fig. 3]
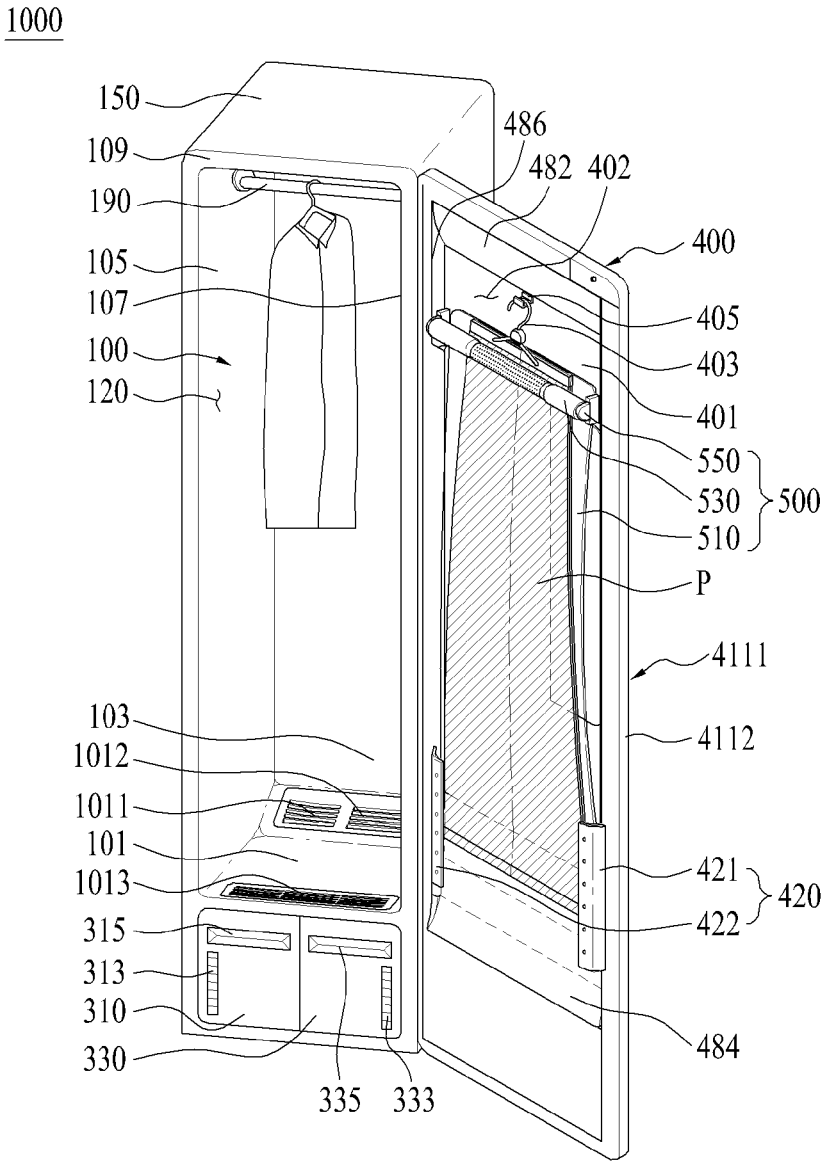

[Fig. 4]
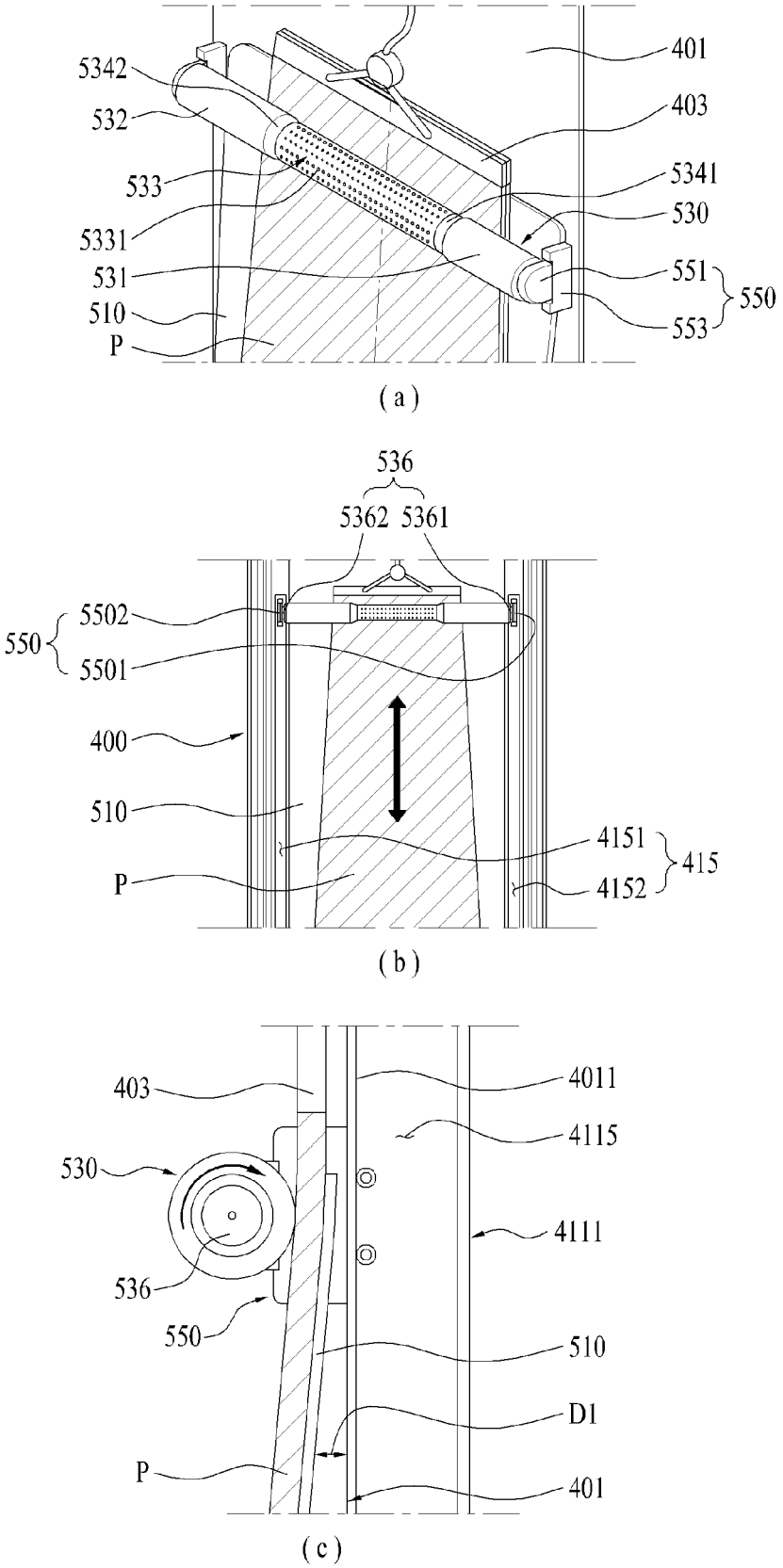

[Fig. 5]
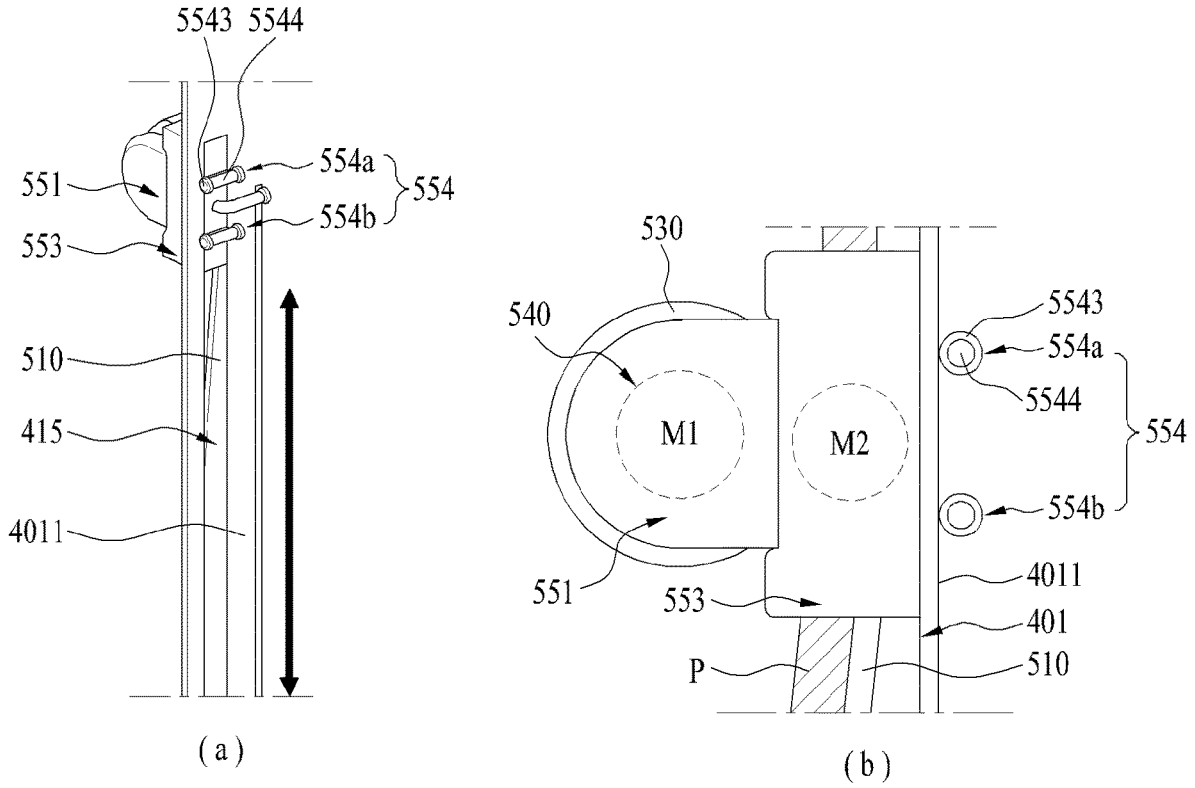

[Fig. 6]
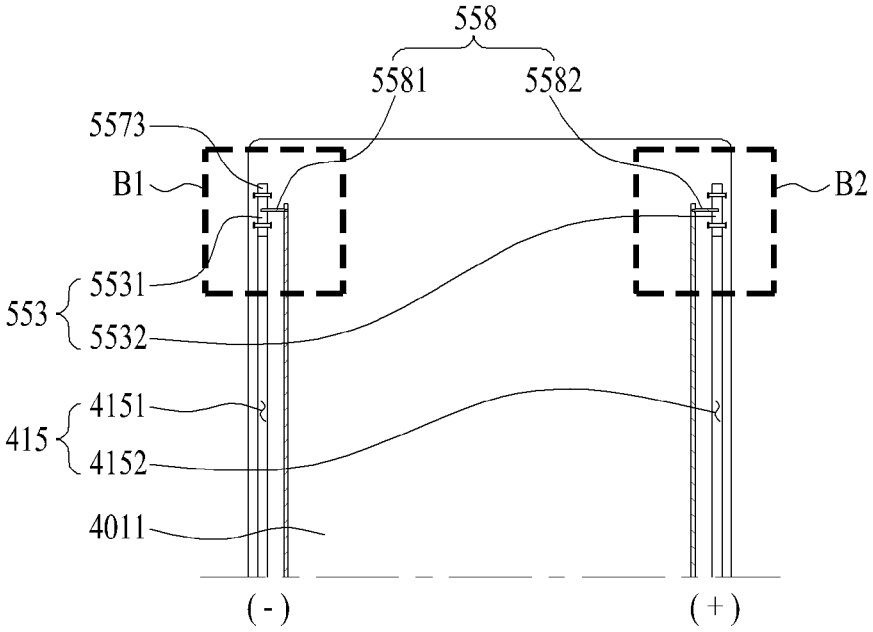
( a )
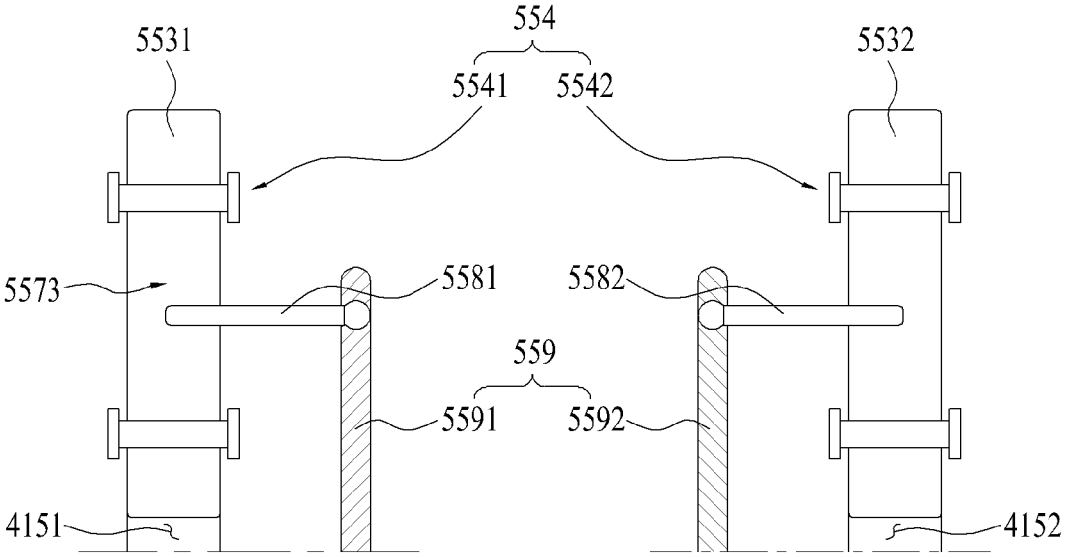
( b ) ( c )

[Fig. 8]
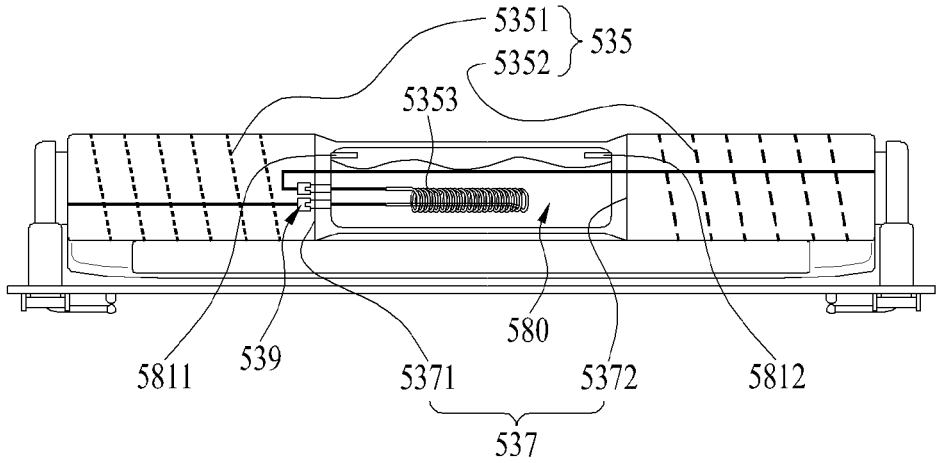
(a)
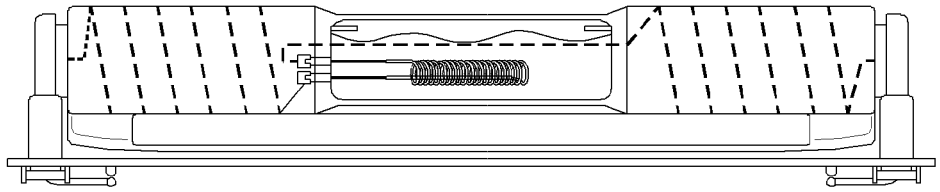
(b)
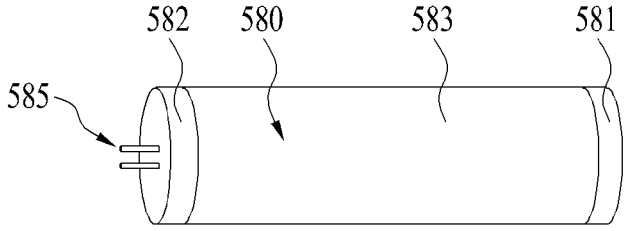
(c)

[Fig. 9]
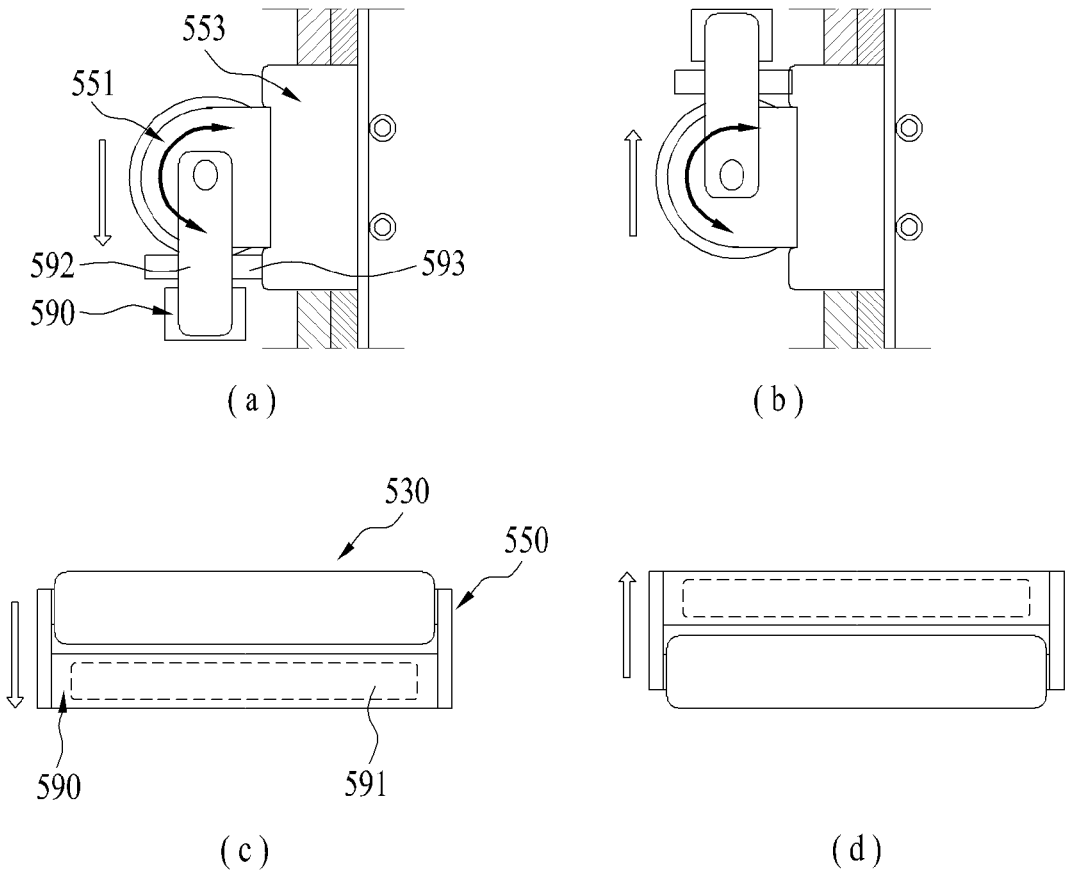

[Fig. 10]
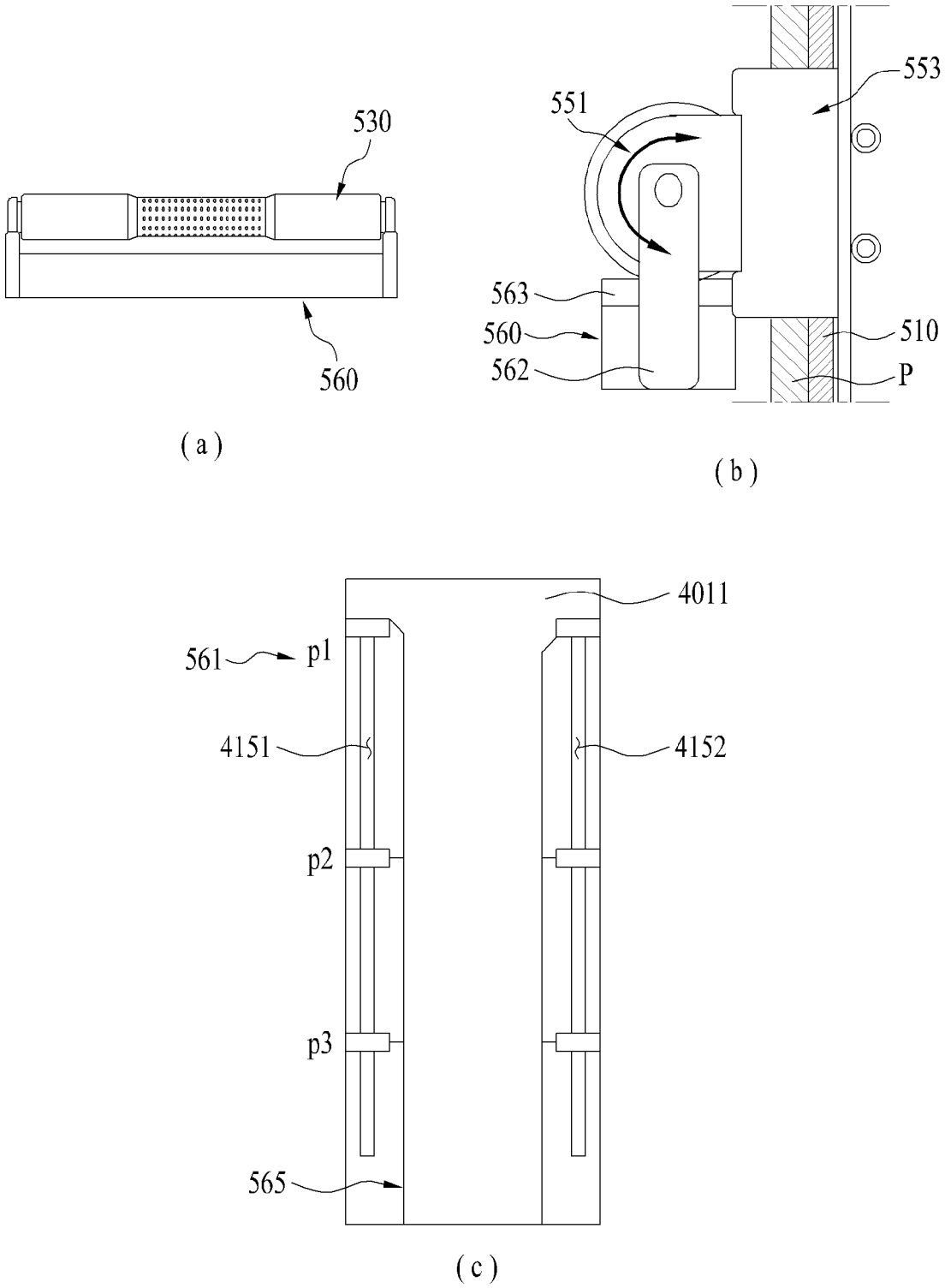

[Fig. 11]
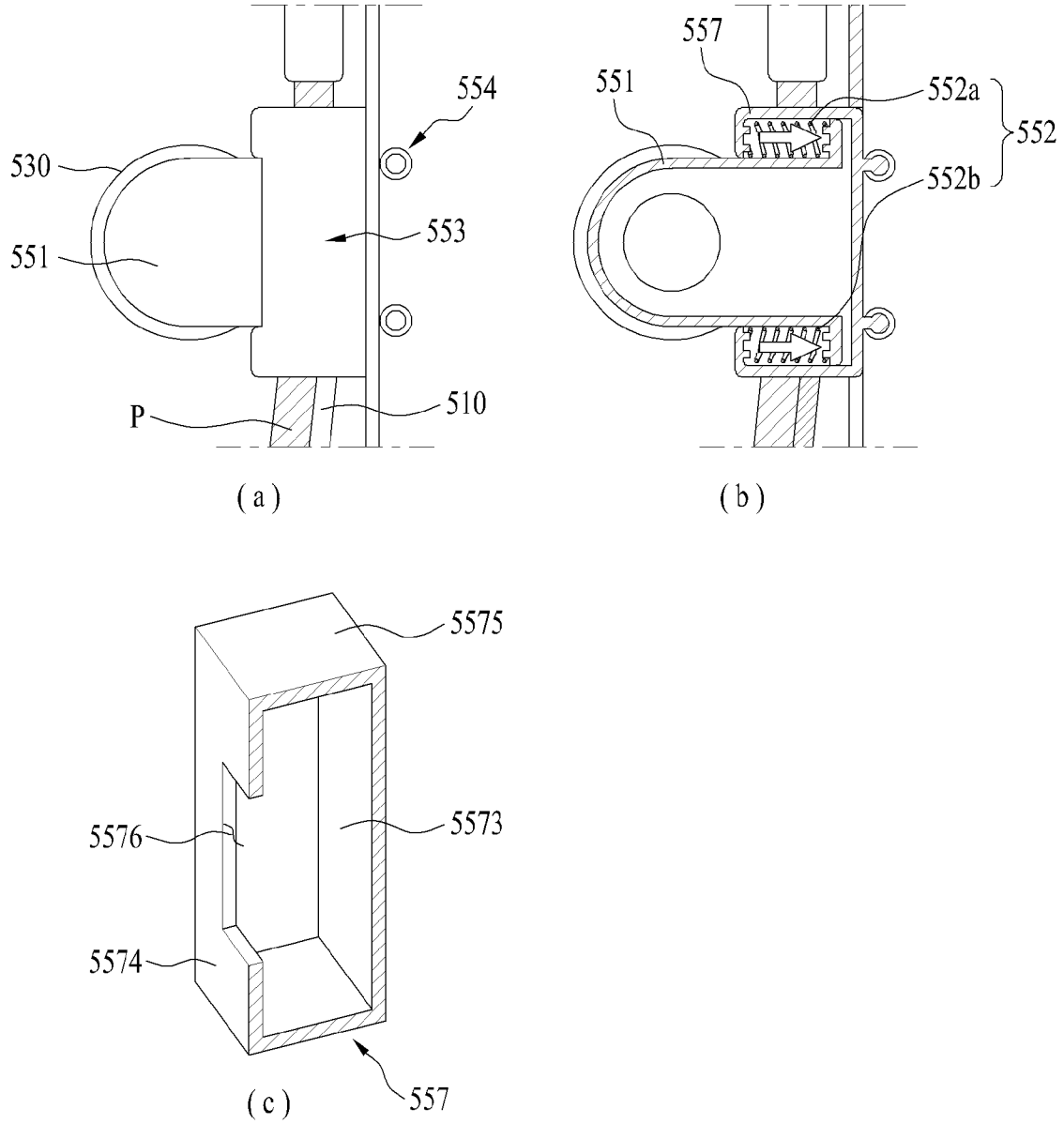

[Fig. 12]
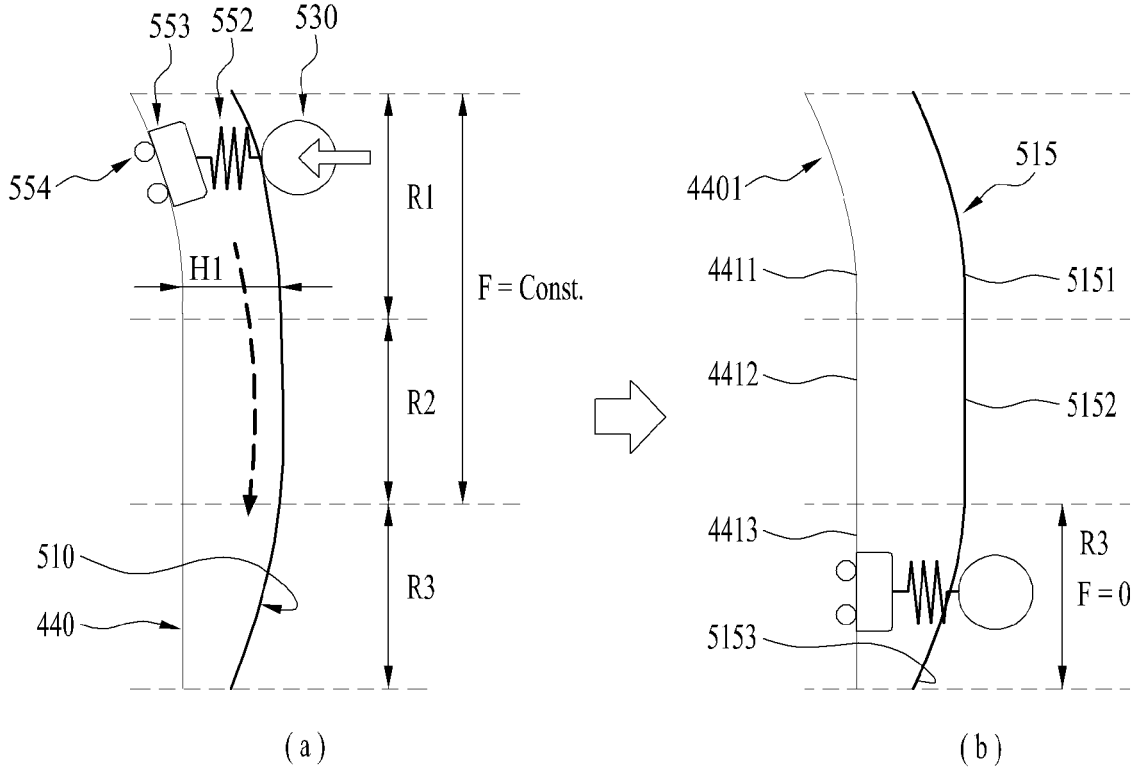
[Fig. 13]
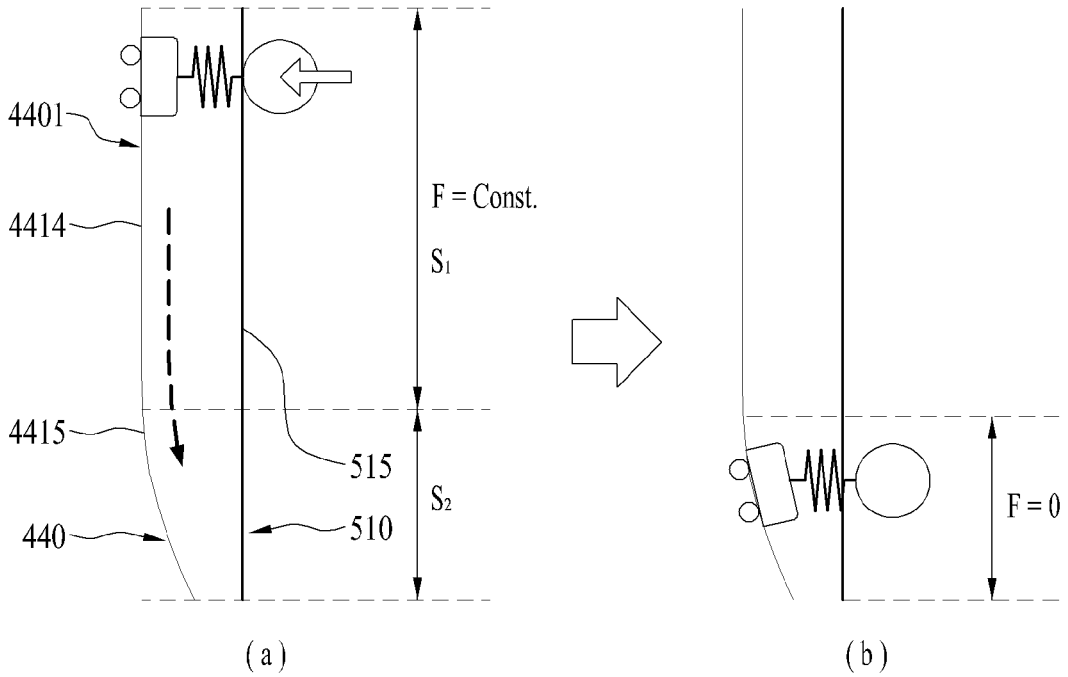

[Fig. 14]
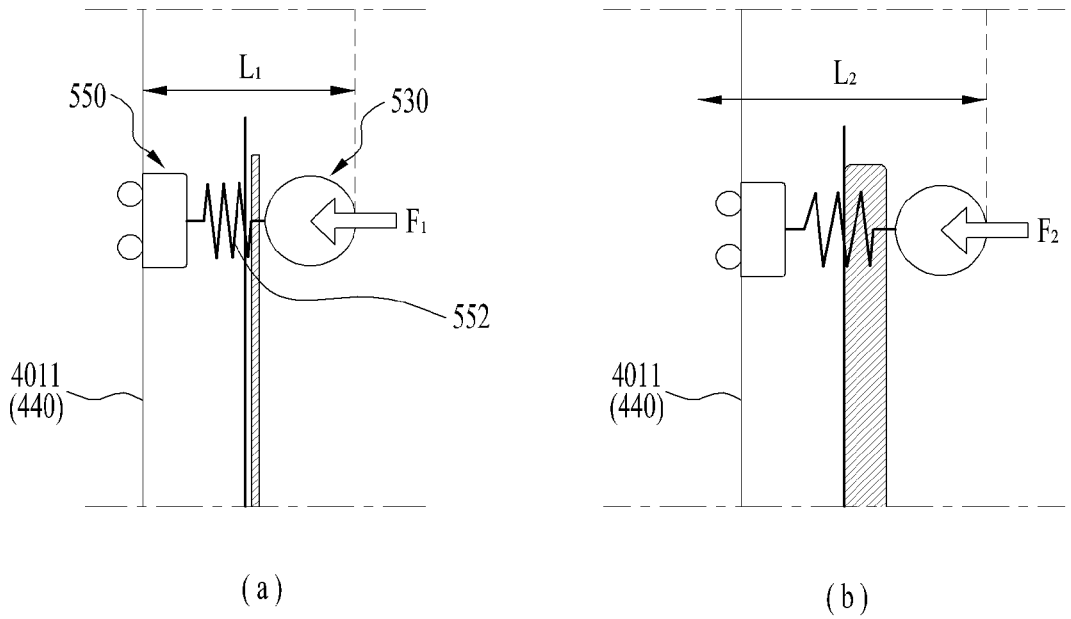

[Fig. 15]
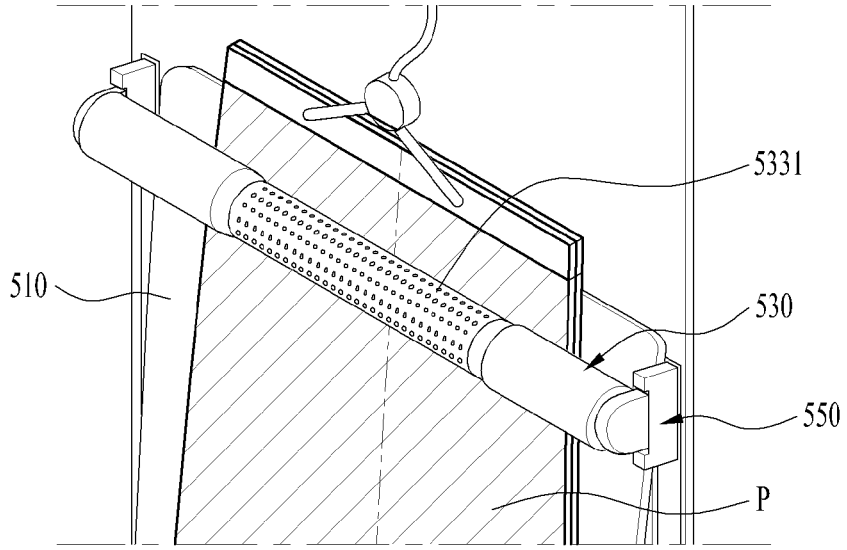
(a)
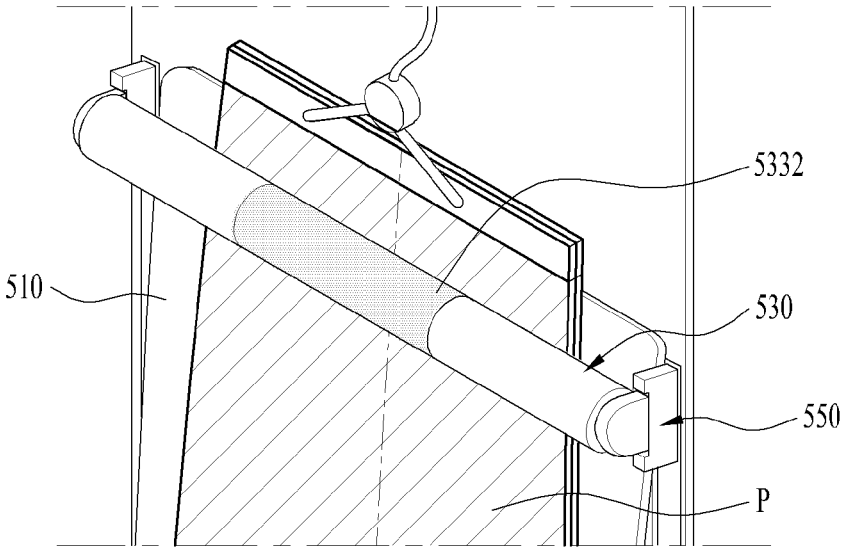
(b)

[Fig. 16]
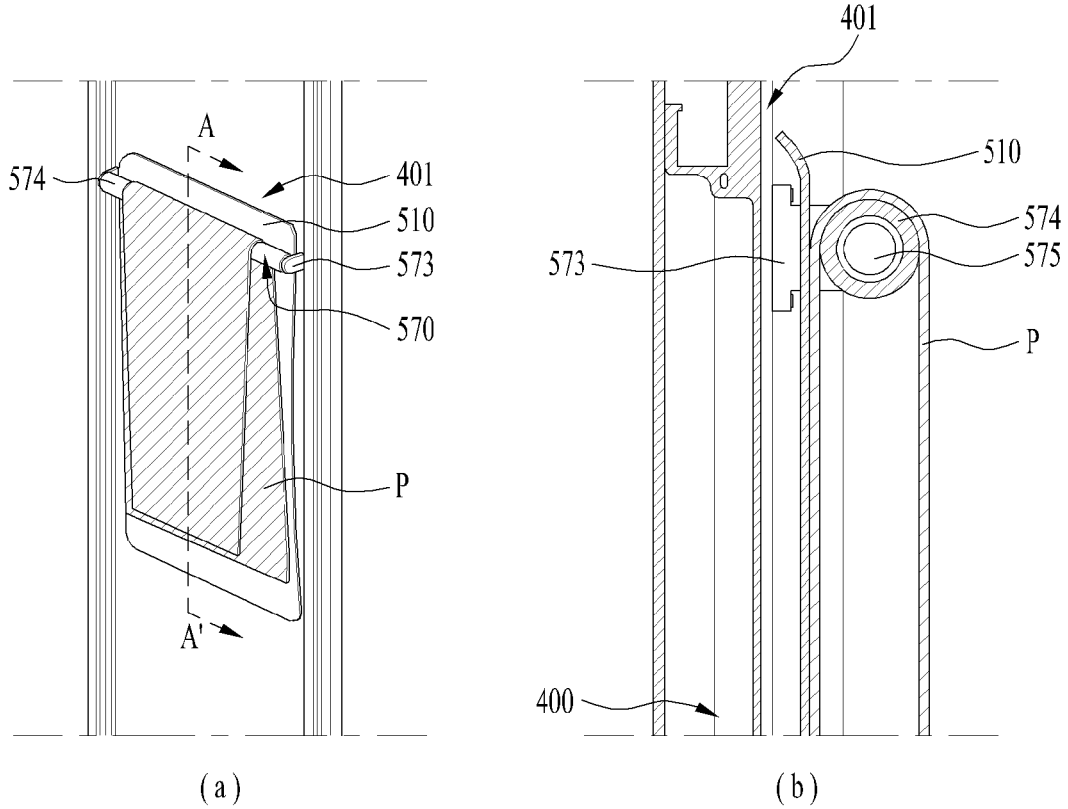
[Fig. 17]
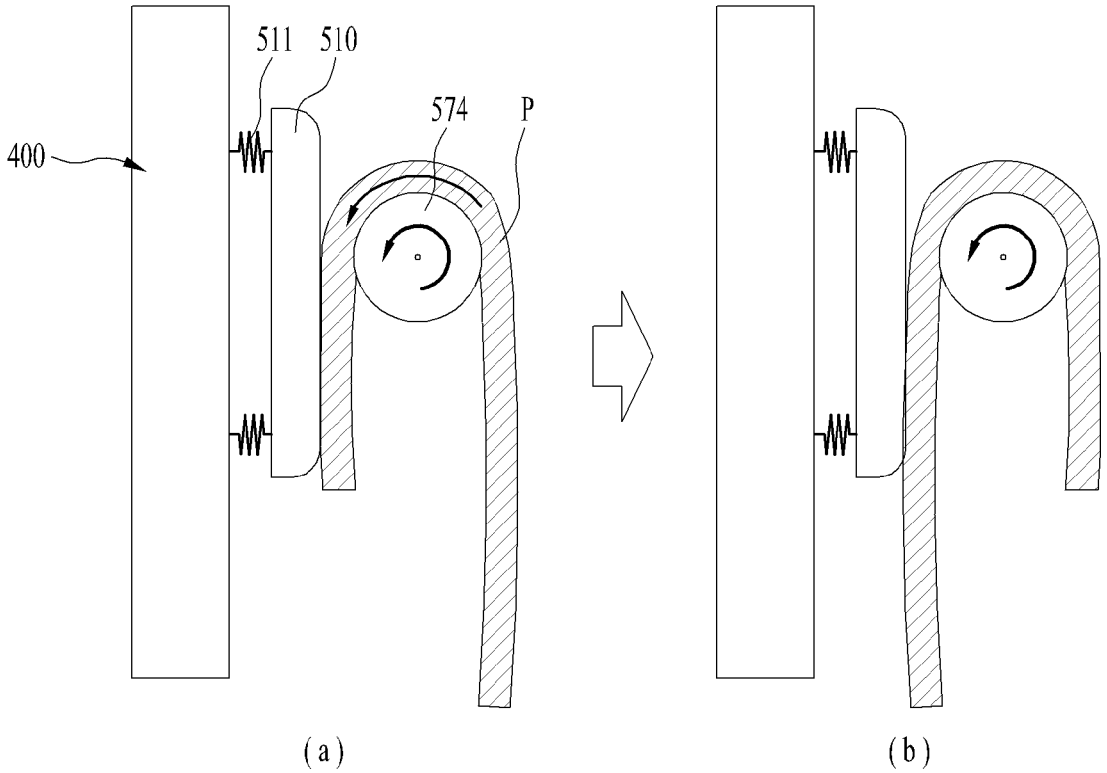

[Fig. 18]
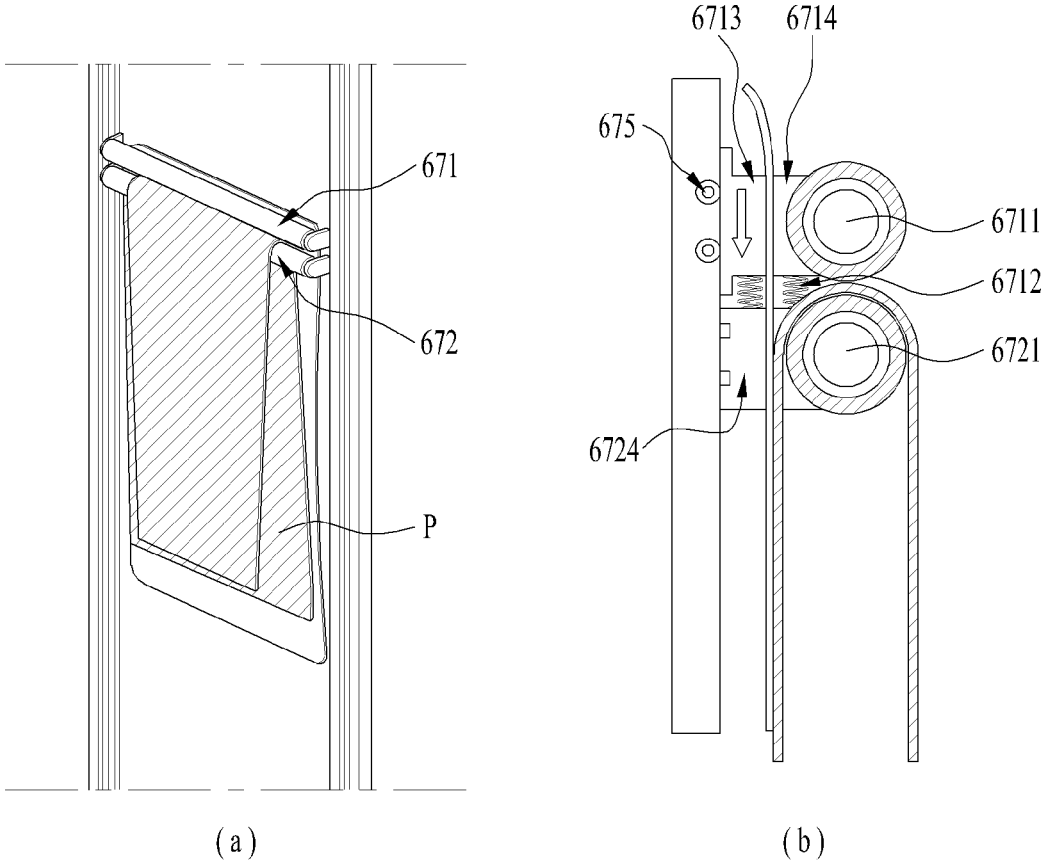

[Fig. 19]
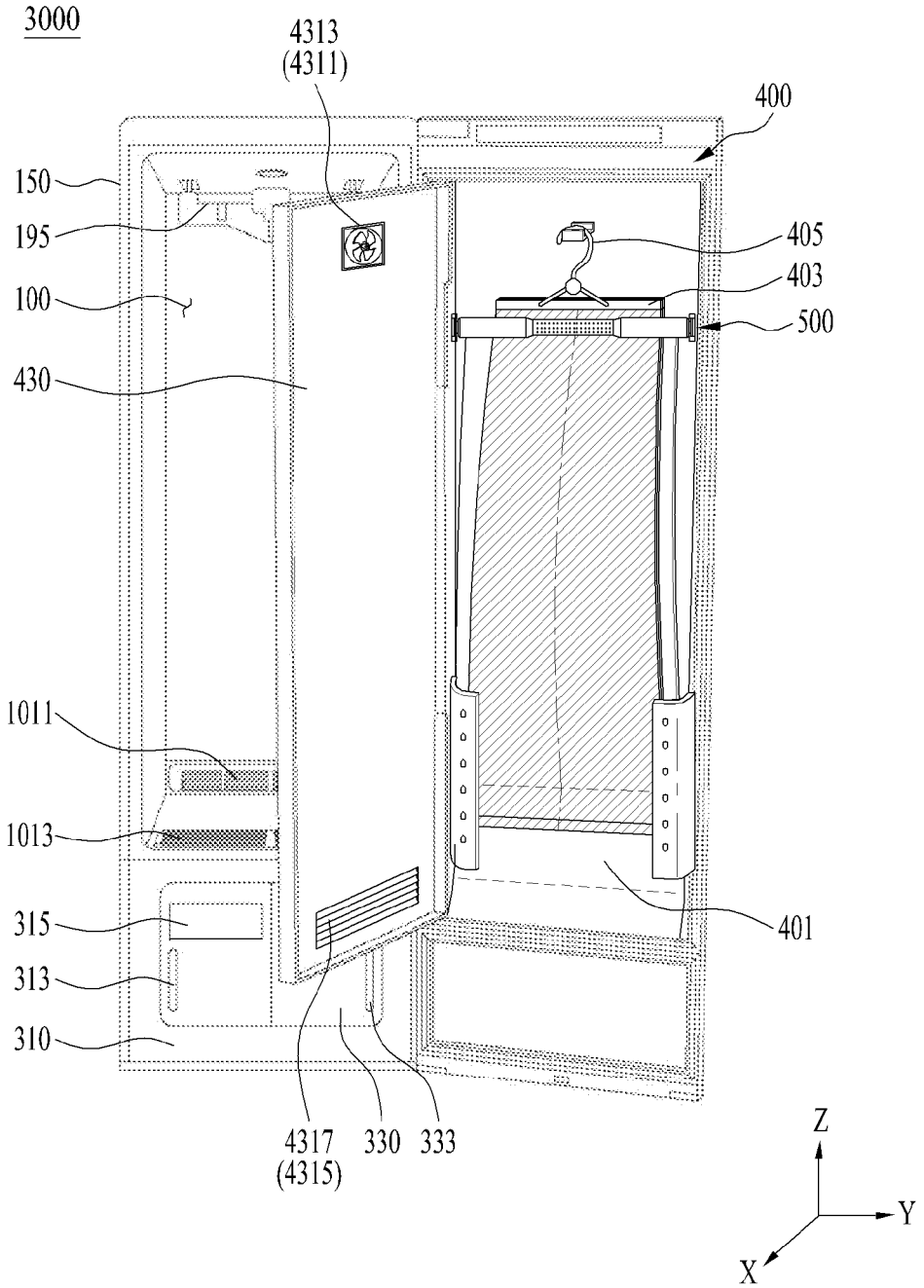

[Fig. 20]
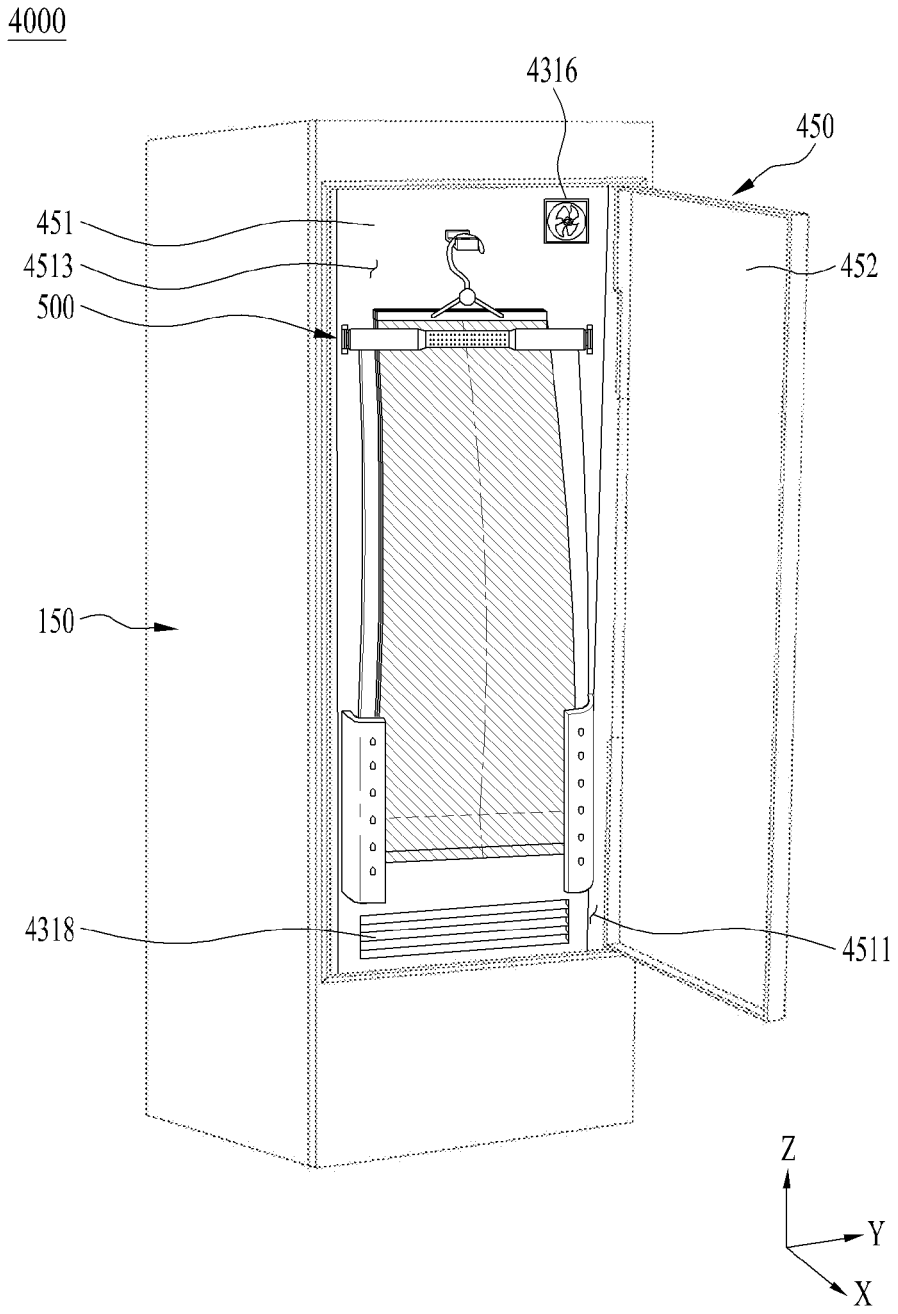

[Fig. 21]
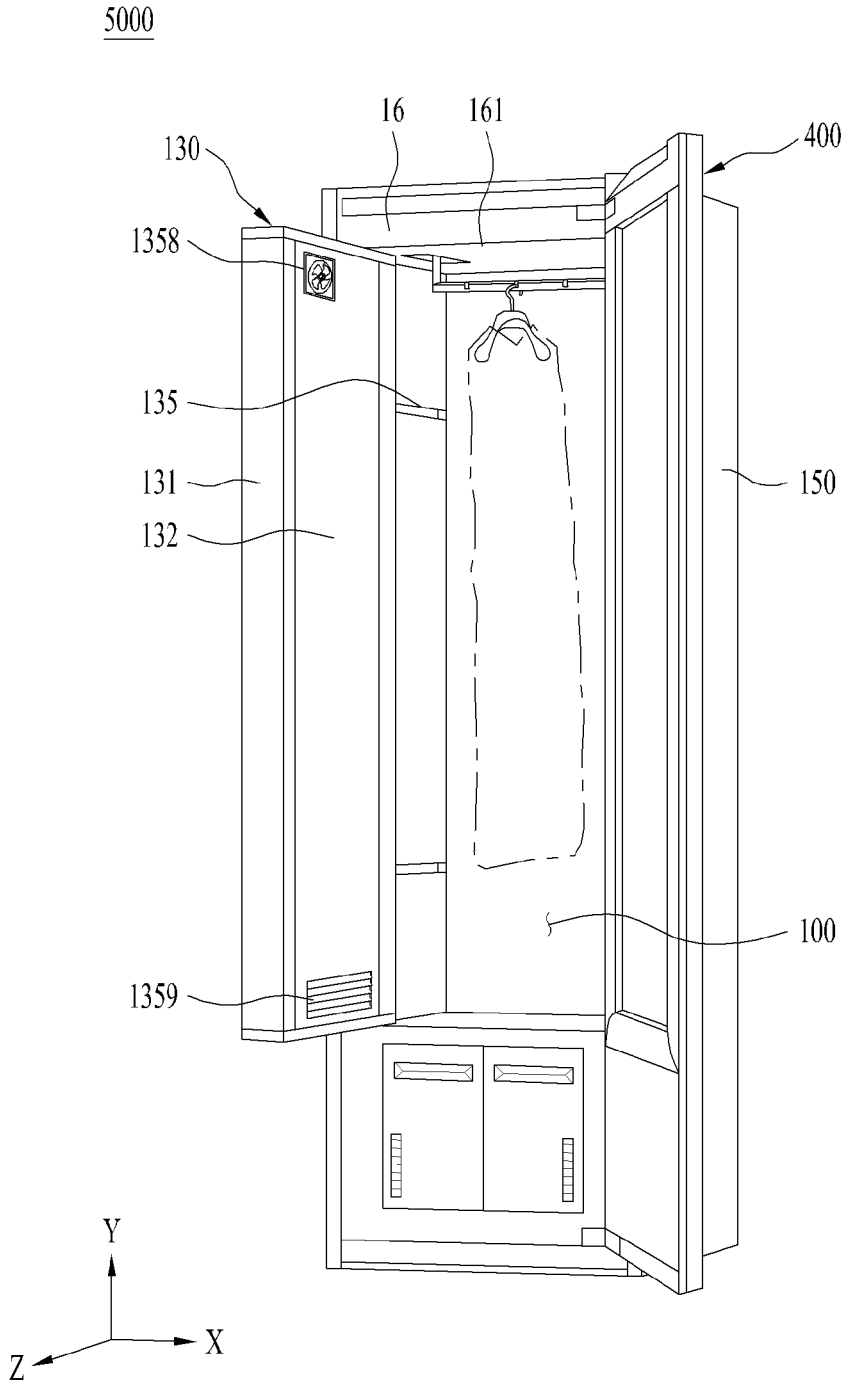

[Fig. 22]
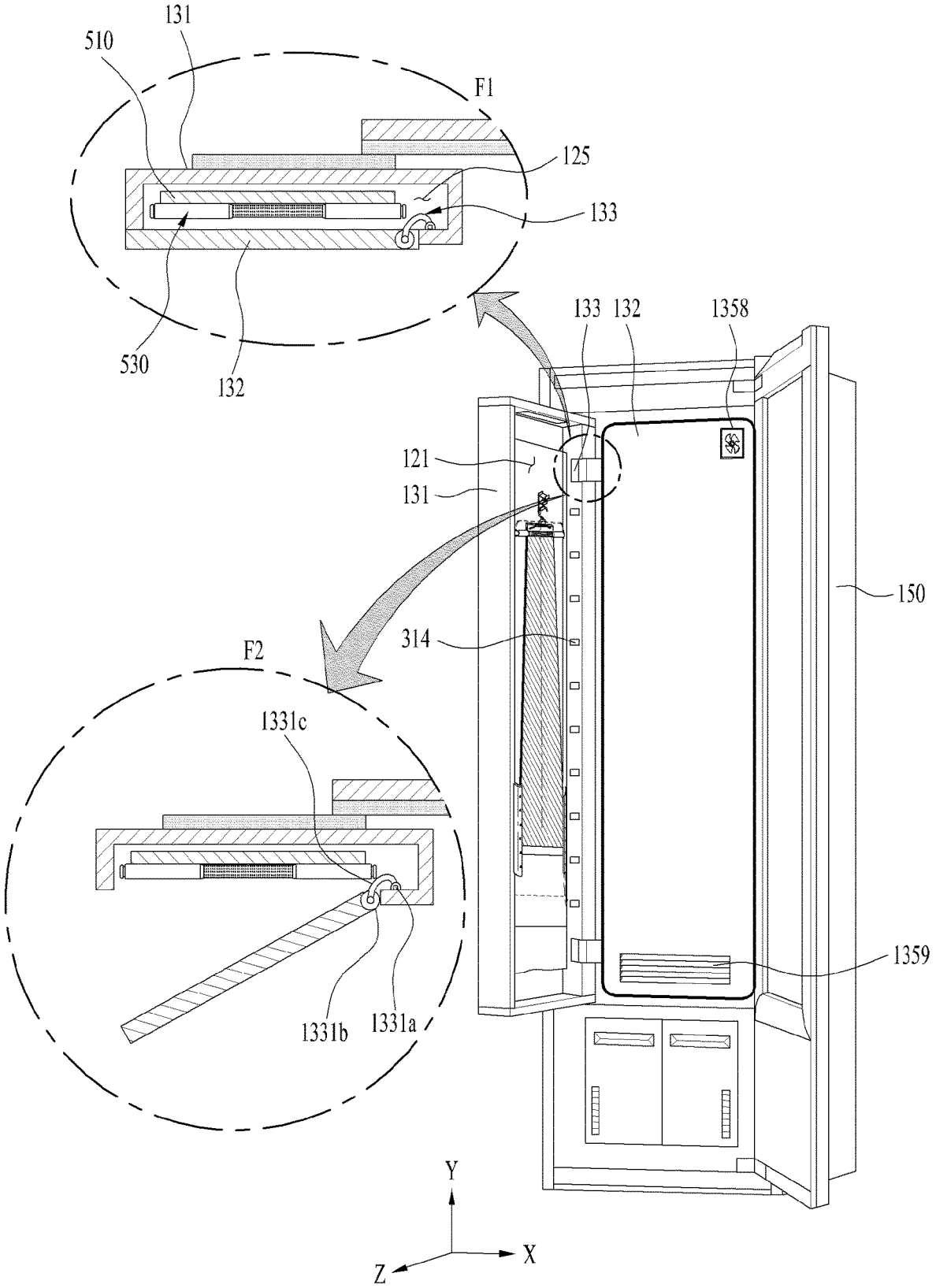

LAUNDRY TREATMENT APPARATUS

CROSS-REFERENCE TO RELATED APPLICATIONS

This application is a National Stage application under 35 U.S.C. § 371 of International Application No. PCT/KR2021/020272, filed on Dec. 30, 2021,which claims the benefit of Korean Application No. 10-2020-0189127, filed on Dec. 31, 2020. The disclosures of the prior applications are incorporated by reference in their entirety.

TECHNICAL FIELD

The present disclosure relates to a laundry treatment apparatus, and more particularly to a laundry treatment apparatus configured to press laundry via a roller to thus remove wrinkles from the laundry while exposing the laundry to steam.

BACKGROUND ART

A laundry treatment apparatus refers to an apparatus designed to wash and dry laundry and to remove wrinkles from laundry in a home or a laundromat shop. Those classified into a laundry treatment apparatus may include a washing machine configured to wash laundry, a drying machine configured to dry laundry, a combined washing and drying machine configured to perform both washing and drying, a laundry management machine configured to refresh laundry, and a steamer configured to remove wrinkles from laundry.

A steamer is an apparatus configured to supply steam to laundry in order to remove wrinkles from the laundry. Unlike a typical iron, a steamer is an apparatus configured to remove wrinkles from laundry by applying heat to the laundry via convection without directly applying heat to the laundry (in such a manner as to bring the laundry into contact with a hard object).

Meanwhile, a laundry management machine is an apparatus configured to maintain laundry in a refreshed and clean state. The laundry management machine may be configured to brush dust off of laundry, remove odors from the laundry, dry the laundry, and apply a scent to the laundry. Furthermore, the laundry management machine may serve to prevent the generation of static electricity, remove wrinkles from laundry using dehumidified air or steam, and sterilize the laundry.

Korean Patent Registration Publication No. 10-1220579 discloses a steam supply configured to spray steam. However, because the steam supply serves to supply only steam to laundry without applying tensile force or compressive force to the laundry, there is a limitation on ability to remove wrinkles.

Korean Patent Registration Publication No. 10-2099179 discloses a laundry treatment apparatus. The laundry treatment apparatus is capable of performing deodorization and removal of wrinkles by supplying hot air to a supply part positioned below a cabinet or pressing laundry in the state in which the laundry is disposed in the reception space in the cabinet.

In addition, the laundry treatment apparatus is capable of performing drying, deodorization and removal of wrinkles by supplying hot air or steam to laundry in the state in which the laundry is stretched by its own weight in a cabinet. Furthermore, the laundry treatment apparatus offers an effect of efficiently removing wrinkles from pants or forming creases in the pants and obviating ironing after completion of washing or drying by pressing the surfaces of the pants using a presser provided on the inner surface of a door.

Particularly, the laundry treatment apparatus is provided on the inner surface of the door with a pants treatment unit (or a press unit), which is also referred to as a presser or a pants press configured to remove unwanted wrinkles or folds and form creases or pleats (intended in the design stage of the pants) in the pants using steam.

The presser is configured to press the pants by rotation on one side surface of the pants. However, because the presser is operated in such a manner as to press the pants beginning from one side surface of the pants, there is no other choice but to sequentially press the pants from the one side surface to the other side surface of the pants. In this case, because higher pressure is applied to the portion of the pants close to the presser and lower pressure is applied to the portion of the pants far away from the presser, there is a problem in which the pants are not uniformly pressed. As a result, there is a problem in that the shape of the pants becomes deformed or the position of the pants is changed due to being pushed by the presser while the pants are pressed by the presser.

Furthermore, the conventional laundry treatment apparatus poses a problem in that a larger number of creases are formed or creases are formed in a direction completely different from an intended direction.

In addition, because steam and hot air must necessarily be supplied in a treatment chamber, there may be excessive expenditure in that steam and hot air must be supplied throughout the entire treatment chamber in order to remove wrinkles from only one pair of pants. Furthermore, the amount of steam that permeates laundry may be reduced due to a press plate.

In order to solve the above problems, Korean Unexamined Patent Publication No. 10-2011-0048343 discloses a clothing treatment apparatus equipped with a scanner, which is configured to apply steam, hot air or heat to pants in the state in which the pants are tightly stretched and fixed to a door inner plate. The scanner is capable of applying steam, hot air, or heat to the fixed pants while moving up and down in the vertical direction of a door. However, due to a rail provided at a base plate, pants are not supported by the base plate but are held at the upper and lower ends thereof by clips, and the scanner provided between the pants and the base plate applies steam, hot air or heat to the pants to remove wrinkles from the pants in the state in which tensile force is applied to the pants. Accordingly, because wrinkles are removed from the pants using the tensile force, the fabric of the pants may be permanently stretched upon repeated use. Furthermore, the treatment process in which the scanner slides along the rail as in ironing while the pants are merely pulled by the tensile force exposes limitations on removal of wrinkles or formation of clearly visible pants' leg creases. In addition, because the scanner is not constructed so as to be rotated, the pants may be pushed when the scanner moves up and down.

In addition, Korean Unexamined Patent Publication No. 10-2011-0048343 discloses the scanner configured to apply steam and/or heat to laundry while moving up and down in the vertical direction of a door in the state in which the laundry is fixed to a door inner plate. However, there is a problem in which the scanner cannot avoid interference with stitch lines, which are positioned at the center of the laundry, because the contact area between the scanner and the laundry is constant. In addition, because there is no space for spraying steam between laundry and the nozzle of the scanner, the steam spraying may be insufficiently performed.

In addition, Korean Unexamined Patent Publication No. 10-2018-0083740 discloses a laundry treatment apparatus, which includes a roller capable of moving while pressing pants after the pants are disposed on a base plate. The roller is passively rotated by means of a moving unit, which is moved in the vertical direction of a door, and steam or hot air is sprayed through the base plate. In practice, because the pants are not disposed over the entire area of the base plate, the pressure in the region blocked by the pants is higher than the pressure in the region not blocked by the pants, and thus steam nozzles positioned in the region not blocked by the pants spray a larger amount of steam, thereby wasting steam and hot air.

In addition, Japanese Unexamined Patent Publication No. 1988-500354 discloses an automatic ironing apparatus. Here, because a moving unit is moved in the longitudinal direction of the automatic ironing apparatus, two rollers, which are disposed before and after laundry, serve merely to press the laundry while being passively rotated. Furthermore, because the cross section of the portion of the roller which comes into contact with laundry is constant, there is a problem whereby it is impossible to avoid interference with stitch lines in the laundry.

In addition, Korean Unexamined Patent Publication No. 10-2020-0081146 discloses a laundry treatment apparatus in which a roller winds pants while moving up and down and sprays steam. However, when the extent to which the pants are wound around the roller increases, the holes in the roller through which steam is discharged are blocked, thereby making it difficult to spray a sufficient amount of steam in a short period of time. Furthermore, because there is no consideration given to portions of pants such as stitch lines, the pants continuously slip laterally as the pants are wound around the roller, thereby making it impossible to remove wrinkles as desired.

DISCLOSURE OF INVENTION

Technical Problem

One technical task of the present disclosure is to remove wrinkles by efficiently and uniformly pressing laundry in a limited space.

Another technical task of the present disclosure is to spray steam only to laundry from which wrinkles are to be removed, rather than all of the laundry contained in the chamber, and to heat and press the laundry.

Another technical task of the present disclosure is to minimize double creases by uniformly pressing laundry.

Another technical task of the present disclosure is to press laundry with a constant pressure regardless of the thickness of the laundry.

Another technical task of the present disclosure is to prevent a portion of laundry that does not need to be pressed from being pressed.

Another technical task of the present disclosure is to independently operate only a press unit without operating the entire machine compartment by spraying steam only to laundry from which wrinkles are to be removed.

Another technical task of the present disclosure is to independently operate only a press unit even when a door is open.

Another technical task of the present disclosure is to supply power during upward and downward movement of a roller and to minimize exposure of a power supply to moisture or water.

Another technical task of the present disclosure is to minimize the amount of steam by spraying steam only to the pants to be treated. Furthermore, another technical task of the present disclosure is to minimize energy consumption by heating the pants to be treated.

Another technical task of the present disclosure is to minimize the size of a water supply passage or a steam passage during spray of steam.

Another technical task of the present disclosure is to prevent the generation of wrinkles caused by pressing of stitch lines in laundry by a roller.

Another technical task of the present disclosure is to improve energy efficiency and user convenience by operating only a pants treatment unit.

Solution to Problem

In order to achieve the above tasks, the present disclosure provides a laundry treatment apparatus configured to form intended crease having a desired length in pants and to remove wrinkles by pressing the pants using a roller during rotation of the roller. The roller is capable of moving in the vertical direction of a door. Because pants may be pushed when the roller moves while pressing the pants, the roller is capable of moving in the vertical direction while rotating by itself in order to prevent this problem. In order to avoid stitch lines of the pants, the roller is configured so as to be depressed in the intermediate portion thereof. A mount supporting two ends of the roller is moved along a guide hole or a guide formed in a door inner plate, thereby guiding vertical movement of the roller.

In order to achieve the above tasks, the present disclosure provides a laundry treatment apparatus including a cabinet including an inlet defined in one side thereof, a first chamber positioned in the cabinet and receiving laundry therein through the inlet, a second chamber positioned below the first chamber and defining a space separated from the first chamber, a door rotatably coupled to the cabinet so as to open and close the inlet, a door inner plate positioned at the side of the door that faces the first chamber, a laundry hanger support provided on the door inner plate and supporting pants hung thereon, a base plate coupled to the door inner plate and supporting the pants hung on the laundry hanger support, a rotating shaft provided in the width direction of the door, a roller rotating about the rotating shaft and pressing the pants, a moving unit supporting the rotating shaft and moving in the vertical direction of the door due to rotation of the roller, and a drive unit provided at the roller or the moving unit so as to rotate the roller.

The roller may include a first cylindrical press positioned close to one end of the roller so as to press the pants, a second cylindrical press positioned close to another end of the roller so as to press the pants, and a cylindrical moisture supply, which is positioned between the first press and the second press so as to connect the first press to the second press and which supplies moisture to the pants.

The moisture supply may have a diameter smaller than the diameter of the first press and the second press.

The moisture supply may include a steam generation tank positioned in the moisture supply and configured to store water therein and to discharge generated steam, a steam heater, which is positioned in the steam generation tank and heats the water stored in the steam generation tank, and a plurality of steam spray holes formed in the outer circumferential surface of the moisture supply so as to spray the steam, which is generated by the steam heater and discharged from the steam generation tank, to the pants.

The roller may further include a tank connector provided between one of the first press and the second press and the moisture supply so as to couple or separate the steam generation tank.

The roller may include a first heater provided in the first press so as to heat the first press, and a second heater provided in the second press so as to heat the second press.

The first heater and the second heater may be respectively provided along an inner circumferential surface of the first press and an inner circumferential surface of the second press.

The moisture supply may include a porous moisture-containing portion configured to have the form of a pipe surrounding the outer circumferential surface of the moisture supply and to contain moisture therein, the moisture-containing portion having a diameter equal to or greater than the diameter of the first press and the second press.

The door may include a guide hole formed through the door inner plate in the vertical direction of the door, and the moving unit may be movable along the guide hole in the vertical direction of the door when the roller is rotated.

The moving unit may include a moving mount, inserted partway into the guide hole and moved in the vertical direction of the door, and a moving support coupled to the moving mount so as to support the rotating shaft.

The moving unit may further include a wheel provided parallel to the width direction of the door and coupled to the surface of the moving mount that is inserted into the guide hole, the wheel having a length greater than the length of the guide hole in the width direction thereof in order to prevent the moving unit from being separated from the guide hole.

The moving unit may further include an elastic member positioned between the moving support and the moving mount so as to provide external force required in order for the roller to press the pants.

The moving unit may be moved along the guide hole in one direction among an upward direction and a downward direction when the roller is rotated in a first rotational direction, and may be moved along the guide hole in a direction opposite the one direction when the roller is rotated in a second rotational direction opposite the first rotational direction.

When rotation of the roller is halted, the movement of the moving unit may also be halted.

The steam heater may be a coil heater.

The moisture supply may include a first moisture supply body including a tank introduction port configured to allow the steam generation tank to be inserted into and separated from the moisture supply, and a second moisture supply body coupled to the tank introduction port.

The roller may be capable of supplying steam to the pants through the moisture supply and of pressing the pants while rotating even when the door is open.

The laundry treatment apparatus may further include a cover rotatably provided at the door or the door inner plate so as to open and close the laundry hanger support, the base plate, the rotating shaft, the roller, and the moving unit.

The rotating shaft may include a first rotating shaft, coupled to one end of the roller, and a second rotating shaft, coupled to another end of the roller.

The door may include a guide hole formed through the door inner plate in the vertical direction of the door, the moving unit may include a first transfer portion coupled to the first rotating shaft and a second transfer portion coupled to the second rotating shaft, the guide hole may include a first guide hole, formed between one side surface of the base plate and one side surface of the door positioned close to the one side surface of the base plate, and a second guide hole, formed between another side surface of the base plate and another side surface of the door positioned close to the another side surface of the base plate, the first transfer portion may be movable along the first guide hole in the vertical direction of the door when the roller is rotated, and the second transfer portion may be movable along the second guide hole in the vertical direction of the door when the roller is rotated.

In order to achieve the above tasks, the present disclosure provides a laundry treatment apparatus including a cabinet including an inlet defined in one side thereof, a first chamber positioned in the cabinet and receiving laundry therein through the inlet, a second chamber positioned below the first chamber and defining a space separated from the first chamber, a door rotatably coupled to the cabinet so as to open and close the inlet, a door inner plate positioned at the side of the door that faces the first chamber, a laundry hanger support provided on the door inner plate and supporting pants hung thereon, a base plate coupled to the door inner plate and supporting the pants hung on the laundry hanger support, a rotating shaft provided in the width direction of the door, a roller rotating about the rotating shaft and pressing the pants, the diameter of the outer circumferential surface of a region of the roller corresponding to a predetermined length in the direction of the rotating shaft being less than the diameter of the two ends of the roller, a moving unit supporting the rotating shaft and moving in the vertical direction of the door due to rotation of the roller, and a drive unit provided at the roller or the moving unit so as to rotate the roller.

In order to achieve the above tasks, the present disclosure provides a laundry treatment apparatus including a cabinet including an inlet defined in one side thereof, a first chamber positioned in the cabinet and receiving laundry therein through the inlet, a second chamber positioned below the first chamber and defining a space separated from the first chamber, a door rotatably coupled to the cabinet so as to open and close the inlet, a door inner plate positioned at the side of the door that faces the first chamber, a rotating shaft provided in the width direction of the door, a roller rotating about the rotating shaft and pressing the pants, a stationary support coupled to the door inner plate and supporting the rotating shaft and the roller at a fixed position, and a base plate coupled to the door inner plate so as to support the pants positioned between the base plate and the roller.

The roller may include a first cylindrical press positioned close to one end of the roller so as to press the pants, a second cylindrical press positioned close to another end of the roller so as to press the pants, and a cylindrical moisture supply, which is positioned between the first press and the second press so as to connect the first press to the second press and supplies moisture to the pants.

The moisture supply may have a diameter smaller than the diameter of the first press and the second press.

In order to achieve the above tasks, the present disclosure provides a laundry treatment apparatus including a cabinet including an inlet defined in one side thereof, a first chamber positioned in the cabinet and receiving laundry therein through the inlet, a second chamber positioned below the first chamber and defining a space separated from the first chamber, a door rotatably coupled to the cabinet so as to open and close the inlet, a door inner plate positioned at the side of the door that faces the first chamber, a base plate coupled to the door inner plate so as to press the pants, a first shaft provided in the width direction of the door, a first roller rotating about the first shaft, a first roller support supporting the first roller in such a manner as to move the first roller in the vertical direction of the door, a second shaft provided in the width direction of the door, a second roller rotating about the second shaft by rotation of the first roller and pressing the pants in cooperation with the first roller, a second roller support supporting the second roller at a fixed position, and an elastic connector disposed between the first roller support and the second roller support and connected thereto for transmission of elastic force therebetween so as to move the first roller toward the second roller.

Alternatively, in order to achieve the above tasks, the present disclosure provides a laundry treatment apparatus including a cabinet including an inlet defined in one side thereof, a first chamber positioned in the cabinet and receiving laundry therein through the inlet, a second chamber positioned below the first chamber and defining a space separated from the first chamber, and a door assembly rotatably coupled to the cabinet so as to open and close the inlet, wherein the door assembly includes a first door body having a door communication hole formed in one surface thereof, the first door body being rotatably coupled to the cabinet so as to open and close the inlet, a second door body rotatably coupled to the first door body so as to define a pants-pressing space separated from the first chamber in conjunction with the first door body and to open and close the door communication hole, a laundry hanger support positioned at one of the first door body and the second door body and in the pants-pressing space and supporting pants hung thereon, a base plate coupled to the one of the first door body and the second door body so as to support the pants disposed thereon, a rotating shaft provided in the width direction of the door assembly, a roller rotating about the rotating shaft and pressing the pants, a moving unit supporting the rotating shaft and moving the rotating shaft and the roller in the vertical direction of the door assembly due to rotation of the roller, and a drive unit provided at the roller or the moving unit so as to rotate the roller.

In order to achieve the above tasks, the present disclosure provides a laundry treatment apparatus including a cabinet including an inlet defined in one side thereof, a first chamber positioned in the cabinet and receiving laundry therein through the inlet, a second chamber positioned below the first chamber and defining a space separated from the first chamber, a door rotatably coupled to the cabinet so as to open and close the inlet, an inner chamber capable of being taken out of the first chamber through the inlet when the door is open, the inner chamber having a subsidiary entrance formed in one surface thereof and defining a reception space separated from the first chamber to receive pants therein, an inner door rotatably coupled to the inner chamber so as to open and close the subsidiary entrance, a laundry hanger support coupled to one of the inner surfaces of the inner chamber defining the reception space and supporting the pants hung thereon, a base plate positioned on the one of the inner surfaces of the inner chamber so as to support the pants hung on the laundry hanger support, a rotating shaft provided in the width direction of the inner chamber, a roller rotating about the rotating shaft and pressing the pants, a moving unit supporting the rotating shaft and moving the rotating shaft and the roller in a vertical direction of the inner chamber due to rotation of the roller, and a drive unit provided at the roller or the moving unit so as to rotate the roller.

Advantageous Effects of Invention

The present disclosure is capable of removing wrinkles by efficiently and uniformly pressing laundry in a limited space.

The present disclosure is capable of spraying steam only to laundry from which wrinkles are to be removed, rather than all of the laundry received in the chamber, and heating and pressing the laundry.

The present disclosure is capable of minimizing double creases by uniformly pressing laundry.

The present disclosure is capable of pressing laundry with a constant pressure regardless of the thickness of the laundry.

The present disclosure is capable of preventing a portion of laundry, which does not need to be pressed, from being pressed.

The present disclosure is capable of independently operating only a press unit, rather than operating the entire machine compartment, by spraying steam only to laundry from which wrinkles are to be removed.

The present disclosure is capable of independently operating only a press unit even when a door is open.

The present disclosure is capable of supplying power during upward and downward movement of a roller and of minimizing exposure of a power supply to moisture or water.

The present disclosure is capable of minimizing the amount of steam that is used by spraying steam only to the pants to be treated. Furthermore, the present disclosure is capable of minimizing energy consumption by heating the pants to be treated.

The present disclosure is capable of minimizing a water supply passage or a steam passage during spray of steam.

The present disclosure is capable of preventing the generation of wrinkles caused by pressing of stitch lines of laundry by a roller.

The present disclosure is capable of improving energy efficiency and user convenience by enabling only a pants treatment unit to be operated.

BRIEF DESCRIPTION OF DRAWINGS

FIG. 1 illustrates an embodiment of a conventional laundry treatment apparatus;

FIG. 2 illustrates an embodiment of a mechanical component included in a second chamber;

FIG. 3 illustrates a laundry treatment apparatus including an embodiment of a press unit, which is a feature of the present disclosure;

FIG. 4(*a*) is an enlarged view illustrating an embodiment of the press unit, FIG. 4(*b*) illustrates the embodiment of the press unit, which is coupled to a door inner plate so as to press pants, and FIG. 4(*c*) is a view of the press unit when viewed from a lateral side;

FIG. 5(*a*) illustrates a moving unit inserted into a guide hole formed through the door inner plate, and FIG. 5(*b*) illustrates the moving unit inserted into the guide hole when viewed from a lateral side;

FIG. 6(*a*) illustrates the guide hole and a power connection structure when viewed from the rear surface of the door inner plate, and FIGS. 6(*b*) and 6(*c*) illustrate moving mounts and wheels, which are provided at two lateral sides, when viewed from the rear surface;

FIG. 8(*a*) illustrates embodiments of a first heater, a second heater, and a steam heater, which are provided in the roller, FIG. 8(*b*) illustrates other embodiments of the first heater, the second heater, and the steam heater, which are provided in the roller, and FIG. 8(*c*) illustrates an embodiment of a steam generation tank provided in the roller;

FIG. 9 illustrates another embodiment of the roller, in which FIGS. 9(*a*) and 9(*b*) illustrate the state in which a moisture supply moves ahead of the roller while the roller moves, and FIGS. 9(*c*) and 9(*d*) illustrate the roller and the moisture supply when viewed from the front;

FIG. 10(*a*) illustrates an embodiment in which a battery for wireless operation of the roller is provided, FIG. 10(*b*) illustrates the roller when viewed from a lateral side, and FIG. 10(*c*) illustrates a plurality of charging points provided on the rear surface;

FIG. 11(*a*) illustrates the state in which pants disposed on a base plate are pressed by the roller when viewed from a lateral side, FIG. 11(*b*) illustrates a cross section of the moving unit, and FIG. 11(*c*) illustrates a cross section of a moving mount;

FIGS. 12(*a*) and 12(*b*) schematically illustrate embodiments of the base plate and a guide rail;

FIGS. 13(*a*) and 13(*b*) schematically illustrate other embodiments of the base plate and the guide rail;

FIG. 14 illustrates an embodiment capable of pressing pants by means of an elastic member provided at the moving unit, regardless of the thickness of the pants, in which FIG. 14(*a*) illustrates the case in which thin pants are pressed, and FIG. 14(*b*) illustrates the case in which thick pants are pressed;

FIG. 15(*a*) illustrates an embodiment in which steam spray holes are formed in the moisture supply, and FIG. 15(*b*) illustrates an embodiment of the moisture supply equipped with a moisture-containing portion, in place of spraying of steam;

FIG. 16(*a*) illustrates the roller, which presses pants at a fixed position without moving in the vertical direction of the door, and FIG. 16(*b*) illustrates a cross section of the roller;

FIG. 17(*a*) illustrates an initial state in which pants are pressed due to rotation of the roller, and FIG. 17(*b*) illustrates an intermediate state in which the pants are pressed due to rotation of the roller;

FIG. 18(*a*) illustrates the state in which pants are pressed between a pair of rollers, and FIG. 18(*b*) illustrates a cross section of the pair of rollers;

FIG. 19 illustrates an embodiment of a cover shielding the press unit;

FIG. 20 illustrates an embodiment in which a space capable of pressing pants is additionally provided in the door;

FIG. 21 illustrates an embodiment in which a space capable of pressing pants is additionally provided in a first chamber; and FIG. 22 illustrates a hinge structure connecting an inner chamber to an inner door.

MODE FOR THE INVENTION

Figure 7:
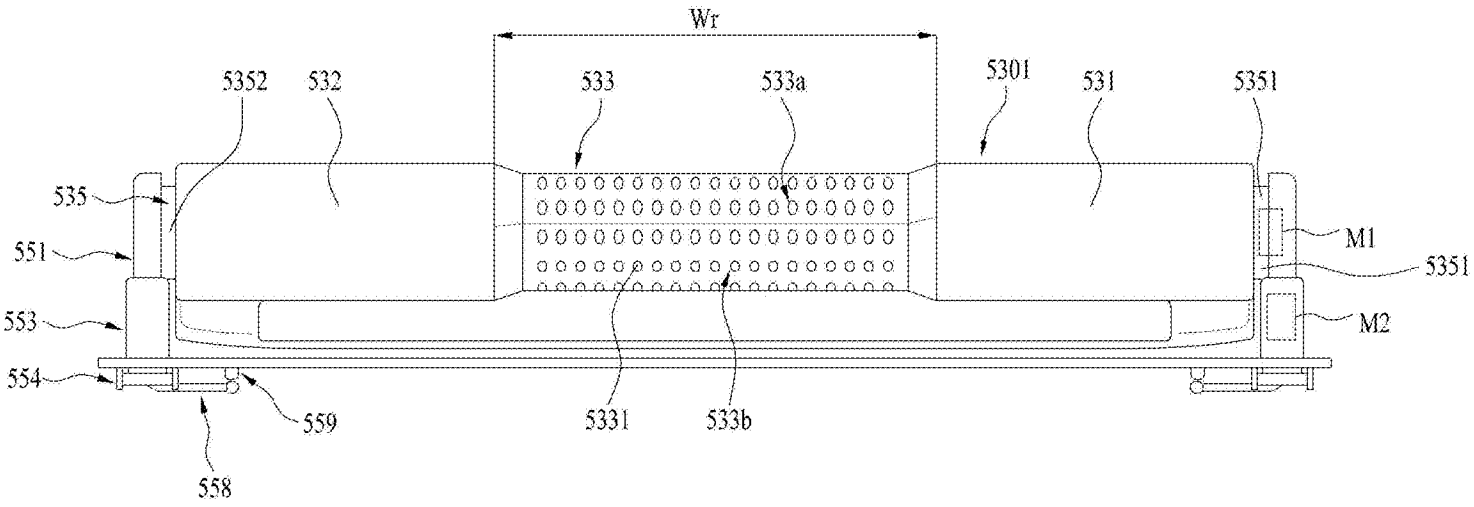
FIG. 7 illustrates the press unit.

Reference will now be made in detail to the preferred embodiments of the present invention, examples of which are illustrated in the accompanying drawings. It should be noted herein that construction of an apparatus, which will hereinafter be described, and a method of controlling the apparatus are given only for illustrative purposes and the protection scope of the present disclosure is not limited thereto. Wherever possible, the same reference numbers will be used throughout the drawings to refer to the same or like parts.

The specific terminology used in this specification is only for convenience of explanation, and is not intended to limit the disclosed embodiment.

For example, the term "same" or "identical" not only represents exactly the same state but also represents a state in which there is a tolerance, or a difference that those not prevent the same function from being realized.

For example, an expression indicating a relative or absolute position such as "in a certain direction", "along a certain object", "in parallel", "perpendicularly", "about", "concentric", and "coaxial", may not only represent the exact position but may also represents a state of relative displacement with a tolerance, or an angle or a distance that does not prevent the same function from being realized.

In this specification, the term "wrinkle" means a wrinkle (or a crinkle) or a fold which is unintentionally formed after wearing of clothes or after washing or drying of laundry. In other words, the term "wrinkle" means a wrinkle or crinkle which is unintentionally formed in clothes in use or in laundry during washing or drying rather than a pleat or a crease which is intentionally provided for the purpose of design or function at design stage. Accordingly, unless the context expressly indicates an intended pleat or crease, the term "wrinkle" means a wrinkle (or a crinkle) or a fold which is unintentionally formed in clothes in use or in laundry after washing or drying.

FIG. 1 illustrates an example of a conventional laundry treatment apparatus 2000. The laundry treatment apparatus 2000 includes a cabinet 150 having an inlet 120 formed in one side thereof, a first chamber 100, which is defined in the cabinet 150 so as to receive laundry through the inlet 120, a second chamber 200, which is positioned below the first chamber 100 so as to define a space separated from the first chamber 100, a steam unit 250 (see FIG. 2), which is disposed in the second chamber 200 and which creates steam and supplies the steam the first chamber 100, and a door 400, which is rotatably coupled to the cabinet 150 so as to open and close the inlet 120. Considering general usage by a user, the inlet 120 is preferably provided at the front side of the cabinet 150.

The laundry treatment apparatus 2000 may further include a blower unit 220 (see FIG. 2), which is disposed in the second chamber 200 and sucks air in the first chamber 100, and a heat pump unit 230, configured to dehumidify and heat the sucked air and to discharge the dehumidified air into the first chamber 100.

The cabinet 150 may be formed of a metal material but may also be made of a plastic material, as long as the cabinet is capable of maintaining a required strength. The first chamber 100 may be formed through plastic injection molding. Although the first chamber 100 may be coupled to the cabinet 150 by means of a frame (not shown), the space between the cabinet 150 and the first chamber 100 or the space between the cabinet 150 and the second chamber 200 may be filled with foamed plastic such as polyurethane.

A laundry including tops and bottoms may be disposed in the first chamber 100, and may be managed in the refreshed state by means of the blower unit 220 (see FIG. 2) disposed in the second chamber 200, the heat pump unit 230 (see FIG. 2), and the steam unit 250 (see FIG. 2). In other words, it is possible to perform functions of sterilizing and deodorizing the laundry and of removing wrinkles formed in the laundry during use, using steam and/or heated air, which is created by the blower unit 250 (see FIG. 2), the heat pump unit 230 (see FIG. 2), and the steam unit 250 (see FIG. 2), which are positioned in the second chamber 200.

The first chamber 100 may include a laundry support 190 configured to support the laundry at an upper level in the inside of the first chamber 100. The laundry support 190 may include a hanger on which the laundry is hung, and may be connected to a drive unit (not shown) capable of reciprocating the laundry support 190 to the right and left. The movement of the laundry support 190 may shake the laundry, thereby separating contaminants including fine dust from the laundry. Furthermore, it is possible to remove wrinkles from the laundry to a certain extent by exposing the laundry to steam or moisture supplied from the second chamber 200 while the laundry supported by the laundry support 190 is shaken. An embodiment of the laundry support 190 may include a moving hanger 195, which is shown in FIG. 19.

In other words, the laundry support 190 may support the laundry, which is disposed in the first chamber 100 in the state of being expanded due to its own weight such that the laundry is uniformly exposed to the dehumidified and heated air and/or steam which is supplied from the second chamber 200.

Generally, water boils at a temperature of 100° C. under atmospheric pressure, and the created water vapor may be referred to herein as steam. Meanwhile, "moisture" may refer to fine water droplets each having a size of 10 mm or less, which are suspended in air at an ambient temperature, like fog. Generally, steam, which is created by boiling water, has bactericidal power superior to moisture because the temperature thereof is higher than that of moisture, and has excellent ability to permeate laundry because water molecules move more actively at high temperatures. Accordingly, steam may be more efficiently used to refresh laundry than moisture.

The first chamber 100 is defined by a first chamber upper surface 109, on which the drive unit (not shown) of the laundry support 190 is positioned, a first chamber bottom surface 101 defining the bottom surface thereof, first chamber right and left lateral surfaces 105 and 107 connecting the first chamber upper surface 109 to the first chamber bottom surface 101, and a first chamber rear surface 103. When the surface in which the inlet 120 is formed is the front surface, the first chamber rear surface 103 will be positioned on the opposite side.

The first chamber bottom surface 101 may be provided therein with an air supply port 1011 and a steam supply port 1012, through which the air, which is dehumidified and heated by the heat pump unit 230, and the steam, which is created by the steam unit 250, in the second chamber 200 are supplied to the first chamber 100, and an air intake port 1013, through which the air in the first chamber 100 is sucked by means of the blower unit 220.

As illustrated in FIG. 1, the air supply port 1011 and the steam supply port 1012 may be provided in the region at which the first chamber bottom surface 101 meets the first chamber rear surface 103. Here, the region at which the first chamber bottom surface 101 meets the first chamber rear surface 103 may be smoothly inclined. The air intake port 1013 may be positioned on the first chamber bottom surface 101 close to the inlet 120. Consequently, the air in the first chamber 100 is discharged through the air supply port 1011, and is sucked into the first chamber 100 through the air intake port 1013, thereby forming a circulating flow. Meanwhile, the steam in the first chamber 100 is also discharged through the steam supply port 1012 and condensed, and the condensed steam is sucked into the first chamber 100 through the air intake port 1013 and collected in a sump (not shown) for storing the condensed water therein.

In order to more efficiently guide the condensed water in the first chamber 100 toward the second chamber 200 through the air intake port 1013, the first chamber bottom surface 101 may be inclined downwards towards the inlet 120 from the first chamber rear surface 103.

As illustrated in FIG. 1, the laundry treatment apparatus 2000 may include a water supply tank 310, configured to supply water to the steam unit 250, and a water discharge tank 330, configured to store therein the condensed water discharged from the sump (not shown), both of which are provided at the front side of the second chamber 200. Furthermore, a tank module frame (not shown) configured to define a tank-mounting space (not shown), in which the water supply tank 310 and the water discharge tank 330 are mounted, may be provided in order to isolate the tank-mounting space (not shown) from the second chamber 200. In other words, the tank-mounting space 351 and the second chamber 200 are positioned below the first chamber 100, the tank-mounting space may be positioned close to the door 400, and the second chamber 200 may be positioned behind the tank-mounting space.

The water supply tank 310 and the water discharge tank 330 may be respectively and detachably coupled to the tank module frame (not shown). Alternatively, the water supply tank 310 may be integrally coupled to the water discharge tank 330, and may thus be detachably coupled to the tank module frame together with the water discharge tank 330.

The door 400 may include a door inner plate 401, which is positioned on the rear surface of the door 400 or on the surface of the door 400 that faces the first chamber 100 when the door 400 is closed. The door 400 may be hingedly and rotatably connected to the cabinet 150 so as to open and close the inlet 120.

The front surface of the water supply tank 310 and the front surface of the water discharge tank 330 may face the door inner plate 401 when the door 400 is closed by a user, and may be exposed to the outside when the door 400 is opened by the user. Because the water supply tank 310 has a water supply tank window 313 formed in the front surface thereof and the water discharge tank 330 has a water discharge tank window 333 formed in the front surface thereof, it is possible to check the levels of the water stored in the water supply tank 310 and the water discharge tank 330.

The front surface of the water supply tank 310 may be provided with a water supply tank handle 315, and the front surface of the water discharge tank 330 may be provided with a water discharge tank handle 335. When a user pulls the water supply tank handle 315 or the water discharge tank handle 335, the water supply tank 310 or the water discharge tank 330 may be rotated about an end of the front surface thereof, and may be separated from the tank module frame (not shown). When the water supply tank 310 or the water discharge tank 330 is mounted in the tank module frame (not shown), the water supply tank 310 or the water discharge tank 330 may be mounted in the tank module frame (not shown) while being rotated.

In the conventional laundry treatment apparatus 2000, the door inner plate 401 or the inside of the first chamber 100 may be provided with a laundry hanger support 405, on which a laundry hanger 403 including inverted pants P hung thereon is hung, and a presser 50 configured to press the pants P, which are held by the laundry hanger support 405 and the laundry hanger 403.

The reason why the pants P are hung in the state in which the bottom hems of the pants P are positioned upwards is to uniformly spread the pants P using the tensile force resulting from the weight of the pants P because the weight of the pant waist portion of the pants P is heavier than the pant leg part of the pants P.

The presser 50 may include a support plate 51, which is coupled to the door inner plate 401 so as to support the laundry, and a rotating plate 52, which is rotatable toward the support plate 51 so as to press the pants P. When the rotating plate 52 is rotated toward the support plate 51 and is coupled thereto, it is possible to press the pants P. Thereafter, when the door 400 is closed, the pants P are steamed and dehumidified and are exposed to heated air, thereby removing wrinkles. Here, the rotating plate 52 may have a rotating plate through hole 54 formed therethrough in order to allow steam to easily permeate the pants P, and may further have a depressed portion 55, which is formed in the surface of the rotating plate 52 that comes into contact with the pants P, in order to prevent the seams of pants P, which are provided in the longitudinal direction of the leg parts of the pants P, from being pressed.

Referring to FIG. 2, the second chamber 200 may be provided therein with the blower unit 220, configured to suck air in the first chamber 100, the steam unit 250 configured to receive water from the water supply tank 310 to thus generate steam and to supply the steam to the first chamber 100, and the heat pump unit 230, configured to dehumidify and heat the air that is sucked by the blower unit 220 and to discharge the air into the first chamber 100. Furthermore, the second chamber 200 may be provided therein with a controller (not shown) configured to control the blower unit 220, the steam unit 250, and the heat pump unit 230.

The steam unit 220 may be provided in order to sterilize and deodorize the laundry disposed in the first chamber 100 and to remove wrinkles from the laundry, and the blower unit 220 and the heat pump unit 230 may be provided in order to circulate the air in the first chamber 100 and to dehumidify the air through heat exchange.

In addition, the controller may control a press unit 500, which will be described later. The controller may control the rotation of rollers 530, 570 and 670, which will be described later. Furthermore, the controller may control the reciprocating movement of the laundry support 190 (see FIG. 1).

In order to supply the dehumidified and heated air to the first chamber 100, the air in the first chamber 100 is sucked through an inlet duct 221 using suction force generated by a blower fan 226. Subsequently, the air is transmitted to the heat pump unit 230 and heat-exchanged therein, and is again supplied to the first chamber 100.

Referring to FIG. 2, the blower unit 220 may include the blower fan 226 and the inlet duct 221. Assuming that the direction in which the inlet 120 is positioned is referred to as a forward direction and the direction in which the rear surface of the first chamber 100 is positioned is referred to as the backward direction, the inlet duct 221 may be provided in front of the blower fan 226, and the tank module frame (not shown) may be provided in front of the inlet duct 221. Accordingly, the tank module frame may isolate the tank-mounting space 351 from the second chamber 200.

The water supply tank 310 and the water discharge tank 330, which are mounted on the tank module frame (not shown), may be positioned close to one lateral side surface of the cabinet 150, among the two lateral side surfaces of the cabinet 150. For example, the water supply tank 310 may be positioned in the tank-mounting space (not shown) closer to the right lateral side surface than to the left lateral side surface of the cabinet 150, whereas the water discharge tank 330 may be positioned in the tank-mounting space (not shown) closer to the left lateral side surface than to the right lateral side surface of the cabinet 150.

Like the water supply tank 310, the steam unit 250 may also be positioned in the second chamber 200 closer to the right lateral side surface than to the left lateral side surface of the cabinet 150. The reason for this is to simplify the connecting passage between the water supply tank 310 and the steam unit 250, along which water flows, by positioning the steam unit 250 behind the water supply tank 310.

The steam unit 250 may heat the water disposed in the steam unit 250 to generate steam using a heater, and the generated steam may flow along a steam passage (not shown) to the steam supply port 1012, which is provided on the bottom surface 101 of the first chamber 100.

If the water supply tan 310 is positioned closer to the left lateral side surface than to the right lateral side surface of the cabinet 150, the steam unit 250 may also be positioned closer to the left lateral side surface than to the right lateral side surface of the cabinet 150.

The inlet duct 221 may include an inlet duct inlet 2213, which communicates with the air intake port 1013 formed in the bottom surface 101 of the first chamber 100 and through which the air in the first chamber 100 is sucked. The inlet duct inlet 2213 may define a sloped passage. The reason for this is to enable the condensed water formed in the first chamber 100 and on the door 400 to easily flow to the sump (not shown) provided in the lower portion of the inlet duct 221 through the inlet duct inlet 2213 and along the sloped passage.

The inlet duct 221 may be positioned in front of the blower fan 226, and the steam unit 250 and the heat pump unit 230 may be positioned behind the blower fan 226. The heat pump unit 230 may be supported by a supporter 265. The supporter 265 may be provided on a base 210, which defines the bottom of the second chamber 200. Accordingly, the supporter 265 may provide a predetermined distance between the base 210 and the heat pump unit 230, and a predetermined mounting space may be defined between the support 265 and the base 210. The steam unit 250 may be positioned in the mounting space, and may be coupled to the supporter 265 in the mounting space. Although FIG. 2 illustrates an embodiment in which the controller 270 is positioned bellow the steam unit 250 in the mounting space defined by the supporter 265, the controller 270 may positioned at any location, such as behind the steam unit 250 or in the second chamber 200.

The heat pump unit 230 may include a housing 231, which accommodates therein a first heat exchanger (or an evaporator, not shown) and a second heat exchanger (or a condenser, not shown), and an air discharge outlet 2312, which communicates with the air supply port 1011 provided in the first chamber 100 in order to discharge the dehumidified and heated air to the first chamber 100 from the housing 231. A compressor (not shown) and an expansion valve, which are configured to circulate refrigerant, may be positioned outside the supporter 265.

Unlike those shown in FIG. 2, the blower unit 220 may circulate the air in the first chamber 100, and the evaporator and the condenser may be provided in the duct, through which the air, circulated by the blower unit 220, flows. In other words, the blower unit may composed of the inlet duct 221, the blower fan 226, a connecting duct (corresponding to the housing shown in FIG. 2), and an exhaust duct (corresponding to the air discharge outlet shown in FIG. 2), and the heat pump unit may include the evaporator and the condenser, which are provided in the connecting duct, and the compressor and the expansion unit, which are provided outside the blower unit 220.

Referring to FIG. 3, the door 400 may include the door inner plate 401, which is the surface of the door 400 that faces the first chamber 100, a door gasket 486, which is provided on the door inner plate 401 in the state of being in tight contact with the peripheral portion of the cabinet 150 so as to form sealing between the door 400 and the cabinet 150, and door liners 482 and 484, which are provided on the door inner plate 401 so as to guide the condensed water created in the first chamber 100 toward the first chamber bottom surface 101. In some embodiments, the door 400 may be configured to simultaneously open and close the first chamber 100 and the tank-mounting space 352. In another embodiment, a plurality of doors may be mounted on the cabinet 150 so as to respectively open and close the first chamber 100 and the tank-mounting space 351. The door liners 482 and 484 may be configured to face the first chamber 100 when the door 400 is closed, and may include an upper door liner 482 and a lower door liner 484. The door liners 482 and 484 may discharge the condensed water, which is generated on the surfaces of the door liners 482 and 484, to the sump (not shown), provided below the inlet duct, through the air intake port 1013 formed in the bottom surface 101 of the first chamber.

The door gasket 486 may be mounted on the door inner plate 401 so as to surround the door inner plate 401. The seal between the door 400 and the cabinet 150 may be established by the door gasket 486. The door gasket 486 may seal the first chamber 100 and the tank-mounting space (not shown), in which the water supply tank 310 and the water discharge tank 330 are mounted, from each other.

Referring to the example of the presser 50 shown in FIG. 1, the rotating plate 52 may be rotated toward the support plate 51 on which the pants P are disposed. The rotating plate 52 may be rotated to press the pants P about a rotational coupler (not shown), for example, a hinge, which is provided on one surface of the rotating plate 52. A region of the rotating plate 52 close to the rotational coupler may continue to press the pants P until the rotating plate 52 is completely rotated to face the support plate 51, that is, until the other surface of the rotating plate 52 is coupled to the support plate 51.

Accordingly, uniform pressure is not applied to the pants P while the rotating plate 52 is rotated. At this point, because higher pressure is applied to a region of the pants P close to the rotational coupler whereas lower pressure is applied to a region of the pants P far from the rotational coupler, there is a problem in which the pants P are not uniformly pressed.

Furthermore, there may be a problem in which the held shape of the pants P is deformed or the pants P are displaced in position because the pants P are pushed by the rotating plate 52 while the pants P are pressed by the rotating plate 52. Therefore, the conventional laundry treatment apparatus 2000 may have a problem in which more wrinkles are generated or creases are formed in a direction other than the intended direction.

Furthermore, because the pants P are simply hung on the laundry hanger support 405 (see FIG. 1) rather than being held, there is a problem whereby it is impossible to prevent the position of the pants P from changing during pressing.

When the pants P are suspended in the state of being spread across the length of the door inner plate rather than being folded, a user may suffer inconvenience because the laundry hanger support 405 (see FIG. 1) is high. In addition, because the pants P occupies almost the entire area of the door inner plate 401, there is a problem whereby the availability of the door inner surface 401 is deteriorated.

In order to press the pants P using the presser 50, remove wrinkles, and efficiently form intended creases, the steam unit 250, the blower unit 220, and the heat pump unit 230, which are provided in the second chamber 200, must be activated. The reason for this is because a dedicated steam generator for the presser 50 is not provided with an air heater. This means that the entire laundry treatment apparatus 2000 must be necessarily operated in order to press the pants P using the presser 50. Furthermore, when the laundry disposed in the first chamber 100 is completely refreshed before using the presser 50, there is inconvenience in which the presser 50 must be used after taking the refreshed laundry out of the first chamber 100.

In addition, the rotational direction of the rotating plate 52 must be changed depending on whether a user is right-handed or left-handed. Accordingly, there is inconvenience in that the rotating plate 52 may need to be separated and reassembled when the user changes.

FIG. 3 illustrates a laundry treatment apparatus 1000 according to an embodiment of the present disclosure in which an embodiment of a press unit 500, which is different from the presser 50 of the conventional laundry treatment apparatus configured to remove wrinkles in the pants P, is illustrated. The feature of the present disclosure is to propose a novel press unit that overcomes the above-mentioned problems.

Specifically, the laundry treatment apparatus 1000 according to the present disclosure includes the cabinet 150 having the inlet 120 formed in one surface thereof, the first chamber 100, which is positioned in the cabinet 150 and receives therein laundry through the inlet 120, the second chamber 200, which is positioned below the first chamber 100 and is separated from the first chamber 100, the door 400, which is rotatably coupled to the cabinet 150 so as to open and close the inlet 120, the door inner plate 401, which is the surface of the door 400 that faces the first chamber 100, the laundry hanger support 405, which is provided on the door inner plate 401 and on which the pants P are hung, and a roller-type press unit 500, which is coupled to the door inner plate 401 so as to hold and press the laundry.

The press unit 500 may include a base plate 510, configured to support the pants P hung on the laundry hanger support 405, a rotating shaft 536, provided in the width direction of the door 400, a roller 530, which is rotated about the rotating shaft 536 and presses the pants P, and a moving unit 550, which supports the rotating shaft 536 and moves the rotating shaft 536 and the roller 530 in the height direction of the door 400.

Furthermore, the laundry treatment apparatus 1000 may include a drive unit 540 (see FIG. 5), which is provided at the roller 530 and the moving unit 550 so as to rotate the roller 530.

Rather than simply pressing laundry while being passively rotated by movement of the moving unit 550, as in the conventional laundry treatment apparatus, the roller 530 not only elastically presses the laundry while being actively rotated by the drive unit 540 but also presses the laundry using the rotative force of the drive unit 540. In other words, the roller 530 may be rotated while pressing the laundry disposed on the base plate 510.

When the roller 530 is actively rotated while pressing the laundry, the moving unit 550 may be passively moved by the rotation of the roller 530. In other words, by means of the drive unit configured to rotate the roller 530, the rotation of the roller 530 and the movement of the moving unit 550 may be performed simultaneously.

The roller 530 may be shaped such that, based on the width direction of the door, the middle portion of the roller 530 may have a diameter less than that of the two end portions of the roller 530. The reason for this is to avoid a stitch line portion of pants, which is thicker than the fabric of the leg part of pants and to provide a space into which steam is sprayed such that the steam uniformly permeates the fabric of the pants P. Furthermore, the reason for this is to prevent the steam from being sprayed only in a direction opposite the direction in which steam is sprayed toward laundry through the roller 530 because the pressure in steam spray holes 5331 formed in the side of the roller 530 that face the laundry is higher than the pressure in steam spray holes 5331 formed in the opposite side of the roller 530.

In other words, the roller 530 may be configured to have a shape similar to that of a dumbbell. Specifically, the outer circumferential surface of a region of the roller 530, which corresponds to a predetermined length in the longitudinal direction of the rotating shaft 536 or in the width direction of the door 400, may have a diameter less than that of the two ends of the roller 530. The reason for this is to provide a space that avoids stitch lines that are positioned at the center line of suspended pants and into which steam is sprayed.

Referring to FIG. 2, the second chamber 200 may be provided therein with the blower unit 220 configured to suck air in the first chamber 100, the steam unit 250 configured to receive water to thus generate steam and to supply the steam to the first chamber 100, and the heat pump unit 230 configured to dehumidify and heat the air sucked by the blower unit 220 and to discharge the air to the first chamber 100. Furthermore, the second chamber 200 may be provided therein with the controller (not shown) configured to control the blower unit 220, the steam unit 250, and the heat pump unit 230.

The steam unit 220 may be provided so as to sterilize and deodorize the laundry disposed in the first chamber 100 and to remove wrinkles from the laundry, and the blower unit 220 and the heat pump unit 230 may be provided so as to circulate the air in the first chamber 100 and dehumidify the air through heat exchange.

The steam unit 250 may be used to refresh the laundry disposed in the first chamber 100. The press unit 500 shown in FIG. 3 may include a steam generation tank 580 (see FIG. 8), which is operated independently of the steam unit 250. Furthermore, the press unit 500 may include a heater 535 (see FIG. 8) configured to heat the pants P, in place of the blower unit 220 and the heat pump unit 230. Accordingly, it is possible to minimize the amount of steam required to remove wrinkles from the pants P disposed on the press unit 500, compared to the case in which the entire first chamber 100 is fully filled with steam. In addition, because it is possible to intensively apply heat only to the pants P, it is possible to save energy, compared to the case of dehumidifying and heating the entire air in the first chamber 100. In other words, it is possible to independently refresh the pants P using only the press unit 500 without activating the blower unit 220, the steam unit 250, or the heat pump unit 230, which are provided in the second chamber 200.

In this case, a user is able to remove wrinkles from only the pants P disposed on the press unit 500 and to clearly form intended creases, and the laundry treatment apparatus 1000 may provide the user with an additional management course for removal of wrinkles and formation of creases such that the user can select the course. In addition, it is possible to remove wrinkles from the pants P disposed on the press unit 500 by operating only the press unit 500 even when the door 400 is opened. In the conventional apparatus, in order to press only the pants P disposed on the presser 50, the laundry treatment apparatus 2000 must be operated after refreshed laundry is taken out of the first chamber 100, the pants P are disposed alone on the presser 50, and the door 400 is closed. Accordingly, the present disclosure is capable of overcoming this inconvenience.

In addition, because the conventional laundry treatment apparatus 2000 is constructed such that the presser 50 is rotated about only one side thereof to press pants, the conventional laundry treatment apparatus 2000 must be designed such that the presser 50 is rotatable about either of the two sides of the presser 500 to realize a reversible design. The reversible design is intended to allow the rotational direction of the presser to be changed depending on whether a user is right-handed or left-handed. However, because the press unit 500 is movable in the up-and-down direction of the door 400, there is no need to consider whether a user is right-handed or left-handed at the design stage.

The laundry hanger support 405 is used in a manner such that pants P are hung on the laundry hanger 403 and then the hook of the laundry hanger 403 is hung on the laundry hanger support 405. Because the laundry hanger support 405 is configured such that a lug, such as a hook, projects toward the first chamber 100 from the door inner plate 401, the laundry hanger 403 may be hung on the projecting lug. The laundry hanger 403 may be a typical pants hanger, and may hold the hems of the leg parts of the pants P in the state in which the leg parts are folded in forward and backward directions. Here, the pants P may be folded such that a clearly folded and intended crease, for example, a front crease of a bottom of a uniform or a bottom of a suit, is positioned at one side and a seam (or a stitch line) of the leg part of the bottom is positioned at the center, and may be held by the laundry hanger 403. Thereafter, the pants P may be hung on the laundry hanger support 405.

Accordingly, the roller 530 may be configured so as to be depressed at a portion thereof corresponding to the seams of the pants P rather than having a cylindrical form having a constant diameter such that the clearly folded and intended creases are pressed by the roller 530 but the seams are not pressed by the roller 530.

Because the hems of the pants P are held by the laundry hanger 403, a user hangs the pants P in the inverted state. Here, the waist portion of the pants P excluding the leg parts, that is, the portion between the waist line and the lower end of the hip portion, which is called a "rise", is typically heavier than the leg parts. Accordingly, when the pants P are suspended in the inverted and extended state, tensile force may be applied throughout the pants P due to the self-weight of the pants P. When tensile force is applied to the pants P, the pants P may be pulled in the height direction of the door 400 or in the longitudinal direction of the pants P.

The door 400 may be rotatably coupled to the cabinet 150 so as to open and close the inlet 120. To this end, the door 400 may include a fastening member such as a hinge unit (not shown). The door 400 may be composed of a single plate. The embodiment of the door 400 shown in FIG. 3 may include a door outer plate 4111 including an outer surface of the door 400, which is positioned far away from the first chamber 100, the door inner plate 401 including an inner surface of the door 400 which is positioned so as to face the first chamber 100, and a side surface 4112 connecting the door inner plate 401 to the door outer plate 4111. The outer surface of the door 400 may be provided with a display (not shown) configured to receive a selection signal from a user and to output the result and associated information. Wires (not shown) for connection to power and transmission of control signals may be disposed between the door inner plate 401 and the door outer plate 4111. The press unit 500 may be coupled to the door inner plate 401.

The door 400 may include the door inner plate 401 facing the first chamber 100, and a rear surface 4011, which is the one among the two surfaces of the door inner plate 401 that is farther away from the inlet 120. When the door 400 is opened, although the door inner surface 401 is exposed to the outside, the rear surface 4011 is not exposed to the outside because the rear surface 4011 is one of the surfaces defining the interior space in the door 400. Furthermore, the door inner plate 401 may include the rear surface 4011, which is positioned far away from the inlet 120, and an inner exposed surface, which is positioned close to the inlet 120.

The door inner plate 401 may include the door gasket 486 configured to form a seal between the door 400 and the cabinet 150, and the door liners 482 and 484, which are provided on the door inner plate 401 so as to guide condensed water, which is generated in the first chamber 100 when the door 400 is closed, to the first chamber bottom surface 101. In some embodiments, the door 400 may be configured to simultaneously open and close the first chamber 100 and the tank-mounting space 351. In another embodiment, a plurality of doors may be mounted on the cabinet 150, and the doors may respectively open and close the first chamber 100 and the tank-mounting space 351. The door liners 482 and 484 may be provided so as to face the first chamber 100 when the door 400 is closed, and may include the upper door liner 482 and the lower door liner 484. The door liners 482 and 484 may discharge condensed water, which is generated on the surfaces of the door liners 482 and 484, to the sump (not shown) disposed below the inlet duct through the air intake port 1013 provided in the first chamber bottom surface 101.

The door gasket 486 may be mounted on the door inner plate 401 so as to surround the door inner surface 401. The seal between the door 400 and the cabinet 150 may be established by the door gasket 486. The door gasket 486 may also separately seal the first chamber 100 and the tank-mounting space (not shown) in which is the water supply tank 310 and the water discharge tank 330 are mounted.

The base plate 510 may be coupled to the door inner plate 401 so as to support the pants P hung on the laundry hanger support 405. The base plate 510 may be coupled to the door inner plate 401 in the state of being spaced apart from the door inner plate 401. To this end, an elastic support (not shown) having elasticity may be positioned between the base plate 510 and the door inner plate 401. When the roller 530 presses the pants P toward the door inner plate 401, the elastic support may support the base plate 510 in order to bring the pants P into uniform and close contact with the base plate 510.

The upper portion and the lower portion of the base plate 510 may be curved. The upper portion of the base plate 510 refers to the portion of the base plate 510 that is closer to the laundry hanger support 405 than to a laundry holder 420, which will be described later, and the lower portion of the base plate 510 refers to the portion of the base plate 510 that is closer to the laundry holder 420 than to the laundry hanger support 405. The upper portion of the base plate 510 may support the hem portions of the pants P, whereas the lower portion of the base plate 510 may support the waist portion of the pants P.

In the pants P supported by the base plate 510, the portion of the pants P that is pressed by the roller 530 is the leg parts of the pants P. Because the waist portion of the pants P is provided with a zipper, a waist pocket and the like, it is difficult to press the waist portion using the roller 530, and moreover it is unnecessary to press the waist portion. Accordingly, because the laundry holder 420 is coupled to the lower portion of the door inner plate 401 and presses and holds opposite sides of the waist portion of the pants P, which are suspended in an inverted state, the laundry holder 420 may not interfere with the roller 530, which presses the leg parts of the pants P. Particularly, because the roller 530 removes wrinkles using steam or moisture and presses the pants P, it is possible to form a clearly formed and intended crease, for example, front creases in the pants P.

The remaining middle portion of the base plate 510 excluding the upper portion and the lower portions thereof may be positioned parallel to the door inner plate 401. Accordingly, the middle portion of the base plate 510 may be parallel to the portion of the door inner plate 401 that corresponds to the middle portion, and the upper and lower portions of the base plate 510 may be curved, and may thus become close to the door inner plate 401.

When the base plate 510 is viewed from a lateral side, the distance between the door inner plate 401 and the base plate 510, which is measured in a direction perpendicular to the door inner plate 401, may increase toward the middle portion from the upper portion of the base plate 510. Furthermore, the distance between the door inner plate 401 and the base plate 510 may increase toward the middle portion from the lower portion of the base plate 510. The reason for this is to more efficiently apply tensile force to the pants P. The laundry hanger support 405 may be positioned on the door inner plate 401, and downward tensile force may be applied to the pants P suspended from the laundry hanger support 405. Accordingly, in comparison with the case in which of the base plate 510 is flat, because the contact length and the contact area between the base plate 510 and the pants P increase in the case in which the base plate 510 is curved, the base plate 510 may be in closer contact with the pants P, thereby improving the effect of applying tensile force to the pants P.

Because the middle portion of the base plate 510 is maximally convex and the distance between the base plate 510 and the door inner plate 401 in a direction perpendicular to the door inner plate 401 decreases moving downwards, that is, toward the lower portion of the base plate 510 from the middle portion, the pants P may drop from the base plate 510. In order to prevent the pants P from dropping, the door 400 may further include the laundry holder 420, which is coupled to the door inner plate 401 and holds opposite sides of the waist portion of the suspended pants P. The laundry holder 420 may convey an effect of pulling the pants P in order to prevent opposite sides of the pants P from being spaced apart from the base plate 510. Consequently, by virtue of the laundry holder 420, tensile force may be applied to the pants P.

The laundry holder 420 may include a first laundry holder 421 configured to hold one side of the waist portion of the pants P and a second laundry holder 422 configured to hold the other side of the waist portion of the pants P. Here, the one side and the other side of the waist portion of the pants P mean opposite sides of the waist portion of the pants P in the state in which the leg parts are folded such that the seams (or stitch lines) of the leg parts are positioned at the centers of respective leg parts and the pants P are held by the laundry hanger 403.

Here, because the laundry holder 420 holds the opposite sides of the suspended pants P, the pants P may come into contact with the base plate 510 even when the pants P extend close to the lower end of the base plate 510 beyond the middle portion of the base plate 510. The laundry holder 420 may be configured to have a clamp structure in order to hold the opposite sides of the pants P. Alternatively, the laundry holder 420 shown in FIG. 3 may be configured to have the form of an angled beam. The laundry holder 420 may be coupled to the door inner plate 401, and may hold opposite sides of the pants P in the state in which the pants P are loosely inserted into the laundry holder 420. In other words, the laundry holder 420 is intended to prevent the pants P from coming into contact with the base plate 510 and being moved in rightward and leftward directions.

FIG. 4(*a*) illustrates the press unit 500 in an enlarged view. The press unit 500 may include the base plate 510 configured to support the pants P hung on the laundry hanger support 405, the rotating shaft 536 disposed in the width direction of the door 400, the roller 530, which is rotatable about the rotating shaft 536 and presses the pants P, and the moving unit 550, which is configured to support the rotating shaft 536 and to move the rotating shaft 536 and the roller 530 in the vertical direction of the door 400.

The roller 530 may include a first cylindrical press portion 531, which is positioned close to one end of the roller 530 and presses the pants P, a second cylindrical press portion 532, which is positioned close to the other end of the roller 530 and presses the pants P, and a cylindrical moisture supply 533, which is positioned between the first press portion 531 and the second press portion 532 so as to connect the first press portion 531 to the second press portion 532 and which supplies moisture to the pants P.

The roller 530 may be constructed such that the first press portion 531 and the second press portion 532, which press the pants P, and the moisture supply 533 are integrally formed. Accordingly, when the drive unit 540 (see FIG. 5) rotates the roller 530, the first press portion 531, the second press portion 532, and the moisture supply 533 may be rotated therewith.

Here, the roller 530 receives moisture from the moisture supply 533 and presses the pants P while pulling the pants P by means of the first press portion 531 and the second press portion 532, which is useful for removal of wrinkles and formation of clear creases.

Although the roller 530 may be made of any of a metal material, a wood material and a plastic material, it is preferable that the roller 530 be made of a metal material. In order to press laundry using the roller 530 and apply heat to the laundry using a heater in the manner of an iron, as will be described later, the roller 530 is preferably made of a metal material in consideration of hardness and thermal conductivity.

The roller 530 may include a roller body 5301 defining the appearance thereof, the first press portion 531 positioned close to one end of the roller body 5301, the second press portion 532 positioned close to the other end of the roller body 5301, and the moisture supply 533, which is positioned between the first press portion 531 and the second press portion 532 so as to connect the first press portion 531 to the second press portion 532 and supplies moisture to the pants P.

The roller 530 may be rotatable about the rotating shaft 536, which is disposed in the width direction of the door 400. The roller 530 may further include the moving unit 550, configured to move the roller 530 in the longitudinal direction of the door 400.

The diameter of the moisture supply 533 may be smaller than the diameter of the first press portion 531 and the second press portion 532. In an embodiment of the moisture supply 533 shown in FIG. 4(*a*), the outer circumferential surface of the moisture supply 533 may be provided therein with the plurality of steam spray holes 5331 for spraying steam.

When steam is sprayed through the plurality of steam spray holes 5331, the steam may permeate the pants P, which are pressed by the roller 530. Because the press unit 500 may include the steam generation tank 580 (see FIG. 8), which is provided in the moisture supply 533 and supplies steam, in addition to the steam unit 250 configured to spray steam to the laundry disposed in the first chamber 100, the press unit 500 may be accommodated in the first chamber 100, and may be operated independently of supply of steamed and/or dehumidified and heated air. In other words, it is possible to spray steam and apply heat to the suspended pants P while only the roller 530 is moved without operating the steam unit 250, the blower unit 220, or the heat pump unit 230, which are accommodated in the second chamber 200. For example, the press unit 500 may convey an effect like that which is obtained when a user uses a steam iron on an ironing board in order to remove wrinkles from the pants P.

If the diameter of the moisture supply 533 is equal to the diameter of the first press portion 531 or the second press portion 532, the moisture supply 533 may press the pants P to the same extent as that by the first press portion 531 or the second press portion 532. Here, because some of the plurality of steam spray holes 5331 that are in contact with the pants P are clogged by the pants P, steam may be discharged through those among the plurality of steam spray holes 5331 that are positioned opposite the some of the plurality of steam spray holes 5331 that re in contact with the pants P. Hence, it is impossible to spray steam to the pants P. In order to prevent this, the diameter of the moisture supply 533 may be smaller than the diameter of either of the first press portion 531 and the second press portion 532.

The regions of the pants P that correspond to the moisture supply 533 may be provided with seams or stitch lines. Pressing the seams or the stitch lines may cause warping of the pants P and thus formation of double creases. In order to avoid this problem, the diameter of the moisture supply 533 may be smaller than the diameter of either of the first press portion 531 and the second press portion 532.

Referring to an embodiment of the roller 530 shown in FIG. 4(*a*) and FIG. 4(*b*), the two ends of the roller 530 may be connected to the rotating shaft 536. The rotating shaft 536 provided at the two ends of the roller 530 may support the roller 530 via the moving unit 550.

Specifically, the rotating shaft 536 may include a first rotating shaft 5361 coupled to one end of the roller 530 and a second rotating shaft 5362 coupled to the other end of the roller 530.

The door 400 may further include guide holes 415, which are formed in the vertical direction of the door 400. The moving unit 550 may include a first transfer portion 5501 coupled to the first rotating shaft 5361 and a second transfer portion 5502 coupled to the second rotating shaft 5362, and the guide holes 415 may include a first guide hole 4151, which is positioned between one side surface of the base plate 510 and the side surface of the door 400 that is positioned close to the one side surface of the base plate 510, and a second guide hole 4152, which is positioned between the other side surface of the base plate 510 and the other side surface of the door 400, which is positioned close to the other side surface of the base plate 510.

The first transfer portion 5501 may be movable in the vertical direction of the door 400 along the first guide hole 4151 when the roller 530 is rotated, and the second transfer portion 5502 may be reciprocable in a vertical direction (in the direction of the arrow) along the second guide hole 4152 when the roller 530 is rotated.

FIG. 4(*c*) illustrates an embodiment of the press unit 500 when viewed from a lateral side. The door 400 may include the door inner surface 401, the rear surface 4011 of the door inner surface 401 positioned far away from the inlet 120, and the door outer plate 4111 coupled to the rear surface 4011 so as to define a mounting space 4115.

In other words, the door 400 may not be composed of a single plate but may be an assembly in which multiple panels are coupled to each other. Specifically, the door 400 may include the door inner plate 401 positioned so as to face the inlet 120 and the door outer plate 4111, positioned far away from the inlet 120. The door inner plate 401 and the door outer plate 4111 may define therein a predetermined mounting space 4115.

The mounting space 4115 may be provided therein with an electric wire, which is connected to the controller (not shown) so as to transmit and receive a control signal or supply power. The mounting space 4115 may be provided therein with a power supply 559 (see FIG. 6(*a*)) for rotation of the roller 530. Furthermore, the mounting space 4115 may be provided therein with a guide 440 (see FIG. 12(*a*), which is configured to control an insertion depth, to which the moving unit 550 is moved along the guide hole, to thus control the distance between the roller 530 and the moving unit 550. The reason why the power supply 559 (see FIG. 6(*a*)) or the guide 440 (see FIG. 12(*a*) is provided in the mounting space 4115, that is, the interior space in the door 400 is to maximally prevent the power supply 559 (see FIG. 6(*a*)) from being exposed to moisture upon supply of steam in the first chamber 100 or via the roller 530 and to mount the guide 440 (see FIG. 12(*a*)) in the mounting space 4115 in the door to provide a neatly finished appearance.

Referring to FIG. 4(*c*), when the roller 530 is rotated in a first rotation direction, for example, in a clockwise direction, while pressing the pants P, the roller 530 may be moved upwards. To this end, the rotating shaft 536 rotatably supporting the roller 530 and the moving unit 550 supporting the rotating shaft 536 may be respectively provided at the two ends of the roller 530. The moving unit 550 may be moved along the guide hole 415 in the vertical direction of the door 400. Here, a portion of the moving unit 550 may be inserted into the guide hole 415. In order to prevent the moving unit 550 from being separated from the guide hole 415, the moving unit 550 may include a wheel 554, which is oriented in the width direction of the door 400 and is wider than the width of the guide hole 415. Specifically, the wheel 554 may be configured as a small caster such that the moving unit 550 is movable along the guide hole 415. Accordingly, the moving unit 550 may be smoothly movable along the guide hole 415 in the vertical direction of the door 400 with reduced friction.

Although the moving unit 550 may be movable along the guide hole 415 by means of an additional drive device, the moving unit 550 according to the embodiment may be passively moved due to rotation of the roller 530. In other words, the moving unit 550 may be moved upwards when the roller 530 is rotated in a first rotational direction and may be moved downwards when the roller 530 is rotated in a second rotational direction, opposite the first rotational direction, without using an additional drive device.

Here, the roller 530 may be rotated on the base plate 510 while pressing the pants P. An elastic member 552 (see FIG. 11) may be provided between the roller 530 and the moving unit 550 so as to bias the roller 530 toward the base plate 510. Accordingly, even when the rotation of the roller 530 is halted, the roller 530 may be maintained in at a current position thereof while pressing the pants P without slipping on the pants P.

In other words, the moving unit 550 may be moved along the guide hole 415 in one direction among upward and downward directions when the roller 530 is rotated in the first rotational direction, and may be moved along the guide hole 415 in the direction opposite the one direction when the roller 530 is rotated in a second rotational direction opposite the first rotational direction. When the roller 530 is stopped, the moving unit 550 may also be stopped.

In practice, the moving unit 550 may be moved in the vertical direction of the door 400 by virtue of rotation of the roller 530, and may serve merely to guide the roller 530 along the guide hole 415.

Referring to FIG. 4(*c*), the base plate 510 may be configured such that the distance D1 between the door inner plate 401 and the base plate 510 in a direction perpendicular to the door inner plate 401 increases moving toward the middle portion from the upper portion of the base plate 510, as described above. Although the position of the moving unit 550, which is moved along the guide hole 415 formed in the door inner plate 401, may not vary, the position of the roller 530, which is moved on the base plate 510, may vary. Accordingly, the distance between the roller 530 and the moving unit 55 may increase toward the middle portion from the upper portion of the base plate 510. At this time, because the roller 530 is elastically biased toward the base plate 510 due to the elastic member 552 (see FIG. 11), which is positioned between the roller 530 and the moving unit 550, the roller 530 may press the pants P.

FIG. 5(*a*) is a perspective view of the moving unit 550, which is inserted into the guide hole 415 formed through the door inner plate 401 when viewed from a lateral side. FIG. 5(*b*) is a view of the moving unit 550 when viewed from a lateral side.

Referring to FIG. 5(*a*), the door 400 may not be composed of a single plate but may be an assembly in which multiple panels are assembled with each other. The door 400 may include the door inner plate 401, which is positioned so as to face the inlet 120. Furthermore, the door 400 may include the rear surface 4011, which is positioned far away from the inlet 120.

The guide hole 415 may be formed through the door inner plate 401. The guide hole 415 may be configured to have a rectangular shape, in which the length thereof in the vertical direction of the door 400 (in the direction of the arrow) is greater than the length thereof in the width direction of the door 400. The moving unit 550 may be moved along the guide hole 415 in the vertical direction of the door 400 when the roller 530 is rotated. When rotation of the roller 530 is halted, the roller 530 may be maintained in the current position.

In order for the roller 530 to press the pants P, the longitudinal length of the guide hole 415, along which the moving unit 550 is moved, may be almost equal to that of the base plate 510. However, because the laundry holder 420 holds the opposite sides of the waist portion of the pants P, the roller 530 is capable of moving over the length of the base plate 510, so the length of the guide hole 415 may be less than the length of the base plate 510.

Referring to FIG. 5(*a*) and FIG. 5(*b*), the moving unit 550 may include a moving mount 553, a portion of which is inserted into the guide hole 415 and which is moved in the vertical direction of the door 400, and a moving support 551, which is coupled to the moving mount 553 and supports the rotating shaft 536.

The moving unit 550 may further include the wheel 554, which is positioned parallel to the width direction of the door 400 and is coupled to the side of the moving mount 553 that is inserted into the guide hole 415. Because the length of the wheel 554 is greater than the length of the guide hole 415 in the width direction, it is possible to prevent the moving unit 550 from being separated from the guide hole 415.

The moving unit 550 may further include the elastic member 552 (see FIG. 11), which is positioned between the moving support 551 and the moving mount 553 so as to provide external force that is required in order for the roller 530 to press the pants P.

The roller 530 may receive power via the power supply 559 (see FIG. 6) provided on the rear surface 4011. Because the roller 530 is exposed to the humidity on the door inner plate 401, the roller 530 may be disposed on the rear surface 4011 in order to prevent the power supply 559 (see FIG. 6) from being exposed to the humidity.

When power is supplied to the power supply 559 (see FIG. 6), the roller 530 is capable of rotating about the rotating shaft 536. The drive unit 540 configured to rotate the roller 530 may include a motor. The drive unit 540 may be provided at a position M1 of the moving support 551 or a position M2 of the moving mount 553. The drive unit 540 may be constructed such that the motor directly rotates the roller 530. The drive unit 540 may further include a planet gear assembly or a pulley assembly, in addition to the motor. The drive unit 540 may be arranged in any manner, as long as the arrangement is capable of rotating the roller 530 at a predetermined speed. The drive unit 540 may be provided only at one end of the roller 530 or at both ends of the roller 530. When the drive unit 540 is provided both at both ends of the roller 530, there may be need to synchronize the rotational speed of the drive unit 540. The drive unit 540 may be controlled by the controller (not shown) provided in the laundry treatment apparatus 1000.

The roller 530 may be pressed not only by elasticity but also by the rotative force of the drive unit 540 while being actively rotated by the drive unit 540.

The wheel 554 may be coupled to the side of the moving mount 553 that is inserted into the guide hole 415. The wheel 554 may include a wheel shaft 5543, which is positioned parallel to the width direction of the door 400, and a wheel rotator 5544, which is coupled to the wheel shaft 5543 so as to allow the moving unit 550 to be smoothly moved along the guide hole 415 by reducing frictional force with the rear surface 4011.

The wheel 554 may include an upper wheel 554*a* and a lower wheel 554*b*, which are respectively coupled to the upper portion and the lower portion of the moving mount 553 in order to stably support the moving mount 553 via the rear surface 4011. Each of the upper wheel 554*a* and the lower wheel 554*b* may include the wheel shaft 5543 and the wheel rotator 5544.

FIGS. 6(*a*) to 6(*c*) illustrate the guide hole 415 and the power supply 559 when viewed from the rear surface 4011. Referring to FIG. 6(*a*), when the rotating shaft 536 includes a first rotating shaft 5361 coupled to one end of the roller 530 and a second rotating shaft 5362 coupled to the other end of the roller 530, the moving unit 550 may include the first transfer portion 5501 coupled to the first rotating shaft 5361 and the second transfer portion 5502 coupled to the second rotating shaft 5362, and the guide hole 415 may include the first guide hole 4151, which is positioned between one side surface of the base plate 510 and the side surface of the door 400 that is positioned close to the one surface of the base plate 510, and the second guide hole 4152, which is positioned between the other side surface of the base plate 510 and the other side surface of the door 400, which is positioned close to the other side surface of the base plate 510.

The power supply 559 may receive power from a machine compartment 200. Specifically, the power supply 559, which is provided in the door 400, and the machine compartment 200 may be connected to each other via an electric wire disposed in a communication hole, which is formed in the hinge portion of the door 200 or the edge of the door 200, where the door 200 meets the cabinet 150. Accordingly, even when the door 200 is opened, the electric wire is hidden from the outside for aesthetic purposes.

The first transfer portion 5501 may be movable along the first guide hole 4151 in the vertical direction of the door 400 when the roller 530 is rotated, and the second transfer portion 5502 may be reciprocated along the second guide hole 4152 in the vertical direction of the door 400 (in the direction of the arrow) when the roller 530 is rotated.

Here, the wheel 554 may include a first wheel 5541 coupled to the first transfer portion 5501 and a second wheel 5542 coupled to the second transfer portion 5502. Each of the first wheel 5541 and the second wheel 5542 may include a first upper wheel 5541*a* and a second lower wheel 554*b*. Each of the first upper wheel 5541*a* and the second lower wheel 554*b* may include the wheel shaft 5543, which is positioned parallel to the width direction of the door 400 and the wheel rotator 5544, which is coupled to the wheel shaft 5543 so as to allow the moving unit 550 to be smoothly moved along the guide hole 415 with reduced friction with the rear surface 4011.

The rear surface 4011 may be provided with the power supply 559, configured to supply power to the roller 530. In other words, it is possible to supply power, required for rotation of the roller 530, via the mounting space 4115 in the door 400.

In summary, the laundry treatment apparatus 1000 may include the cabinet 150 having the inlet 120 formed in one surface thereof, the first chamber 100, which is positioned in the cabinet 150 so as to receive laundry therein through the inlet 120, the second chamber 200, which is positioned below the first chamber 100 and defines a space separated from the first chamber 100, the door 400, which has the mounting space 4115 therein and which is rotatably coupled to the cabinet 150 so as to open and close the inlet 120, the door inner plate 401 facing the inlet 120, the laundry hanger support 405, which is provided on the door inner plate 401 and on which the pants P are hung, the base plate 510, which is coupled to the door inner plate 401 so as to support the pants P suspended from the laundry hanger support 405, the guide hole 415, which is oriented in the vertical direction of the door 400 parallel to the base plate 510 and which is formed through the door inner plate 401 in a direction perpendicular both to the vertical direction and to the width direction of the door 400, the rotating shaft 536, which is disposed parallel to the width direction of the door 400, the roller 530, which is rotatable about the rotating shaft 536 and presses the pants P, the moving unit 550, which supports the rotating shaft 536 and moves the rotating shaft 536 and the roller 530 along the guide hole 415 in the vertical direction of the door 400, and the power supply 559, which is disposed in the mounting space 4115 and supplies power to the roller 530.

Referring to FIGS. 6(*b*) and 6(*b*) which respectively illustrate the first transfer portion 5501 and the second transfer 5502 in FIG. 6(*a*) in enlarged views, the power supply 559 may include a wire 5590, which is positioned along the guide hole 415 in the vertical direction of the door 400. When the guide hole 415 includes the first guide hole 4151 and the second guide hole 4152 at the two ends of the roller 530, the wire 5590 may include a first wire 5591 and a second wire 5592, which are respectively disposed along the first guide hole 4151 and the second guide hole 4152.

For example, the first wire 5591 and the second wire 5592 may be respectively disposed along the first guide hole 4151 and the second guide hole 4152 so as to be parallel to each other. The first wire 5591 may be disposed adjacent to the side surface of the first guide hole 4151 that is positioned far away from one side surface of the door close to the first guide hole 4151 in the vertical direction of the first guide hole 4151. Meanwhile, the second wire 5592 may be disposed adjacent to the side surface of the second guide hole 4152 that is positioned far away from the other side surface of the door close to the second guide hole 4151 in the vertical direction of the second guide hole 4152.

In other words, the first wire 5591 and the second wire 5592 may be respectively disposed along the first guide hole 4151 and the second guide hole 4152 to as to be parallel to each other like rails.

Accordingly, the power supply 559 may supply power required not only for rotation of the roller 530 by the drive unit 540 but also for generation of moisture and/or steam from the moisture supply 533 and heating of the outer circumferential surface of the roller 530 by a first heater 5351 and a second heater 5352, through the first wire 5591 and the second wire 5592 from the power supply 559.

The moving mount 553 may include a moving contact 558 to be connected to the wire 5590, which is disposed on a mount body lower surface 5573, which is the surface of the moving mount on which the wheel 554 is positioned. The moving contact 558 may be configured to have a pin form, and may be made of a highly conductive material or an alloy thereof such as aluminum or copper, having high electrical conductivity.

When the wheel 554 is composed of the upper wheel 554*a* and the lower wheel 554*b*, the moving contact 558 may be positioned between the upper wheel 554*a* and the lower wheel 554*b* for stable contact. The current that flows through the moving contact 558 may be transmitted to the drive unit 540 for rotation of the roller 530. The current may also be used in the generation of steam and heating of the roller 530, which will be described later.

Negative current ((−) current) and positive current ((+) current) may be respectively connected to the first wire 5591 and the second wire 5592. Alternatively, positive current ((+) current) and negative current ((−) current) may also be respectively connected to the first wire 5591 and the second wire 5592. The roller 530 may be electrically connected to the first wire 5591 and the second wire 5592 so as to form a single circuit, and the circuit may be supplied with direct current. Although alternating current may also be used, it is desirable to use direct current in consideration of the size of the drive unit relative to the diameter of the roller and required torque.

The wire 5590 may be sheathed by a coating member made of an insulation material, and the coating member may be partially removed in the vertical direction of the door 400 such that the portion of the wire 5590 that is in contact with the moving contact 558 is exposed.

FIG. 6(*a*) illustrates the roller 530, which is positioned at the upper end of the guide hole 415. The position may be the initial position of the roller 530. An input unit may be positioned on the front surface of the door 400 for selection of operational courses so as to allow a user to select a course for operation of the press unit 500. The front surface of the door 400 may refer to the surface of the door 400 that is exposed when the door 40 closes the inlet 120.

The position at which the roller 530 is positioned prior to the operation of the press unit 500 may be set as an initial position. The initial position may be the upper end of the guide hole 415. The reason for this is because the incorrect generation of creases such as double creases is reduced in the case in which the roller 530 is reciprocated in the vertical direction of the door 400 from the lower ends of the leg parts of the pants P than in the case in which the roller 530 is reciprocated in the vertical direction of the door 400 from the waist portion of the pants P.

When a predetermined period of time for the course that is selected by a user lapses, the roller 530 may return to the initial position and stop. The reason for this is to eliminate the need to preferentially rearrange the roller 530 to the initial position before every use because the final position of the roller 530 varies at every termination of use.

Referring to FIGS. 6, 10 and 11, it will be appreciated that components that perform the same function are positioned close to one side and the other side of the door 400. In other words, the guide hole 415 may include the first guide hole 4151 and the second guide hole 4152. Furthermore, the wire 5590 may include the first wire 5591 and the second wire 5592. Furthermore, the moving unit 550 may include the first transfer portion 5501 and the second transfer portion 5502 so as to respectively correspond to the first guide hole 4151 and the second guide hole 4152. Furthermore, the moving contact 558 may include a first contact 5581 and a second contact 5582, and the wheel 554 may include the first wheel 5541 and the second wheel 5542. The moving mount 553 may include a first transfer mount 5531 and a second transfer mount 5532, and a moving mount body 557 may include a first transfer mount body 5571 and a second transfer mount body 5572. The moving support 551 may include a first transfer support 5511 and a second transfer support 5512. In other words, components having the same function may be symmetrically disposed.

Accordingly, although only one set of components among the components of the guide hole 415, the components of the wire 4490, the components of the moving unit 550, the components of the moving contact 558, the components of the wheel 554, the components of the moving mount 553, the components of the moving mount body 557 or the components of the moving support 551 may be described in this specification, the other sets of components may have the same function, and may be formed symmetrically with the one set of the components.

FIG. 7 illustrates the roller 530 when viewed from above. The roller 530 may include the roller body 5301 defining the appearance of the roller 530, a first press 531 positioned close to one end of the roller body 5301, a second press 532 positioned close to the other end of the roller body 5301, and the cylindrical moisture supply 533, which is positioned between the first press 531 and the second press 532 so as to connect the first press 531 to the second press 532 and supplies moisture to the pants P.

The roller 530 may be rotated about the rotating shaft 536, which is oriented in the width direction of the door 400. The roller 530 may include the moving unit 550 configured to enable the roller 530 to be moved in the longitudinal direction of the door 400.

Referring to an embodiment of the moisture supply 533 shown in FIG. 7, the moisture supply 533 may have a plurality of steam spray holes 5331 through which steam is sprayed to the outer circumferential surface of the moisture supply 533.

When steam is sprayed through the plurality of steam spray holes 5331, the steam may permeate the pants P, which are in the state of being pressed by the roller 530. Furthermore, because the moisture supply 533 may be provided therein with the steam generation tank 580 (see FIG. 8) for the supply of steam, in addition to the steam unit 250 configured to spray steam to the laundry disposed in the first chamber 100, the press unit 500 may be disposed in the first chamber 100, and may be operated independently of the supply of steamed and/or dehumidified and heated air. In other words, it is possible to spray steam and apply heat to the suspended pants P while only the roller 530 is moved without operating the steam unit 250, the blower unit 220, or the heat pump unit 230, which are received in the second chamber 200. For example, the press unit may convey an effect obtained when a user uses a steam iron on an ironing board in order to remove wrinkles.

Here, if the diameter of the moisture supply 533 is equal to the diameter of the first press 531 or the second press 532, the moisture supply 533 may press the suspended pants P to the same extent as the extent to which the first press 531 or the second press 532 presses the pants P. Here, because some of the plurality of steam holes 5331 that are in contact with the pants P are clogged by the pants P, steam may be discharged through others of the plurality of steam spray holes 5331, which are positioned opposite the some of the steam holes 5331. In this case, because it is impossible to achieve the object of spraying steam to the pants P, the diameter of the moisture supply 533 may be smaller than the diameter of any of the first press 531 and the second press 532 in order to overcome this problem.

The regions of the pants P corresponding to the moisture supply 533 may have seams or stitch lines. Pressing the seams or the stitch lines may cause warping of the pants P and formation of double creases. Therefore, in order to prevent these problems, the diameter of the moisture supply 533 may be smaller than the diameter of any of the first press 531 and the second press 532.

The roller 530 may be configured to have a shape similar to that of a dumbbell. In other words, the outer circumferential surface of a region of the roller 530, which corresponds to a predetermined length in the longitudinal direction of the rotating shaft 536 of the roller 530 or in the width direction of the door 400, may have a diameter less than that of the two ends of the roller 530. The reason for this is to provide a space that avoids stitch lines, which are positioned at the center line of suspended pants P and into which steam is sprayed.

The predetermined length may be Wr in FIG. 7. The roller 530 may include the moisture supply 533 in the region corresponding to the predetermined length Wr.

However, the shape of the roller 530 and the shape of the moisture supply 533 shown in FIG. 7 are only for illustrative purposes, and the roller 530 and the moisture supply 533 may have other shapes as long as they remain capable of spraying steam. For example, the diameter of the moisture supply 533 may be equal to the diameter of the first press 531 or the second press 532. In this case, the steam spray holes 5331, which are formed in the outer circumferential surface of the roller 530, which has a constant diameter, may be depressed radially inwards in order to ensure space into which to spray steam. In other words, the entire region of the moisture supply 533 is not depressed, and only the regions of the individual steam spray holes 5331 may be depressed. Also in this case, the portion of the outer circumferential surface of the roller 530 that corresponds to the stitch lines in the pants P may be depressed radially inwards in order to avoid interference with the stitch lines when the roller 530 presses the pants P. In other words, a V-shaped or U-shaped notch may be formed in the center of the outer circumferential surface of the roller 530 in order to prevent interference with the stitch lines.

The drive unit 540 configured to drive the roller 530 may be provided at one end of the roller 530. Alternatively, the drive unit 540 may be provided at any other position on the roller 530 as long as the drive unit 540 is capable of rotating the roller 530. FIG. 7 illustrates an embodiment in which the first transfer portion 5501 and the second transfer portion 5502 are coupled to the two ends of the roller 530. The drive unit 540 may be positioned in the first transfer portion 5501 or the second transfer portion 5502. For example, the drive unit 540 may be positioned at M1 or M2, and may generate rotative force required to rotate the roller 530 using power received from the power supply 559 via the moving contact 558.

The moisture supply 533 may be composed of a first moisture supply body 533*a* and a second moisture supply body 533*b*, which are coupled to each other. Furthermore, at least one of the first moisture supply body 533*a* or the second moisture supply body 533*b* may be separated from or coupled to the roller 530 or the roller body 5301. The reason for this is to ensure attachment and detachment of the steam generation tank 580 (see FIG. 8), which may be positioned in the moisture supply 533.

In other words, the moisture supply 533 may include the first moisture supply body 533*a* including a tank introduction port 120, through which the steam generation tank 580 is inserted into and separated from the inside of the moisture supply 533, and a second moisture supply body 533*b* coupled to the tank introduction port 120. It is preferable that the first moisture supply body 533*a* and the second moisture supply body 533*b* be coupled to each other with low friction.

FIG. 8(*a*) illustrates an embodiment in which the first heater 5351, the second heater 5352, and a steam heater 5353 are provided in the roller 530. As described above, the roller 530 is not intended merely to press the pants P. For efficient removal of wrinkles and efficient formation of intended creases, the roller 530 may spray steam while transmitting heat to the pants P.

For spraying steam, the moisture supply 533 may include the steam generation tank 580, which is positioned in the moisture supply 533 and discharges generated steam, the steam heater 5353, which is positioned in the steam generation tank 580 and heats the water stored in the steam generation tank 580, and the plurality of steam spray holes 5331 (see FIG. 7), which are formed throughout the outer circumferential surface of the moisture supply 533 in order to spray the steam, which is generated by the steam heater 5353 and is discharged from the steam generation tank 580, to the pants P.

The roller 530 may further include a tank connector 539 configured to allow the steam generation tank 580 to be coupled to one of the first press 531 and the second press 532 and the moisture supply 533 and to be separated therefrom.

Consequently, the distance between the steam generation tank 580 and the steam spray holes 5331 may be reduced, and the steam generation tank 580 may be detachably received in the roller 530 like a cartridge. Accordingly, it is possible to further simplify and shorten the flow passage compared to the case in which a water supply tank or a subsidiary tank is externally provided in order to supply water. Furthermore, because steam is sprayed only to the suspended pants P, it is possible to reduce the amount of steam that is required compared to the case in which steam is supplied throughout the first chamber 100.

The roller 530 may include a blocker configured to prevent the steam between the first press 531 and the moisture supply 533 and between the second press 532 and the moisture supply 533 from being discharged through the plurality of steam spray holes 5331 (see FIG. 7) and from leaking into the first press 531 and the second press 532. A first blocker 5371 may be positioned between the first press 531 and the moisture supply 533, and a second blocker 5372 may be positioned between the second press 532 and the moisture supply 533. The first blocker 5371 and the second blocker 5372 may be made of metal film or plastic film.

One of the first blocker 5371 and the second blocker 5372 may be provided with the tank connector 539 so as to be coupled to or separated from the steam generation tank 580.

Referring to FIG. 8(*c*), the steam generation tank 580 may include a steam generation tank body 583, and may further include a first cover 581 and a second cover 582 which close the two ends of the steam generation tank body 583. Furthermore, the steam generation tank 580 may include a first terminal 5851 and a second terminal 5852, which are electrically connected to one of the first cover 581 and the second cover 582. These may have shapes similar to terminals provided at an elongate fluorescent tube, which are fitted into a socket. When the first terminal 5851 and the second terminal 5852 are connected to the tank connector 539, which has a socket shape corresponding to the first terminal 5851 and the second terminal 5852, the steam generation tank 583 may be electrically connected to the tank connector 539 so as to activate the steam heater 5353, for example, a heater provided in the steam generation tank 580.

Unlike the steam generation tank 580, which is removably coupled to the tank connector like a kind of cartridge, the steam generation tank 580 may be connected to a water supply pipe, which receives water from the externally provided water supply tank 310 (see FIG. 1). Accordingly, the controller (not shown) may supply water through the water supply pipe when there is a need to supply water to the steam generation tank 580.

The steam heater 5353 may convert electricity into heat, and may boil the water stored in the steam generation tank 580 to generate steam. The generated steam may be discharged through steam dischargers 5811 and 5812, which are provided at the first cover or the second cover, and may in turn be discharged to the outside through the plurality of steam spray holes 5331, thereby being sprayed to the pants P.

The heater may be preferably composed of a coiled heater or a sheath heater. However, the heater may be embodied as any other kind of heater, as long as the heater is capable of heating the water stored in the steam generation tank 580. For example, the heater may include an inverter-type coil. In the case in which a steam generation pipe rather than the steam generation tank is provided, the steam generation pipe may be connected to the water supply tank 310 (see FIG. 1), which is externally provided, such that the water is heated so as to generate steam while the water flows through the steam generation pipe.

The tank connector 539 may be rotated in a direction opposite the rotational direction of the roller 530. The reason for this is to immerse the steam heater 5353 into the water stored in the steam generation tank 580. The tank connector 539 may be embodied as a combination of gears. Alternatively, the steam generation tank 580 may be configured so as to be freely rotated in the roller 530. Here, the steam generation tank 580 may be oriented in the direction of gravity due to the weight of the water stored in the steam generation tank 580, regardless of rotation of the roller 530. However, the steam heater 5353 may be provided on the inner circumferential surface of the steam generation tank 580, and the steam generation tank 580 may be rotated together with the roller 530.

Furthermore, design may be made so that the amount of water stored in the steam generation tank 580 always remain sufficient to immerse the steam heater 5353 in the water.

The roller 530 may further include the heater 535 configured to transmit heat to the pants P to thus heat the pants P. The heater 535 may include the first heater 5352 configured to heat the first press 531 and the second heater 5352 configured to heat the second press 532. The heater 535 may be electrically connected to the steam heater 5353. The reason for this is for heater 535 to be electrically connected to the first wire 5591 and the second wire 5592.

The first heater 5351 may be provided in a coiled form along the inner circumferential surface of the first press. When the first heater 5351 is in contact with the inner circumferential surface of the first press 531, heat may be most efficiently transmitted. Alternatively, the first heater 5351 may be positioned in the first press 531 such that the heat emitted from the first heater 5351 heats the first press 531 in a thermal radiation manner.

The second heater 5352 may be provided in a coiled form along the inner circumferential surface of the second press 532. When the second heater 5352 is in contact with the inner circumferential surface of the second press 532, heat may be most efficiently transmitted. Alternatively, the second heater 5352 may be positioned in the second press 532 such that the heat emitted from the second heater 5352 heats the second press 532 in a thermal radiation manner. The second heater 5352 may perform heating in any manner, as long as it is possible to heat the second press 532 to thus transmit the heat to the pants P.

Considering that the first press 531 and the second press 532 are heated, it is desirable that the roller body 5301 be made of a metal material.

Referring to FIG. 8(*a*), the first heater 5351 and the second heater 5352 may be electrically connected, and the steam heater 5353 may dependently receive power via the moving unit. However, in consideration of economic efficiency, the first heater 5351, the second heater 5352, and the steam heater 5353 may be electrically and integrally connected to one another, as illustrated in FIG. 8(*b*). This is only an illustrative example, and the first heater 5351, the second heater 5352, and the steam heater 5353 may be electrically connected to one another in another manner so as to heat the first press 531 and the second press 532 and discharge steam through the moisture supply 533.

In place of a moisture supply 533 configured to spray steam through the steam spray holes 5331, the moisture supply 533 may include a moisture-containing porous portion 5332 (see FIG. 15) wound around the outer circumferential surface of the moisture supply 533. The diameter of the outer circumferential surface of the moisture-containing portion 5332 may be equal to or greater than the diameter of the first press 531 and the second press 532 such that, when the roller 530 presses the pants P, the moisture-containing portion 5332 is squeezed, and thus the moisture contained therein is discharged to the outside.

However, because the steam permeates throughout the pants P due to the ability of the steam to permeate laundry even when the steam is sprayed only to a portion of the pants P, it is more desirable to spray steam using the steam spray holes 5331 and the steam generation tank 580 than using the moisture-containing portion 5332 (see FIG. 15).

FIGS. 8(*a*) to 8(*c*) illustrate an embodiment in which the moisture supply 533 is positioned in the roller 530 together with the heater 535. FIG. 9 illustrates an embodiment in which the roller 530 includes a steam-moving unit 590 provided outside the roller 530, in place of the moisture supply 533. In other words, although the roller 530 includes therein the heater 535, the steam-moving unit 590 configured to spray steam to the pants P may be provided outside the roller 530. Because steam must be sprayed in advance before the heated roller 530 presses the pants P, the steam-moving unit 590 may be connected to the rotating shaft 536 so as to be rotated in the rotational direction of the roller 530. For example, when the roller 530 rotates in the first rotational direction or in the second rotational direction opposite the first rotational direction and is thus lowered in the vertical direction of the door 400, as illustrated in FIG. 9(*a*), the steam-moving unit 590 may be positioned ahead of the roller 530 by virtue of rotation thereof before the roller 530 is lowered. Consequently, the heated roller 530 may press the pants P after steam is sprayed, thereby efficiently removing wrinkles and forming intended creases, for example, front creases in the pants P.

Referring to FIG. 9(*b*), when the roller 530 is raised in the vertical direction of the door 400 while rotating in a direction opposite the direction in FIG. 9(*a*), the steam-moving unit 590 may be positioned ahead of the roller 530 by virtue of rotation thereof before the roller 530 is raised in the vertical direction of the door 400.

To this end, the steam-moving unit 590 may include a water vapor tank 591 configured to generate steam, a rotational support 592 configured to connect the water vapor tank 591 to the rotating shaft 536 and to rotatably support the water vapor tank 591, and a buffer 593 coupled to the rotational support 591 and supporting the rotational support 592 in the state of being positioned parallel to the door inner plate 401.

The bumper 593 may prevent the water vapor tank 591 from being excessively rotated to a predetermined angle or more when the water vapor tank 591 is rotated by means of the rotational support 592. In other words, the water vapor tank 591 may be rotated only until the water vapor tank 591 is positioned ahead of the roller 530 and is positioned parallel to the door inner plate 401. The bumper 593 may stably support the steam-moving unit 590 when the bumper 593 is moved in the state of being coupled to the moving mount 553.

FIGS. 9(*c*) and 9(*d*) illustrate the roller 530 and the steam-moving unit 590 when viewed from the front. As illustrated in these drawings, the steam-moving unit 590 may spray steam in advance of the roller 530 prior to movement of the roller 530. Accordingly, it is possible to efficiently remove wrinkles and to form intended creases.

FIG. 10(*a*) illustrates an embodiment of a battery configured to supply power to the roller 530. FIG. 10(*b*) illustrates the roller 530 when viewed from a lateral side. FIG. 10(*c*) illustrates a plurality of charging points provided on the rear surface 4011. FIG. 6 illustrates an arrangement in which power required to rotate the roller 530 is provided via the wire 5590 disposed along the guide hole 415. Unlike this, FIG. 10 illustrates an arrangement in which at least one battery-charging portion 561 is provided along the guide hole 415. The battery-charging portion 561 may be provided for stable supply of power. Alternatively, after the battery-charging portion 561 is charged by supplying power thereto, the roller 530 may be rotated by the battery-charging portion 561, steam may be generated by the moisture supply 533, and the roller 530 may be heated using the heaters 5351 and 5352.

When the roller 530 moves along the guide hole 415 in the vertical direction of the door 400 and reaches the at least one charging portion 561, the controller (not shown) may check the remaining power in a battery 560 and may then charge the battery 560 via the at least one charging portion 561 when necessary. Because the roller 530 remains at a certain point for a predetermined period of time during charging, the roller 530 may halt rotation thereof.

FIG. 10(*a*) illustrates an embodiment in which the battery 560 is provided outside the roller 530, is supported by the moving unit, and is movable together with the roller 530 due to rotation of the roller 530. Referring to FIG. 10(*b*), the battery 560 may include a charging support 562 configured to connect the battery 560 to the moving support 551 and to support the battery 560, and a charging bumper 593, configured to prevent the charging support 562 from being rotated beyond a predetermined angle and to support the charging support 562.

FIG. 10(*c*) illustrates an embodiment in which at least one charging portion 561 is arranged on the rear surface 4011 along the guide hole 415. The at least one charging portion 561 may be positioned at a point P1, which is the upper end of the guide hole 415. The point P1 is the initial position of the roller 530, which is described above, and is necessary to charge the battery 560 while the press unit 500 is not used. The at least one charging portion 561 may be connected to the wire 5590 received in the mounting space 4115.

The battery-charging portion 561 may include at least one charging portion arranged along the guide hole 415. In other words, the battery-charging portion 561 may include a first charging portion positioned at the upper end of the guide hole 415, that is, the initial position, and a second charging portion positioned at the lower end or an intermediate position of the guide hole 415. Alternatively, the battery-charging portion 561 may include a charging portion at an intermediate point P2 and a charging portion at a point P3, which are arranged along the guide hole 415, as illustrated in FIG. 10(*c*). When the roller 530 reaches the battery-charging portion 561, the controller (not shown) may check the power remaining in the battery 560, and may charge the battery 560 for a predetermined period of time until the charging rate of the battery 560 drops to a predetermined rate in consideration of the remaining time of the current course.

FIG. 11 illustrates embodiments of the moving support 551 and the moving mount 553 in an enlarged view. The moving unit 550 may include the moving mount 553, which is partially inserted into the guide hole 415 and is moved in the vertical direction of the door 400, and the moving support 551 coupled to the moving mount 553 so as to support the rotating shaft.

Referring again to FIG. 11(*a*), the moving unit 550 may further include the wheel, which is positioned parallel to the width direction of the door 400 and is coupled to the mount body lower surface 5573, which is the surface of the moving mount 553 that is inserted into the guide hole 415.

The moving unit 550 may further include the elastic member 552, which is positioned between the moving support 551 and the moving mount 553 so as to provide elasticity such that the roller body 5301 presses the pants P.

Referring to FIG. 11(*b*), the moving unit 550 may include the moving mount body 557, which receives a portion of the moving support 551, and a support hole 5576, which is formed in the moving mount body 557 so as to open toward the first chamber 100 and exposes the remaining portion of the moving support 551 to the outside. The elastic member 552 may be accommodated in the moving mount body 557 so as to elastically connect a portion of the moving support 551 to the moving mount body 557.

For example, when the distance between the base plate 510 and the guide hole 415 in a perpendicular direction gradually increases, the distance between the roller 530 and the moving unit 550 may also increase. Specifically, the distance between the moving support 551 supporting the roller 530 and the moving mount may increase. In order to accommodate the distance variation, the elastic member 552 may be provided between the moving support 551 and the moving mount 553. Accordingly, when the distance between the roller 530 and the moving unit 550 increases, the elastic force caused by the elastic member 552 is exerted in the opposite direction, whereby the roller 530 presses the pants P disposed on the base plate 510.

Meanwhile, when the distance between the base plate 510 and the guide hole 415 in the perpendicular direction gradually decreases, the distance between the roller 530 and the moving unit 550 may decrease. Specifically, the distance between the moving support 551 supporting the roller 530 and the moving mount 553 may decrease. Accordingly, when the distance between the roller 530 and the moving unit 550 decreases, the elastic force caused by the elastic member 552 is exerted in the opposite direction, whereby the roller 530 does not press the pants P disposed on the base plate 510.

Using this principle, it is possible to cause the roller 530 to press or to release the pants P by controlling the distance between the base plate 510 and the door inner plate 401, the distance between the base plate 510 and the guide hole 415 formed in the door inner plate 401 or the distance between the guide 440, which will be described later, and the base plate 510. When there is a parallel arrangement of the base plate 510 and the door inner plate 401, the base plate 510 and the guide hole 415, or the guide 440 and the base plate 510, with a constant distant therebetween, the roller 530 may press the pants P with a constant force.

Referring to FIG. 11(*c*), the elastic member 552 may be accommodated in the moving mount 553. The moving mount 553 may include the moving mount body 557 defining the appearance of the moving mount 553. The moving mount body 557 may include the mount body lower surface 5573, which is inserted into the guide hole 415, a mount body upper surface 5573 positioned opposite the mount body lower surface 5573, and a mount body side surface 5575, which connects the mount body upper surface 5574 to the mount body lower surface 5573 to define an internal space therebetween. The mount body side surface 5575 may be fully or partially inserted into the guide hole 415 depending on the distance between the base plate 510 and the door inner plate 401, the distance between the base plate 510 and the guide hole 415 formed in the door inner plate 401, or the distance between the guide 440 and the base plate 510.

The moving support 551 may include a first support body 551*a*, which is inserted into the moving mount 553 and is connected to the elastic member 552, and a second support body 551*b*, which is connected to the first support body 551*a* so as to support the rotating shaft 536 and the roller 530.

The mount body upper surface 5574 may have a support hole 5576 formed therethrough. A portion of the moving support 551 may be received in the moving mount body 557 through the support hole 5576, and the remaining portion of the moving support 551 may project outwards from the support hole 5576, and may be connected to the rotating shaft 536.

The elastic member 552 may connect the portion of the moving support 551 that is received in the moving mount body 557 to the mount body upper surface 5574. Accordingly, when the distance between the moving support 551 and the moving mount 553 increases, the portion of the moving support 551 that is received in the moving mount body 557 may project outwards through the support hole 5576. Accordingly, because the elastic member 552 is compressed so as to push the moving support 551 in the opposite direction, the roller 530 may press the pants P disposed on the base plate 510.

In other words, when the first support body 551*a* is moved in the direction of the support hole 5576 and the roller 530 is moved far away from the moving unit 550 by the second support body 551*b*, the roller 530 may press the pants P by virtue of the elastic force of the elastic member 552.

To this end, the laundry treatment apparatus 1000 may include the cabinet 150 having the inlet 120 formed in a surface thereof, the first chamber 100, which is positioned in the cabinet 150 and receives laundry through the inlet 120, the second chamber 200, which is positioned below the first chamber 100 and defines a space separated from the first chamber 100, the door 400 rotatably coupled to the cabinet 150 so as to open and close the inlet 120, the door inner plate 401 positioned on the surface of the door 400 that faces the first chamber 100, the laundry hanger support 405, which is provided on the door inner plate 401 and on which the pants P are hung, the base plate 510, which is coupled to the door inner plate 401 in the state of being spaced apart from the door inner plate 401 so as to support the pants P hung on the laundry hanger support 405, the guide hole 415 formed through the door inner plate 401 in the vertical direction of the door 400 and in a direction perpendicular both to the vertical direction and to the width direction of the door 400, the rotating shaft 536 positioned parallel to the width direction of the door 400, the roller 530, which is rotatable about the rotating shaft 536 and presses the pants P, the moving unit 550, which moves the roller 530 along the guide hole 415 while the roller 530 is rotated, and the elastic member 552, which is positioned in the moving unit 550 and is connected to the rotating shaft 536 so as to apply elastic force to the roller 530 toward the base plate 510 to press the pants P and to support the rotating shaft 536.

The position of the elastic member 552 will now be described in detail with reference to FIG. 11(*c*). The moving support 551 may include the first support body 551*a*, which is received in the moving mount 553 and is connected to the elastic member 552, and the second support body 551*b*, which is connected to the first support body 551*a* and supports the rotating shaft 536. The moving mount 553 may include the moving mount body 557 accommodating the first support body 551*a* therein, the mount body upper surface 5574 formed in the surface of the moving mount body 557 that faces the first chamber 100 for communication of the inside of the moving mount body 557 with the first chamber 100, and the support hole 5576 formed through the mount body upper surface 5574 so as to allow the first support body 551*a* to project outwards from the moving mount body 557. Here, the elastic member 552 may be positioned between the mount body upper surface 5574 and the first support body 551*a*.

Although the elastic member 552 may be positioned at any position as long as the elastic member 552 connects the moving support 551 to the moving mount 553, the elastic member 552 is preferably positioned in the moving mount 553 so as to realize a neat appearance and to minimize exposure to moisture.

The base plate 510 may merely be positioned parallel to the door inner plate 401 so as to always maintain a predetermined facing distance therebetween. Here, the elastic member 552 may always apply elastic force to the roller 530 to press the pants P.

The facing distance may be the distance between the base plate 510 and the door inner plate 401, or may be the distance between the door inner plate 401 and a point at which an imaginary line, which extends perpendicularly from the door inner plate 401, intersects the base plate 510. When the base plate 510 includes a curved surface, for example, when the intermediate portion of the base plate 510 is configured to be flat parallel to the door inner plate 401 so as to maintain a predetermined facing distance therebetween whereas the upper and lower portions of the base plate 510 are curved toward the door inner plate 401, it is possible to vary the facing distance between the base plate 510 and the door inner plate 401. In other words, when the roller 530 moves on the base plate 510 and the moving unit 550 moves along the guide hole 415 formed in the door inner plate 401 in the vertical direction of the door 400, the facing distance between the base plate 510 and the door inner plate 401 may vary and the distance between the roller 530 and the moving unit 550 may also vary. Specifically, the distance between the first support body 551*a* and the mount body upper surface 5574 may vary. Consequently, the length of the elastic member 552 positioned between the first support body 551*a* and the mount body upper surface 5574 may vary.

Here, the distance or the perpendicular distance means the distance between an arbitrary point of an object and a point of another object at which an imaginary line, which extends from the arbitrary point in a direction perpendicular both to the vertical direction and to the width direction of the door 400, meets the another object.

When the length of the elastic member 552 increases beyond the original length, that is, when the distance between the base plate 510 and the door inner plate 401 increases, the elastic force applied to the roller 530 may gradually increase. Accordingly, when the roller 530 on the base plate 510 is moved toward the intermediate portion of the base plate 510, the pressure applied to the pants P may gradually increase. Because the intermediate portion of the base plate 510 is spaced apart from the door inner plate 401 by a predetermined spacing distance, the roller 530 may press the pants P with a constant force. The spacing distance means a predetermined distance by which the base plate 510 is spaced apart from the door inner plate 552 such that the roller 530 presses the pants P by means of the elastic member 552. Accordingly, the distance may vary depending on the design.

Accordingly, because the elastic member 552 is positioned between the mount body upper surface 5574 and the first support body 501*a*, it is possible to apply force to the roller 530 in the direction of the base plate 510 when the distance between the door inner plate 401 and the base plate 510 is equal to or greater than a predetermined distance.

Because the distance between the base plate 510 and the door inner plate 401 decreases again moving toward the lower portion of the base plate 510, the force applied to the pants P by the roller 530 will decrease. The reason for this is because there is no need to press the lower portion of the base plate 510 because the lower portion of the base plate 510 corresponds to the waist portion of the pants P.

Accordingly, in the case in which the base plate 510 is designed so as to have a curved surface, it is possible to control the force applied to the pants P by the roller 530 while efficiently applying tensile force to the pants P as described above.

When the perpendicular distance between the base plate 510 and the guide hole 415 gradually increases, the distance between the roller 530 and the moving unit 550 increases. Specifically, the distance between the moving support 551 supporting the roller 530 and the moving mount 553 increases. The elastic member 552, which is capable of accommodating the distance variation, may be provided at the moving support 551 and the moving mount 553. Accordingly, when the distance between the roller 530 and the moving unit 550 increases, the elastic force of the elastic member 552 is exerted in the opposite direction, whereby the roller 530 is capable of pressing the pants P disposed on the base plate 510.

Meanwhile, when the distance between the base plate 510 and the guide hole 415 gradually decreases, the distance between the roller 530 and the moving unit 550 will decrease. Specifically, the distance between the moving unit 551 supporting the roller 530 and the moving mount 530 will decrease. Accordingly, when the distance between the roller 530 and the moving unit 550 decreases, the elastic force from the elastic member 552 is applied in the opposite direction, whereby the roller 530 does not press the pants P disposed on the base plate 510.

Therefore, it is preferable to design the base plate 510 having the curve surface using this mechanism. FIGS. 12 and 13 illustrate various embodiments of the guide 440 having a curved surface. Furthermore, it is possible to obtain a similar effect not only in the case in which the base plate 510 is designed to have a curved surface but also in the case in which the guide hole 415 is designed to have a curved surface.

Referring to FIGS. 12(*a*) and 12(*b*), a support surface 515 of the base plate 510, which is the surface that faces the first chamber and the roller 530, among the two surfaces of the base plate 510, and that supports the pants P, may be curved. Furthermore, in order to make the guide hole 415 curved, it is possible to include the guide 440, which is positioned on the rear surface 4011 so as to control the distance between the roller 530 and the moving unit 550 by controlling the distance to the base plate 510. A guide surface 4401 of the guide 440, which is in contact with the wheel 554, may be curved.

In other words, the door 400 may include the door inner plate 401, the rear surface 4011, which is the surface of the door inner plate 401 that is positioned far away from the inlet 120, the guide 440 coupled to the rear surface 4011 so as to define the mounting space 4115, and the guide 440, which is positioned on the rear surface 4011 so as to control the distance between the roller 530 and the moving unit 550 by controlling the distance to the base plate 510.

The base plate 510 may include the support surface 515 supporting the pants P. The support surface 515 may include a first support surface 5151, which is positioned at the upper portion thereof and is curved, and a second support surface 5152, which is positioned below the first support surface and extends parallel to the door inner plate 401. The distance between the guide 440 and the first support surface 5151 may increase moving toward the second support surface 5152. The distance between the door inner plate 401 and the second support surface 5152 may be maintained constant. The reason for this is to enable the roller 530 to press the pants P with constant force while maintaining the distance between the door inner plate 401 and the first support surface 5151 constant.

The base plate 510 may further include a third support surface 5153, which is positioned at the lower portion of the support surface 551 so as to be connected to the second support surface 5152 and is curved. The distance between the door inner plate 401 and the third support surface 5153 may decrease moving away from the second support surface 5152.

In other words, it is possible to control the distance between the roller 530 and the moving unit 550 depending on the perpendicular distance between the base plate 510 and the guide 440.

The portion connecting the first support surface 5151 to the second support surface 5151 and the portion connecting the second support surface 5152 to the third support surface 5153 may be convex so as to smoothly connect the curved surface to the flat surface.

Similarly, the guide 440 may also be curved. Here, the guide surface 4401 of the guide 440, which is in contact with the wheel 554 so as to guide the wheel 554, may also be curved. The guide 440 may be embodied as a guide rail. In this case, the guide surface 4401 of the guide rail, which is in contact with the wheel 554, may be curved.

Because the guide 440 is positioned on the rear surface 4011 and is thus disposed in the interior space of the door 400, the guide 440 may not be exposed to the outside. The distance between the moving unit 550 and the roller 530 may be controlled by controlling only the depth to which the moving unit 550 is inserted into the guide hole 415. The moving unit 550 may come into contact with the guide 440 via the wheel 554.

The guide 440 may include a first guide surface 4411, which is positioned so as to correspond to the first support surface 5151 and to face the first support surface 5151 in the state of being parallel thereto, and a second guide surface 4412, which is positioned so as to correspond to the second support surface 5152 and to face the second support surface 5152 in the state of being parallel thereto and which is connected at one end thereof to one end of the first guide surface 4411. The guide 440 may further include a third guide surface 4413, which is positioned so as to correspond to the third support surface 5153 and which extends from the second guide surface 4412 parallel to the door inner plate 401.

Consequently, the base plate 510 may include the first support surface 5151, the second support surface 5152, and the third support surface 5153, which are sequentially curved, flat, and curved, from the upper portion to the lower portion of the door inner plate 401. The guide 440 may include the first guide surface 4411, the second guide surface 4412, and the third guide surface 4413, which sequentially correspond to the first support surface 5151, the second support surface 5152, and the third support surface 5153, from the upper portion to the lower portion of the door inner plate 401. The third surface 5153 may be curved, whereas the third guide surface 4413 may be flat.

Assuming that zones in which the first support surface 5151, the second support surface 5152, and the third support surface 5153, and the first guide surface 4411, the second guide surface 4412, and the third guide surface 4413, which respectively correspond thereto, are sequentially referred to as a first zone R1, a second zone R2, and a third zone R3, the first support surface 5151 and the first guide surface 4411 may be curved and may face each other in the state of being parallel to each other in the first zone R1. In other words, the first support surface 5151 and the first guide surface 4411 may have the same curvature such that the distance therebetween is maintained constant. When the perpendicular distance H1 between the first support surface 5151 and the first guide surface 4411 is greater than the spacing distance in the first zone R1, the roller 530 may press the pants P due to the constant elastic force of the elastic member 552. Accordingly, the pants P may be pressed by a constant pressure in the first zone R1.

The second support surface 5152 and the second guide surface 4412 are flat, and a constant distance is maintained therebetween in the second zone R2. Here, the second guide surface 4412 may be a portion of the rear surface. In other words, it is possible to employ the flat rear surface itself. Here, because the distance therebetween is maintained constant, the roller 530 may press the pants P with constant pressure.

The distance between the third support surface 5153 and the third guide surface 4413 may decrease in the third zone R3. The reason for this is because the third guide surface 4413 is flat and the third support surface 5153 is curved toward the door inner plate 401. For reference, the door inner plate 401 may be positioned between the base plate 510 and the guide 440.

Because the distance between the roller 530 and the moving unit 550 decreases in the third zone R3, the elastic member 552 may push out the roller 530 rather than pulling the roller 530 toward the base plate 510. Accordingly, the force applied to the pants P may be eliminated or minimized in the third zone R3, which corresponds to the waist portion of the pants P. The reason for this is because the waist portion of the pants P is provided with various projecting elements such as zippers, buttons and pockets, which are apt to be crushed by pressure, and unwanted double creases are apt to be formed.

In the third zone R3, it is possible to remove wrinkles by spraying steam through the steam spray hole 5331 to cause the steam to permeate the pants P rather than by pressing the pants P using the roller 530.

FIG. 13(*a*) illustrates embodiments of the base plate 510 and the guide 440, which are curved differently. Unlike the base plate 510 and the guide 440 shown in FIG. 12, the base plate 510 may be flat. The guide 440 may be flat in the upper portion and the intermediate portion thereof, and may be curved toward the rear surface in the lower portion thereof. For reference, the rear surface 4011 may be positioned between the base plate 510 and the guide 440. In FIG. 13, the zone that corresponds to the upper portion and the intermediate portion 4414 of the guide 440 is referred to as a first zone S1, and the zone that corresponds to the lower portion 4415 of the guide 440 is referred to as a second zone S2. The guide 440 and the base plate 510 may be parallel to each other in the first zone S1. Accordingly, when the perpendicular distance between the guide 440 and the base plate 510 is equal to or greater than a predetermined distance, the roller 530 may press the pants P with a constant pressure.

FIG. 13(*b*) schematically illustrates the state in which the roller 530 is positioned in the second zone S2. In the second zone S2, the base plate 510 may be flat, but the guide 440 may be curved such that the distance between the base plate 510 and the guide 440 decreases downwards. Accordingly, because the distance between the roller 530 and the moving unit 550 decreases in the second zone S2, the elastic member 552 may push out the roller 530 rather than pulling the roller 530 toward the base plate 510. Consequently, the force applied to the pants P may be removed or minimized in the second zone S2, which corresponds to the waist portion of the pants P. The reason for this is because the waist portion of the pants P is provided with various projecting elements, such as zippers, buttons and pockets, which are apt to be crushed by pressure, and unwanted double creases are apt to be formed.

In the second zone S2, it is possible to remove wrinkles by spraying steam through the steam spray hole 5331 to cause the steam to permeate the pants P rather than by pressing the pants P using the roller 530.

Although there is an advantage in that the base plate 510 and the guide 440 shown in FIG. 13 have a simpler shape than that shown in FIG. 12, it is preferable to have the shape shown in FIG. 12 in the interest of reduction of double creases in the pants P.

When the rotating shaft 536 includes the first rotating shaft 5361 and the second rotating shaft 5362, which are provided at the two ends of the roller 530, the moving unit 550 may include the first transfer portion 5501 and the second transfer portion 5502, which are provided at the two ends of the roller 530 and are respectively coupled to the first rotating shaft 5361 and the second rotating shaft 5362. The guide hole 415 may include the first guide hole 4151 and the second guide hole 4152, which are vertically formed in the two lateral sides of the base plate 510, in which the first transfer portion 5501 is inserted into the first guide hole 4151 and the second transfer portion 5502 is inserted into the second guide hole 4152. The elastic member 552 may include a first elastic member 5521, which is positioned at the first transfer portion 5501 so as to cause the roller 530 to press the pants P toward the base plate 510 and to support the rotating shaft 536, and a second elastic member 5522, which is positioned at the second transfer portion 5502 so as to cause the roller 530 to press the pants P toward the base plate 510 and to support the rotating shaft 536.

Accordingly, the apparatus may include a first guide 441, which is positioned on the rear surface 4011 so as to correspond to the first guide hole 415 and which controls the distance between the roller 530 and the moving unit 550 by controlling the distance to the base plate 510, and a second guide 442, which is positioned on the rear surface 4011 so as to correspond to the second guide hole 4152 and which controls the distance between the roller 530 and the moving unit 550 by controlling the distance to the base plate 510. Each of the first guide 441 and the second guide 442 may have the same shape as that of the guide 440.

As described above, the base plate 510 may include the support surface 515 configured to support the pants P. The support surface 515 may include the first support surface 5151, which is positioned at the upper portion thereof and is curved, the second support surface 5152, which extends parallel to the door inner plate 401 from the first support surface 5151, and the third support surface 5153, which is positioned at the lower portion thereof so as to be connected to the second support surface 5152 and is curved.

Preferably, the perpendicular distance between the door inner plate 401 and the first support surface 5151 may increase moving toward the second support surface 5152, the perpendicular distance between the door inner plate 401 and the second support surface 5152 may be constant, and the perpendicular distance between the door inner plate 401 and the third support surface 5153 may decrease moving away from the second support surface 5152.

Similarly, the first guide 441 may include the first guide surface 4411, which is positioned so as to correspond to the first support surface 5151 and to be parallel to the first support surface 5151, the second guide surface 4412, which is positioned so as to correspond to the second support surface 5152 and to be parallel to the second support surface 5152 and which is connected at one end thereof to one end of the first guide surface 4411, and the third guide surface 4413, which extends from the second guide surface 4412 parallel to the door inner plate 401.

The second guide 442 may include a fourth guide surface 4421, which is positioned so as to correspond to the first support surface 5151 and to be parallel to the first support surface 5151 and which has the same shape as that of the first guide surface 4411, a fifth guide surface 4422, which is positioned so as to correspond to the second support surface 5152 and to be parallel to the second support surface 5152 and which is connected at one end thereof to one end of the fourth guide surface 4421 and has the same shape as that of the second guide surface 4412, and a sixth guide surface 4423, which is positioned so as to correspond to the third support surface 5153 and which extends from the fifth guide surface 442 parallel to the door inner plate 401 and has the same shape as that of the fifth guide surface 4422.

FIG. 14 illustrates an embodiment capable of pressing the pants P using the elastic member 552 provided at the moving unit 550, regardless of the thickness of the pants P. Here, FIG. 14(*a*) illustrates the case in which thin pants are pressed, and FIG. 14(*b*) illustrates the case in which thick pants are pressed. As illustrated in FIG. 14, the perpendicular distance between the rear surface 4011 and the base plate 510 (or the roller 530) or the perpendicular distance between the guide surface 4401 and the base plate 510 (or the roller 530) may vary depending on the thickness of the pants P.

When it is intended to interpose the pants P between the base plate 510 and the roller 530, the roller 530 may be pulled, and the pants P hung on the laundry hanger support 405 may be inserted into the gap between the base plate 510 and the roller 530. Alternatively, the rotating shaft 536 may be detachably coupled to the moving support of one of the first transfer support 5511 and the second transfer support 5512, which support the roller 530, and the moving support of the other of the first transfer support 5511 and the second transfer support 5512 may be provided with a hinge so as to be rotatable. The hinge may be provided in the vertical direction of the door 400 so as to be parallel to the door 400. After the roller body 5301 is rotated about the hinge and the pants P are hung on the laundry hanger support 405, the roller body 5301 may be rotated again, and may be coupled to the moving support again.

FIG. 15(*a*) illustrates an embodiment in which the moisture supply has the steam spray holes. FIG. 15(*b*) illustrates an embodiment which is provided with the moisture-containing portion in place of the steam spray holes.

The moisture supply 533 may be provided with the porous moisture-containing portion 5332 (see FIG. 15), which is configured to have the form of a pipe surrounding the outer circumferential surface of the moisture supply 533, in place of spraying steam through the steam spray holes. The diameter of the outer circumferential surface of the moisture-containing portion 5332 (see FIG. 15) may be equal to or greater than the diameter of the second press 532 such that the moisture-containing portion 5332 is squeezed and the moisture contained therein is discharged to the outside when the pants P are pressed by the roller 530.

However, because steam is capable of permeating and spreading throughout the pants P by virtue of the ability thereof to permeate into the pants P even when the steam is sprayed only to a portion of the pants P, it is preferable to spray steam using the steam spray holes 5331 and the steam generation tank 580, compared to the moisture-containing portion 5332 (see FIG. 15).

In FIG. 15, the roller 530 is positioned at the uppermost level of the guide hole, which is the highest position to which the roller 530 is maximally movable by means of the moving unit 550. This position is referred to as an initial position. The controller (not shown) is capable of returning the roller 530 to the initial position whenever the operation of the press unit 500 is terminated in order to ensure constant positioning of the roller 530.

As described above, the roller 530 is capable not only of spraying steam but also of transmitting heat to the suspended pants P by means of the first heater 5351 and the second heater 5352. The reason for this is because wrinkles in fabric are further removed at a temperature higher than an ambient temperature. Furthermore, the wrinkles are more efficiently removed by spraying steam.

Because the press unit 500 is capable of performing both steam spray and heat transmission to the pants P via the roller 530, there is no need to use the steam unit 250 and the heat pump unit 230 in order to refresh the laundry disposed in the first chamber 100. Accordingly, there is no need to take out all of the laundry in the first chamber 100 and operate the steam unit 250 and the heat pump unit 230 in order to remove wrinkles from a pair of pants. A user is able to select a course associated with treatment of pants and to operate only the press unit 500. Accordingly, an interface may be provided such that a user is able to select the course associated with management of pants independently of courses for managing laundry disposed in the first chamber 100. Therefore, it is possible to achieve energy reduction and to improve user convenience.

Furthermore, it is possible to operate only the press unit 500 even when the door is open.

FIG. 16(*a*) illustrates an embodiment of the press unit 500, in which the roller 574 performs only rotation at a fixed position. The press unit 500 may include the door inner plate 401 of the door 400, which faces the first chamber 100, the rotating shaft 575, which is provided in the width direction of the door 400, the roller 574 configured to be rotated about the rotating shaft 575 and to press the pants P, a stationary support 573, which is coupled to the door inner plate 401 so as to support the rotating shaft 575 and the roller 574 at a fixed position, and the base plate 510, which is coupled to the door inner plate 401 so as to support the pants P disposed between the door inner plate 401 and the roller 574.

If the roller 574, which is rotated at a fixed position, is referred to as a stationary roller, the stationary roller may include a stationary roller body defining the appearance of the stationary roller, a stationary roller rotating shaft configured to rotate the stationary roller body, and a stationary mount configured to support the stationary rotating shaft at a fixed position on the door inner plate 401.

The stationary support 573 may be coupled to the door inner plate 401 at a fixed position. Accordingly, the rotating shaft 575 (or the stationary roller rotating shaft), supported by the stationary support 573 (or the stationary mount), and the roller body 570 (or the stationary roller), rotatable about the rotating shaft 575, may also always be rotated at a fixed position. The roller 570 (or the stationary roller) is capable of pressing the pants P toward the base plate 510 using an elastic member (not shown).

Referring to FIG. 16(*b*), which is a cross-sectional view taken along line A-A' in FIG. 16(*a*), the pants P, which are interposed between the roller 530 and the base plate 510, may be relatively movable due to rotation of the roller 530. Although the roller 530 is fixed, the pants P are movable in the vertical direction of the door depending on the rotational direction of the roller 530. Consequently, the roller 530 is capable of pressing the entirety of the leg parts, rather than a portion of the leg parts.

FIG. 17 schematically illustrates an embodiment of the fixed roller 530. As illustrated in FIG. 17(*a*), the base plate 510 may be coupled to the door 400 in the state of being spaced apart from the door 400 via an elastic support 511. The reason for this is to enable the base plate 510 to be in close contact with the pants P. Because a portion of the pants is interposed between the base plate 510 and the roller 530, there may be need to provide an additional laundry hanger support 405. The pants P interposed between the base plate 510 and the roller 530 may be moved in an upward or downward direction along the base plate 510 in the state of being pressed by the roller 530 due to the frictional force with the roller 530. FIG. 17(*b*) illustrates the state in which the pants P interposed between the base plate 510 and the roller 530 are moved downwards due to rotation of the roller 530 for a certain period of time. If the roller 530 is rotated in the opposite direction, the pants interposed between the base plate 510 and the roller 530 will be moved to the position shown in FIG. 17(*a*).

FIG. 17 illustrates an embodiment in which the pants P are pressed between the base plate 510 and the single roller 530, whereas FIG. 18 illustrates an embodiment in which the pants P are pressed between a pair of rollers 671 and 672. Like a rolling process in a factory, the pair of rollers 671 and 672 may press the pants P interposed therebetween. Although the pair of rollers 671 and 672 are positioned on the door inner plate so as to move the pants P vertically in FIG. 18(*a*), the support plate may be provided so as to be perpendicular to the door inner plate and the pair of rollers 671 and 672 are disposed on the support plate such that the pants P are moved horizontally.

FIG. 18(*b*) illustrates a cross section of the press unit including the pair of rollers 671 and 672. The press unit 500 may include the base plate 510, which is coupled to the door inner plate 401 and presses the pants P, a first shaft 6711 provided in the width direction of the door 400, a first roller 671 rotatable about the first shaft 6711, a first roller support 6714 configured to support the first roller 671 while allowing the first roller 671 to be moved in the vertical direction of the door 400, a second shaft 6721 provided in the width direction of the door 400, a second roller 672, which is rotated about the second shaft 6721 by rotation of the first roller 671 and which presses the pants P in cooperation with the first roller 671, a second roller support 6724 configured to support the second roller 672 at a fixed position, and an elastic connector 6712 configured to elastically connect the first roller support 6714 to the second roller support 6724 to thus cause the first roller 671 and the second roller 672 to move toward each other.

One of the first roller 671 and the second roller 672 is rotatable at a fixed position. FIG. 18(*b*) illustrates an embodiment in which the second roller 672 is rotatable at a fixed position. Meanwhile, the first roller 671 may be configured to be movable to some extent in the vertical direction of the door. The reason for this is to vary the distance between the first roller 671 and the second roller 672 depending on the thickness of the pants P. Accordingly, the first roller 671 may include a mover 675 configured to allow the first roller 671 to be moved along the door inner plate 401.

One of the first roller 671 and the second roller 672 may be provided with the moisture supply 533 and the heater 535. Alternatively, the first roller 671 may be provided with the moisture supply 533, and the second roller 672 may be provided with the heater 535. Each of the first roller 671 and the second roller 672 may be depressed in the intermediate portion thereof so as to avoid interference with stitch lines of the pants P. In other words, the diameter of the intermediate portion of each of the first roller 671 and the second roller 672 may be smaller than the diameter of the two ends thereof.

FIG. 19 illustrates an embodiment of a cover 430 configured to protect the press unit 500 provided in the laundry treatment apparatus 1000. The press unit 500 may include the cover 430, which is rotatably provided on the door inner plate 401 so as to open and close the laundry hanger support 405, the base plate 510, the rotating shaft 536, the roller 530, and the moving unit 550.

The cover 430 is intended to prevent the press unit 500 from being exposed to steam or heated air when the door 400 is closed and steam and heated air is supplied into the first chamber 100 by operating the steam unit 250 and the heat pump unit 230, which are provided in the second chamber 200.

By configuring the cover 430 in this way, the cover 430 may be rotated so as to cover the press unit 500 and then the press unit 500 may be independently operated alone even when the door 400 is open. Furthermore, the press unit 500 may be operated independently of the first chamber 100 even when the laundry disposed in the first chamber 100 is refreshed.

If the space in which the press unit 500 is positioned is closed by the cover 430, steam discharged from the press unit 500, water vapor which is generated in such a manner that the steam which has permeated laundry is converted into moisture and the moisture is heated by the heater 535, and heated air may not be discharged. In this case, it is impossible to dry the laundry within a predetermined period of time. In order to prevent this problem, the cover 430 may have first communication hole 4311 and a second communication hole 4315, which are formed through the cover 430. The first communication hole 4311 may be provided therein with a cover-venting fan 4313 configured to forcibly discharge air and moisture in the space closed by the cover 430. Meanwhile, the second communication hole 4315 may be provided therein with a cover-venting cover 4317 configured to exchange the air and the moisture in the space closed by the cover 430 with the outside air and moisture. The cover-venting cover 4317 may be configured to have a shape such as a louver shape.

If the cover-venting fan 4313 is provided at an upper portion of the cover 430, the cover-venting cover 4317 may serve as a guide functioning to allow outside air to be introduced into the laundry treatment apparatus. Only one of the cover-venting fan 4313 and the cover-venting cover 4317 may be provided.

FIG. 20 illustrates an embodiment of the press unit capable of removing wrinkles from the pants in the state in which only a portion of the door is opened without opening the inlet to the laundry treatment apparatus 4000 and the pants are suspended therein. The door may be provided therein with the press unit, and an additional door may be provided so as to allow access to the press unit, in addition to the door configured to open and close the inlet to the cabinet. The additional door may be referred to as a door-in-door.

In other words, the laundry treatment apparatus 4000 may include the cabinet 150 having the inlet 120 formed in one surface thereof, the first chamber 100 defined in the cabinet 150 so as to receive laundry therein through the inlet 120, the second chamber 200, which is positioned below the first chamber 100 and defines a space separated from the first chamber 100, and a door assembly 450, which is rotatably coupled to the cabinet 150 so as to open and close the inlet 120.

The door assembly 450 may include a first door body 451, which includes a door communication hole 4511 formed in one surface thereof and which is rotatably coupled to the cabinet 150 so as to open and close the inlet 120, a second door body 452, which is rotatably coupled to the first door body 451, which defines a pants-pressing space 4513 separated from the first chamber 100 in conjunction with the first door body 451, and which opens and closes the door communication hole 4511, the laundry hanger support 405, which is positioned in the pants-pressing space 4513 and on one of the two door bodies and on which the pants P are hung, the base plate 510, which is coupled to one of the two door bodies and supports the suspended pants P, the rotating shaft 536 provided in the width direction of the door assembly 450, the roller 530, which is rotatable about the rotating shaft 536 and presses the pants P, and the moving unit 550, which supports the rotating shaft 536 and moves the rotating shaft 536 and the roller 530 in the vertical direction (in the Y-axis direction) of the door assembly 450.

The first door body 451 may include an indoor venting fan 4316 or an indoor venting cover 4318, which allows the pants-pressing space 4513 to communicate with the first chamber 100 to thus discharge the air and/or moisture in the pants-pressing space 4513 to the first chamber 100 or exchange the air and/or moisture in the pants-pressing space 4513 with the air and/or moisture in the first chamber 100. Alternatively, only one of the indoor venting fan 4316 and the indoor venting cover 4318 may be provided.

Alternatively, the indoor venting fan 4316 or the indoor venting cover 4318 may be provided at the second door body 452 rather than the first door body 451. In this case, the air and/or steam may be discharged and circulated to the outside rather than to the first chamber. The reason for this is because it is impossible to discharge sprayed steam and heated air in the closed space such as the pants-pressing space 4513. In other words, the reason for this is because, in the case in which the indoor venting fan 4316 or the indoor venting cover 4318 is not provided, steam, moisture or heated air may remain in the pants-pressing space 4513 even when the operation of the press unit 500 is terminated.

In the case in which the laundry treatment apparatus includes the door assembly 450, it is possible to independently operate only the press unit 500 even when the door 400 is open. Furthermore, it is also possible to operate the press unit 500 independently of the first chamber 100 in the case in which laundry disposed in the first chamber 100 is refreshed.

FIG. 21 illustrates an embodiment in which a space capable of pressing pants is additionally provided in the first chamber.

Specifically, the laundry treatment apparatus 5000 may include the cabinet 150 having the inlet 130 formed in one surface thereof, the first chamber 100, which is defined in the cabinet 150 and receives laundry therein through the inlet 120, the second chamber 200, which is positioned below the first chamber 100 and defines a space separated from the first chamber 100, the door 400 rotatably coupled to the cabinet 150 so as to open and close the inlet 120, and an inner chamber assembly 130 capable of being taken out of the first chamber 100 through the inlet 120 when the door 400 is open. The inner chamber assembly may also be referred to as an inner pants press.

The inner chamber assembly 130 may include an inner chamber 131, which has a subsidiary entrance 121 formed in one surface thereof and defines a reception space 125, which is separated from the first chamber 100 and receives pants therein, an inner door 132 rotatably coupled to the inner chamber 131 so as to open and close the subsidiary entrance 121, the laundry hanger support 405, which is coupled to one of the inner surfaces of the inner chamber 131 defining the reception space 125 and on which the pants P are hung, the base plate 510, which is positioned on the one of the inner surfaces of the inner chamber 131 so as to support the pants P hung on the laundry hanger support 405, the rotating shaft 536 provided in the width direction of the inner chamber 131, the roller 530, which is rotatable about the rotating shaft 536 and presses the pants P, and the moving unit 550, which supports the rotating shaft 536 and moves the roller 530 in the vertical direction of the inner chamber 131.

The inner door 132 may be provided with an inner venting fan 1358 or an inner venting cover 1359, which allows the reception space 125 to communicate with the first chamber 100 to thus discharge the air and/or moisture in the reception space 125 to the first chamber 100 or to thus exchange the air and/or moisture in the reception space 125 with the air and/or moisture in the first chamber 100. Alternatively, only one of the inner venting fan 1358 and the inner venting cover 1359 may be provided. The reason for this is because it is impossible to discharge sprayed steam and heated air in a closed space such as the reception space 125. In other words, the reason for this is because, in the case in which the inner venting fan 1358 or the inner venting cover 1359 is not provided, steam, moisture or heated air may remain in the reception space 125 even when operation of the press unit 500 is terminated.

In the case in which the laundry treatment apparatus includes the inner door assembly 450, it is possible to independently operate only the press unit 500 even when the door 400 is open. Furthermore, it is also possible to operate the press unit 500 independently of the first chamber 100 in the case in which the laundry disposed in the first chamber 100 is being refreshed.

FIG. 22 illustrates a hinge structure, which allows the inner door 132 to be opened and positioned in the first chamber 100 and which connects the inner chamber 131 to the inner door 132. The inner door assembly 450 may be normally positioned in the first chamber 100, and may be taken out of the first chamber 100 when necessary. To this end, the inner door assembly 450 may include an inner guide 135, which guides sliding removal of the inner door assembly 450 from the first chamber 100 through the inlet 120. The inner guide 135 may allow the inner door assembly 450 to be slidably removed from the first chamber 100 or to be inserted into the first chamber 100.

Referring to the insets denoted by F1 and F2 in FIG. 22, when the inner door 132 is open, the press unit 500 may be positioned in the reception space 125. The inner door 132 may be hingedly coupled to the inner chamber 131 via an inner door hinge 133. The inner door hinge 133 may include a bar-shaped hinge body 1331*c*, a first rotating shaft 1331*a* rotatably coupling one end of the hinge body 1331*c* to the inner chamber 131, and a second rotating shaft 1331*b* rotatably coupling the other end of the hinge body 1331*c* to the inner door 132. The hinge body 371 may be configured to have a bar shape such that an inflection point is formed between the first rotating shaft 1331*a* and the second rotating shaft 11331*b*. Consequently, it is possible to open and close the inner door 132 in a narrow space without interfering with the pants P held by the press unit 500.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treatment apparatus comprising:

a cabinet including an inlet defined in one side thereof;

a first chamber positioned in the cabinet and receiving laundry therein through the inlet;

a second chamber positioned below the first chamber and defining a space separated from the first chamber;

a door rotatably coupled to the cabinet to open and close the inlet;

a door inner plate positioned at a side of the door that faces the first chamber;

a laundry hanger support provided on the door inner plate and supporting pants hung thereon;

a base plate coupled to the door inner plate and supporting the pants hung on the laundry hanger support;

a rotating shaft provided in a width direction of the door;

a roller rotating about the rotating shaft and pressing the pants;

a moving unit supporting the rotating shaft and moving in a vertical direction of the door due to rotation of the roller; and a drive unit provided at the roller to thereby rotate the roller.

2. The laundry treatment apparatus of claim 1, wherein the roller comprises:

a first cylindrical press positioned close to one end of the roller so as to press the pants;

a second cylindrical press positioned close to another end of the roller so as to press the pants; and a cylindrical moisture supply, which is positioned between the first press and the second press so as to connect the first press to the second press and supplies moisture to the pants.

3. The laundry treatment apparatus of claim 2, wherein the roller is capable of supplying steam to the pants through the moisture supply and of pressing the pants while rotating, even when the door is open.

4. The laundry treatment apparatus of claim 2, wherein the moisture supply has a diameter smaller than a diameter of the first press and the second press.

5. The laundry treatment apparatus of claim 4, wherein the moisture supply comprises:

a steam generation tank positioned in the moisture supply and configured to store water therein and to discharge generated steam;

a steam heater positioned in the steam generation tank and heating the water stored in the steam generation tank; and a plurality of steam spray holes formed in an outer circumferential surface of the moisture supply so as to spray the steam, which is generated by the steam heater and discharged from the steam generation tank, to the pants.

6. The laundry treatment apparatus of claim 5, wherein the steam heater is a coil heater.

7. The laundry treatment apparatus of claim 5, wherein the roller further comprises a tank connector provided between one of the first press and the second press and the moisture supply so as to couple or separate the steam generation tank.

8. The laundry treatment apparatus of claim 7, wherein the moisture supply comprises:

a first moisture supply body including a tank introduction port configured to allow the steam generation tank to be inserted and separated into and from the moisture supply; and a second moisture supply body coupled to the tank introduction port.

9. The laundry treatment apparatus of claim 4, wherein the moisture supply includes a porous moisture-containing portion configured to have a form of a pipe surrounding an outer circumferential surface of the moisture supply and to contain moisture therein, the moisture-containing portion having a diameter equal to or greater than the diameter of the first press and the second press.

10. The laundry treatment apparatus of claim 2, wherein the roller comprises:

a first heater provided in the first press so as to heat the first press; and a second heater provided in the second press so as to heat the second press.

11. The laundry treatment apparatus of claim 10, wherein the first heater and the second heater are respectively provided along an inner circumferential surface of the first press and an inner circumferential surface of the second press.

12. The laundry treatment apparatus of claim 1, wherein the door includes a guide hole formed through the door inner plate in the vertical direction of the door, and wherein the moving unit is movable along the guide hole in the vertical direction of the door when the roller is rotated.

13. The laundry treatment apparatus of claim 12, wherein the moving unit comprises:

a moving mount inserted partway into the guide hole and moved in the vertical direction of the door; and a moving support coupled to the moving mount so as to support the rotating shaft.

14. The laundry treatment apparatus of claim 13, wherein the moving unit further comprises a wheel provided parallel to the width direction of the door and coupled to a surface of the moving mount that is inserted into the guide hole, the wheel having a length greater than a length of the guide hole in a width direction thereof in order to prevent the moving unit from being separated from the guide hole.

15. The laundry treatment apparatus of claim 14, wherein the moving unit further comprises an elastic member positioned between the moving support and the moving mount so as to provide external force required for the roller to press the pants.

16. The laundry treatment apparatus of claim 15, wherein the moving unit is moved along the guide hole in one direction among an upward direction and a downward direction when the roller is rotated in a first rotational direction, and is moved along the guide hole in a direction opposite the one direction when the roller is rotated in a second rotational direction, opposite the first rotational direction.

17. The laundry treatment apparatus of claim 16, wherein, when the rotation of the roller is halted, the movement of the moving unit is also halted.

18. The laundry treatment apparatus of claim 1, further comprising a cover rotatably provided at the door or the door inner plate so as to open and close the laundry hanger support, the base plate, the rotating shaft, the roller, and the moving unit.

19. The laundry treatment apparatus of claim 1, wherein the rotating shaft comprises:

a first rotating shaft coupled to one end of the roller; and a second rotating shaft coupled to another end of the roller.

20. The laundry treatment apparatus of claim 19, wherein the door includes a guide hole formed through the door inner plate in the vertical direction of the door, wherein the moving unit comprises:

a first transfer portion coupled to the first rotating shaft; and a second transfer portion coupled to the second rotating shaft, wherein the guide hole comprises:

a first guide hole formed between one side surface of the base plate and a side surface of the door that is positioned close to the one side surface of the base plate; and a second guide hole formed between another side surface of the base plate and another side surface of the door, which is positioned close to the another side surface of the base plate, wherein the first transfer portion is movable along the first guide hole in the vertical direction of the door when the roller is rotated, and wherein the second transfer portion is movable along the second guide hole in the vertical direction of the door when the roller is rotated.

21. A laundry treatment apparatus comprising:

a cabinet including an inlet defined in one side thereof;

a first chamber positioned in the cabinet and receiving laundry therein through the inlet;

a second chamber positioned below the first chamber and defining a space separated from the first chamber;

a door rotatably coupled to the cabinet to open and close the inlet;

a door inner plate positioned at a side of the door that faces the first chamber;

a laundry hanger support provided on the door inner plate and supporting pants hung thereon;

a base plate coupled to the door inner plate and supporting the pants hung on the laundry hanger support;

a rotating shaft provided in a width direction of the door;

a roller rotating about the rotating shaft and pressing the pants, a diameter of an outer circumferential surface of a region of the roller corresponding to a predetermined length in a direction of the rotating shaft being less than a diameter of two ends of the roller;

a moving unit supporting the rotating shaft and moving in a vertical direction of the door due to rotation of the roller; and a drive unit provided at the roller or the moving unit so as to rotate the roller.

22. A laundry treatment apparatus comprising:

a cabinet including an inlet defined in one side thereof;

a first chamber positioned in the cabinet and receiving laundry therein through the inlet;

a second chamber positioned below the first chamber and defining a space separated from the first chamber;

a door rotatably coupled to the cabinet to open and close the inlet;

a door inner plate positioned at a side of the door that faces the first chamber;

a rotating shaft provided in a width direction of the door;

a roller rotating about the rotating shaft and pressing the pants;

a stationary support coupled to the door inner plate and supporting the rotating shaft and the roller at a fixed position;

a base plate coupled to the door inner plate so as to support the pants positioned between the base plate and the roller; and a drive unit provided at the roller to thereby rotate the roller.

23. The laundry treatment apparatus of claim 22, wherein the roller comprises:

a first cylindrical press positioned close to one end of the roller so as to press the pants;

a second cylindrical press positioned close to another end of the roller so as to press the pants; and a cylindrical moisture supply, which is positioned between the first press and the second press so as to connect the first press to the second press and supplies moisture to the pants.

24. The laundry treatment apparatus of claim 23, wherein the moisture supply has a diameter smaller than a diameter of the first press and the second press.

25. A laundry treatment apparatus comprising:

a cabinet including an inlet defined in one side thereof;

a first chamber positioned in the cabinet and receiving laundry therein through the inlet;

a second chamber positioned below the first chamber and defining a space separated from the first chamber;

a door rotatably coupled to the cabinet to open and close the inlet;

a door inner plate positioned at a side of the door that faces the first chamber;

a base plate coupled to the door inner plate so as to press the pants;

a first shaft provided in a width direction of the door;

a first roller rotating about the first shaft;

a first roller support supporting the first roller in such a manner as to move the first roller in a vertical direction of the door;

a second shaft provided in the width direction of the door;

a second roller rotating about the second shaft by rotation of the first roller and pressing the pants in cooperation with the first roller;

a second roller support supporting the second roller at a fixed position;

an elastic connector disposed between the first roller support and the second roller support and connected thereto for transmission of elastic force therebetween so as to move the first roller toward the second roller.

26. A laundry treatment apparatus comprising:

a cabinet including an inlet defined in one side thereof;

a first chamber positioned in the cabinet and receiving laundry therein through the inlet;

a second chamber positioned below the first chamber and defining a space separated from the first chamber; and a door assembly rotatably coupled to the cabinet to open and close the inlet, wherein the door assembly comprises:

a first door body having a door communication hole formed in one surface thereof, the first door body being rotatably coupled to the cabinet so as to open and close the inlet;

a second door body rotatably coupled to the first door body so as to define a pants-pressing space separated from the first chamber in conjunction with the first door body and to open and close the door communication hole;

a laundry hanger support positioned at one of the first door body and the second door body and in the pants-pressing space and supporting pants hung thereon;

a base plate coupled to the one of the first door body and the second door body so as to support the pants disposed thereon;

a rotating shaft provided in a width direction of the door assembly;

a roller rotating about the rotating shaft and pressing the pants;

a moving unit supporting the rotating shaft and moving the rotating shaft and the roller in a vertical direction of the door assembly due to rotation of the roller; and a drive unit provided at the roller or the moving unit so as to rotate the roller.

27. A laundry treatment apparatus comprising:

a cabinet including an inlet defined in one side thereof;

a first chamber positioned in the cabinet and receiving laundry therein through the inlet;

a second chamber positioned below the first chamber and defining a space separated from the first chamber;

a door rotatably coupled to the cabinet to open and close the inlet;

an inner chamber capable of being taken out of the first chamber through the inlet when the door is open, the inner chamber having a subsidiary entrance formed in one surface thereof and defining a reception space separated from the first chamber to receive pants therein;

an inner door rotatably coupled to the inner chamber to open and close the subsidiary entrance;

a laundry hanger support coupled to one of inner surfaces of the inner chamber defining the reception space and supporting the pants hung thereon;

a base plate positioned on the one of the inner surfaces of the inner chamber so as to support the pants hung on the laundry hanger support;

a rotating shaft provided in a width direction of the inner chamber;

a roller rotating about the rotating shaft and pressing the pants;

a moving unit supporting the rotating shaft and moving the rotating shaft and the roller in a vertical direction of the inner chamber due to rotation of the roller; and a drive unit provided at the roller or the moving unit so as to rotate the roller.

* * * * *